US007263298B2

(12) United States Patent
Nagamine et al.

(10) Patent No.: US 7,263,298 B2
(45) **Date of Patent: *Aug. 28, 2007**

(54) IMAGE FORMING APPARATUS MOUNTED WITH REPLACEABLE UNIT, IMAGE FORMING SYSTEM, AND METHOD OF CONTROLLING IMAGE FORMING APPARATUS

(75) Inventors: Kiyoshi Nagamine, Saitama (JP); Yasushi Sakata, Saitama (JP); Tsuneo Toda, Saitama (JP); Haruhiko Okabe, Saitama (JP); Akinori Ono, Saitama (JP); Hiroh Soga, Saitama (JP); Takeshi Yokoe, Saitama (JP); Kiyoshi Kimura, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 139 days.

This patent is subject to a terminal disclaimer.

(21) Appl. No.: 11/082,911

(22) Filed: Mar. 18, 2005

(65) Prior Publication Data

US 2005/0254839 A1 Nov. 17, 2005

(30) Foreign Application Priority Data

May 17, 2004 (JP) ..... P.2004-146136
May 17, 2004 (JP) ..... P.2004-146137

(51) Int. Cl.
*G03G 15/00* (2006.01)
*G03G 21/00* (2006.01)

(52) U.S. Cl. ..... 399/12; 399/81; 399/82

(58) Field of Classification Search ..... 399/12, 399/81, 82, 24, 27, 8, 9, 111; 347/19, 49, 347/86

See application file for complete search history.

(56) References Cited

U.S. PATENT DOCUMENTS

| | | | | |
|---|---|---|---|---|
| 2005/0244170 | A1* | 11/2005 | Ono et al. | 399/12 |
| 2005/0254832 | A1* | 11/2005 | Kumai et al. | 399/12 |
| 2005/0254833 | A1* | 11/2005 | Yokoe | 399/12 |
| 2005/0254835 | A1* | 11/2005 | Takei | 399/12 |
| 2005/0254837 | A1* | 11/2005 | Takahashi | 399/12 |
| 2005/0254838 | A1* | 11/2005 | Takahashi | 399/12 |

FOREIGN PATENT DOCUMENTS

| | | |
|---|---|---|
| JP | A-6-149051 | 5/1994 |
| JP | B2-2602341 | 1/1997 |
| JP | A-10-133528 | 5/1998 |
| JP | 2000-284581 | 10/2000 |
| JP | A-2001-100598 | 4/2001 |
| JP | B2-3476704 | 9/2003 |

* cited by examiner

*Primary Examiner*—Sophia S. Chen
(74) *Attorney, Agent, or Firm*—Oliff & Berridge, PLC

(57) ABSTRACT

In the case of being mounted with any cartridge other than a genuine cartridge, which accommodates a toner other than a genuine toner, a user can select as an operation mode other than that corresponding to a genuine toner, through a UI device 18, making a correction to the consumption of a developer by combining conditions to be changed, such as increasing or decreasing the degree of a change (gradient) in a set value of the toner density with respect to the consumption of a developer (m1 or m2); increasing or decreasing a limit value (m1 or m2); varying an initial value (consumption=0) (m3); no making a change in a set value according to the consumption (m4); and no making a change in a set value according to the consumption, for example, by varying an initial value (m5)

12 Claims, 34 Drawing Sheets

OPERATION MODE SELECTION PROCESS WITH RESPECT TO GENUINE ARTICLE (S1030)

IMAGE FORMING APPARATUS MOUNTED WITH REPLACEABLE UNIT, IMAGE FORMING SYSTEM, AND METHOD OF CONTROLLING IMAGE FORMING APPARATUS

BACKGROUND OF THE INVENTION

1. Field of the Invention

The present invention relates to an image forming apparatus mounted with replaceable units, an image forming system, and a method of controlling the image forming apparatus, and more specifically, to an image forming apparatus in which the replaceable units are replaceably mounted in an image forming apparatus main body.

2. Background Art

An image forming apparatus which allows a user to easily replace a unit including consumables and the like is known.

Meanwhile, if a replaceable unit replaced by a user is not a genuine article for an image forming apparatus, there are problems in that the performance of the image forming apparatus cannot be sufficiently exhibited, like deterioration of the image quality, the operation of the apparatus cannot be guaranteed, or the apparatus can get out of order. This is because the image forming apparatus controls processes for forming an image in consideration of characteristics of a toner, characteristics of an image carrier, an electrification voltage, cleaning characteristics, fixing characteristics and the like.

Therefore, in order to maintain the image quality of an image forming apparatus, and to prevent occurrence of the above problems, JP-A-10-133528 discloses a method which comprises providing a genuine replaceable part with a data carrier for holding consumption data on consumables, and discriminating whether the genuine replaceable unit has been supplied with the consumables by comparing a consumption detected by a consumption detecting unit provided in an image forming apparatus main body with the consumption data held by the data carrier.

Further, JP-A-6-149051 discloses a method which comprises providing a toner cartridge with a storage unit for storing predetermined coded data, and inhibiting copying when the predetermined coded data stored in the storage unit has not yet been read from the copying machine main body side.

Further, JP-A-2001-100598 discloses a method which comprises performing warning display and printing inhibition when empty information to be written in a cartridge at the time of detection of run-out of a toner is read from a cartridge refilled with a toner.

Further, Japanese Patent No. 2602341 discloses a method which comprises making the count of the images formed and storing it in a memory of a cartridge, and, if a preset final count representing the number of images capable of being formed by a cartridge is equal to the count of images which are actually formed, disabling the cartridge from being used afterwards.

Moreover, Japanese Patent No. 3476704 discloses a method which comprises setting an image forming condition whose level is lowered than that of an appropriate image forming condition, thereby allowing a user to easily find the fact that a mounted toner refilling container is inappropriate, when it is determined that the toner refilling container is inappropriate through duplex communication between a communication unit of the toner refilling container side and a communication unit of an apparatus main body side, and a selective input unit selects the fact that the user continues to refill a toner while inappropriateness of the container is ignored.

SUMMARY OF THE INVENTION

A first object of the present invention is to provide an image forming apparatus, an image forming system, and a method of controlling the image forming apparatus, which can use a replaceable unit other than a genuine article, by a user's intention, even when the replaceable unit other than a genuine article is mounted.

Further, a second object of the present invention is to provide an image forming apparatus which can use a replaceable unit other than a genuine article by a user's intention, even when the replaceable unit other than a genuine article is mounted.

In order to achieve the above-mentioned objects, according to a first aspect of the invention, there is provided an image forming apparatus including: an image forming apparatus main body; at least one replaceable unit replaceably mounted in the image forming apparatus main body; a discriminating unit that discriminates whether or not the replaceable unit is genuine; an input unit for selecting any one of an operation mode corresponding to the replaceable unit which is genuine and other operation modes than the operation mode; and a control unit that performs control in an operation mode selected by the input unit. That is, a user can select an operation mode corresponding to a replaceable unit which is genuine, or other operation modes, and can use replaceable units which are not genuine depending on user's intention.

In addition, the operation mode mentioned herein means aspects of control of an image forming apparatus, and includes not only programs and control parameters for forming an image, but also input and output conditions, and further includes aspects of display onto a display device, which are not directly related to the image formation.

Preferably, the operation mode corresponding to the replaceable unit which is genuine is set as a default. Accordingly, if a replaceable unit is genuine, the image forming apparatus can be controlled in an operation mode corresponding to the genuine replaceable unit without the operation mode being selected by a user.

Further, preferably, the image forming apparatus further includes a display unit that performs display on the basis of discrimination results of the discriminating unit. Accordingly, a user can confirm display based on discrimination results on whether or not a replaceable unit is genuine.

According to a second aspect of the invention, there is provided an image forming apparatus including: an image forming apparatus main body; at least one replaceable unit replaceably mounted in the image forming apparatus main body; a detecting unit that detects that the replaceable unit has been replaced; a discriminating unit that discriminates whether or not the replaceable unit is genuine, if the detecting unit detects that the replaceable unit has been replaced; an input unit for selecting any one of an operation mode corresponding to the replaceable unit which is genuine and other operation modes than the operation mode; and a control unit that performs control in an operation mode selected by the input unit. That is, if a replaceable unit has been replaced, it is discriminated whether or not the replaceable unit is genuine, and a user can select an operation mode corresponding to a replaceable unit which is genuine, and other operation modes.

Preferably, the input unit can select an operation mode even when the replacement of the replaceable unit is not detected by the detecting unit. That is, a user can select an operation mode, even when a replaceable unit is not replaced.

Further, preferably, the discriminating unit discriminates whether or not the replaceable unit is genuine when the detecting unit detects that the replaceable unit has been replaced. Accordingly, when a replaceable unit has been replaced, a user can select an operation mode, and a user can use a replaceable unit other than a genuine article, by the user's intention, even when the replaceable unit other than a genuine article is mounted.

Further, preferably, the discriminating unit discriminates whether or not the replaceable unit is genuine after the detecting unit detects that the replaceable unit has been replaced. Accordingly, even when the discriminating unit cannot discriminate whether or not a replaceable unit is genuine at the very moment when the replaceable unit is replaced, the discriminating unit can discriminate whether or not the replaceable unit is genuine after a predetermined time has elapsed.

According to a third aspect of the invention, there is provided an image forming system including: an image forming apparatus and a host apparatus connected to the image forming apparatus. The image forming apparatus has an image forming apparatus main body; at least one replaceable unit replaceably mounted in the image forming apparatus main body; a discriminating unit that discriminates whether or not the replaceable unit is genuine; and a control unit that performs control in an operation mode selected. The host apparatus has an input unit for selecting any one of an operation mode corresponding to the replaceable unit which is genuine and other operation modes than the operation mode. Accordingly, a user can select an operation mode corresponding to a replaceable unit, which is genuine, or other operation modes using the host apparatus, and the user can use a replaceable unit other than a genuine article, by the user's intention, even when the replaceable unit other than a genuine article is mounted.

According to a fourth aspect of the invention, there is provided a method of controlling an image forming apparatus in which at least one replaceable unit is mounted in an image forming apparatus main body, the method including the steps of: discriminating whether or not the mounted replaceable unit is genuine; waiting until a user selects an operating mode after performing display that urges the user to select an operation mode; and performing control in an operation mode corresponding to input by the user, if the user selects the operation mode. That is, the image forming apparatus can be controlled in an operation mode selected after a user confirms display which urges the user to select an operation mode.

According to a fifth aspect of the invention, there is provided a method of controlling an image forming apparatus in which at least one replaceable unit is mounted in an image forming apparatus main body, the method including the steps of: discriminating whether or not the mounted replaceable unit is genuine; waiting until a user selects an operating mode after performing display that urges the user to select an operation mode, if it is discriminated that the mounted replaceable unit is not genuine; and performing control in an operation mode corresponding to input by the user, if the user inputs the operation mode. That is, if it is discriminated that a mounted replaceable unit is genuine, the image forming apparatus can be controlled in a default operation mode without waiting for a user to select an operation mode. If it is discriminated that the mounted replaceable unit is not genuine, the image forming apparatus can be controlled in an operation mode corresponding to the input by the user.

According to a sixth aspect of the invention, there is provided a method of controlling an image forming apparatus in which at least one replaceable unit is mounted in an image forming apparatus main body, the method including the steps of: detecting that the replaceable unit has been mounted in the image forming apparatus main body; discriminating whether or not the mounted replaceable unit is genuine; waiting until a user selects an operating mode after performing display that urges the user to select an operation mode; and performing control in an operation mode corresponding to input by the user, if the user inputs the operation mode. That is, since the image forming apparatus performs display which urges a user to select an operation mode after the image forming apparatus discriminates whether or not a mounted replaceable unit is genuine, the user can select an operation mode after has confirmed display which urges the user to select an operation mode.

According to a seventh aspect of the invention, there is provided a method of controlling an image forming apparatus in which at least one replaceable unit is mounted in an image forming apparatus main body, the method including the steps of: detecting that the replaceable unit has been mounted in the image forming apparatus main body; discriminating whether or not the mounted replaceable unit is genuine; waiting until a user selects an operating mode after performing display that urges the user to select an operation mode, if it is discriminated that the mounted replaceable unit is not genuine, and performing control in an operation mode corresponding to input by the user, if the user inputs the operation mode. That is, if it is discriminated that a mounted replaceable unit is genuine, the image forming apparatus can be controlled in a default operation mode without waiting for a user to select an operation mode. If it is discriminated that the mounted replaceable unit is not genuine, the image forming apparatus can be controlled in an operation mode selected after a user confirms display which urges the user to select an operation mode.

According to a eighth aspect of the invention, there is provided an image forming apparatus including: an image forming apparatus main body; at least one replaceable unit replaceably mounted to the image forming apparatus main body; a storage unit, provided in the replaceable unit, for storing information regarding a consumption of the replaceable unit; a discriminating unit for, based on the information acquired from the storage unit, discriminating whether or not the replaceable unit is a genuine article; an input unit for selecting any one of an operation mode corresponding to the replaceable unit which is the genuine article and operation modes different from the operation mode; and a control unit for performing controls according to the selected operation mode by the input unit. That is, based on the information regarding the consumption of the replaceable unit, whether or not the replaceable unit is a genuine article can be discriminated. Thus, a user can select any one of the operation mode corresponding to the replaceable unit which is the genuine article and other operation modes. Therefore, a replaceable unit which is a non-genuine article can be used by the user's intention.

In addition, the operation mode mentioned herein means control aspects of the image forming apparatus, and includes not only programs and control parameters for forming an image, but also input and output conditions, and further includes display aspects onto a display device, which are not directly related to the image formation.

Preferably, the image forming apparatus further includes an image forming apparatus main body side storage unit, provided in the image forming apparatus main body, for storing a life span threshold value exceeding a standard life span of the replaceable unit, in which, based on the information regarding the consumption of the replaceable unit stored in the storage unit and the life span threshold value stored in the image forming apparatus main body side storage unit, the discriminating unit discriminates whether or not the replaceable unit is the genuine article. That is, based on the information regarding the consumption of the replaceable unit and the life span threshold value exceeding the standard life span of the replaceable unit, the discriminating unit discriminates whether or not the replaceable unit is the genuine article. Thus, even if the precision of the information regarding the consumption of the replaceable unit is low, the discriminating unit can discriminates a genuine article from a non-genuine article.

According to a ninth aspect of the invention, there is provided an image forming apparatus including: an image forming apparatus main body; at least one replaceable unit replaceably mounted to the image forming apparatus main body; a storage unit, provided in the replaceable unit, for storing information regarding a consumption of the replaceable unit; a detecting unit for detecting whether or not replaceable unit is to be replaced; a number of detected times storage unit for storing how many times the detecting unit detects that the replaceable unit is to be replaced; a number of detected times determining unit for determining whether or not the number of detected times stored in the number of detected times storage unit is equal to or more than a predetermined value, where the predetermined value is equal to or more than two; a discriminating unit for, based on the information acquired from the storage unit or the determination result of the number of detected times determining unit, discriminating whether or not the replaceable unit is a genuine article; an input unit for selecting any one of an operation mode corresponding to the replaceable unit which is the genuine article and operation modes different from the operation mode; and a control unit for performing controls in the selected operation mode by the input unit. That is, based on the information regarding the consumption of the replaceable unit or when the detecting unit detects two times or more that the replaceable unit is to be replaced, the discriminating unit can discriminate whether or not the replaceable unit is the genuine article. Thus, even if the detection precision of the detecting unit is low, the discriminating unit can discriminates a genuine article from a non-genuine article.

Preferably, the image forming apparatus further includes an image carrier for carrying a toner image, and an image density detecting unit for detecting a density of the toner image carried in the image carrier, in which the replaceable unit is a unit which has at least a toner built-in, and, based on the detection result of the image density detecting unit, the detecting unit detects whether or not the replaceable unit is to be replaced. That is, when the density of the toner image carried in the image carrier is lowered up to a predetermined value, the replaceable unit influencing the density of the toner image can be detected to be replaced.

Moreover, the image carrier mentioned herein includes an intermediate transfer body.

Further, preferably, the image forming apparatus further includes an image carrier, a developer container, in which a toner and a carrier for frictionally electrifying the toner are housed, for visualizing an electrostatic latent image carried in the image carrier by the toner, and a toner density detecting unit for detecting a density of the toner housed in the developer container, in which the replaceable unit is a unit which has at least the toner built-in, and, based on the detection result of the toner density detecting unit, the detecting unit detects whether or not the replaceable unit is to be replaced. That is, when the density of the toner is lowered up to a predetermined value, the replaceable unit influencing the density of the toner can be detected to be replaced.

Further, preferably, the image forming apparatus further includes a toner cartridge for housing a toner, a toner conveying unit for conveying the toner from the toner cartridge, and a toner presence/absence detecting unit for detecting presence/absence of the toner in the toner conveying unit, in which the replaceable unit is a unit which has at least the toner built-in, and, based on the detection result of the toner presence/absence detecting unit, the detecting unit detects whether or not the replaceable unit is to be replaced. That is, when the toner presence/absence detecting unit detects that the toner is absent from the toner conveying unit, the toner cartridge can be detected to be replaced.

Further, preferably, the image forming apparatus further includes a waste toner receiving unit for receiving a waste toner which is collected from an image carrier, and a waste toner fullness detecting unit for detecting whether or not the waste toner receiving unit is full, in which the replaceable unit is a unit which receives at least the waste toner, and, based on the detection result of the waste toner fullness detecting unit, the detecting unit detects whether or not the replaceable unit is to be replaced. That is, based on the amount of the waste toner, whether or not the replaceable unit is the genuine article can be discriminated. Thus, a user can select any one of the operation mode corresponding to the replaceable unit which is the genuine article and other operation modes. Therefore, a replaceable unit which is a non-genuine article can be used by the user's intention.

According to a tenth aspect of the invention, there is provided an image forming apparatus including: an image forming apparatus main body; at least one replaceable unit replaceably mounted to the image forming apparatus main body; a storage unit, provided in the replaceable unit, for storing information regarding the replaceable unit; an access unit for accessing the storage unit; a discriminating unit for discriminating whether the replaceable unit is a genuine article or it is likely to be a non-genuine article; an input unit for selecting any one of an operation mode corresponding to the replaceable unit which is the genuine article and operation modes different from the operation mode; and a control unit for performing controls according to the selected operation mode by the input unit, in which, when the access unit is impossible to repetitively access the storage unit, the discriminating unit discriminates that the replaceable unit is likely to be the non-genuine article. That is, when the access unit is impossible to repetitively access the storage unit, the discriminating unit can discriminates whether the replaceable unit is the genuine article or it is likely to be the non-genuine article. Therefore, the discriminating unit can be reduced from discriminating the genuine article as that it is likely to be the non-genuine article.

According to the present invention, a user can use a replaceable unit other than a genuine article, by the user's intention, even when the replaceable unit other than a genuine article is mounted.

Further, according to the present invention, a replaceable unit other than a genuine article can be used by the user's intention, even when the replaceable unit other than a genuine article is mounted.

BRIEF DESCRIPTION OF THE DRAWINGS

These and other objects and advantages of this invention will become more fully apparent from the following detailed description taken with the accompanying drawings in which:

FIGS. 16A and 16B are graphs showing results corrected by the setting shown in FIG. 15, in which FIG. 16A shows a corrected toner density, and FIG. 16B shows a corrected image density;

FIGS. 21A and 21B illustrate screens displayed on the UI device, in which FIG. 21A is a screen for input when a user selects an operation mode corresponding to a genuine article, FIG. 21B is a screen for input when a user selects an operation mode corresponding to any one other than a genuine article;

FIGS. 27A and 27B are graphs showing setting for correcting a change in electrification capability of the developer, in which FIG. 27A shows setting of a toner density with respect to the consumption of the developer and FIG. 27B shows setting of an image density with respect to the consumption of the developer;

DETAILED DESCRIPTION OF THE PREFERRED EMBODIMENTS

First Embodiment

Hereinafter, embodiments of the present invention will be described with reference to the accompanying drawings.

Figure 1:
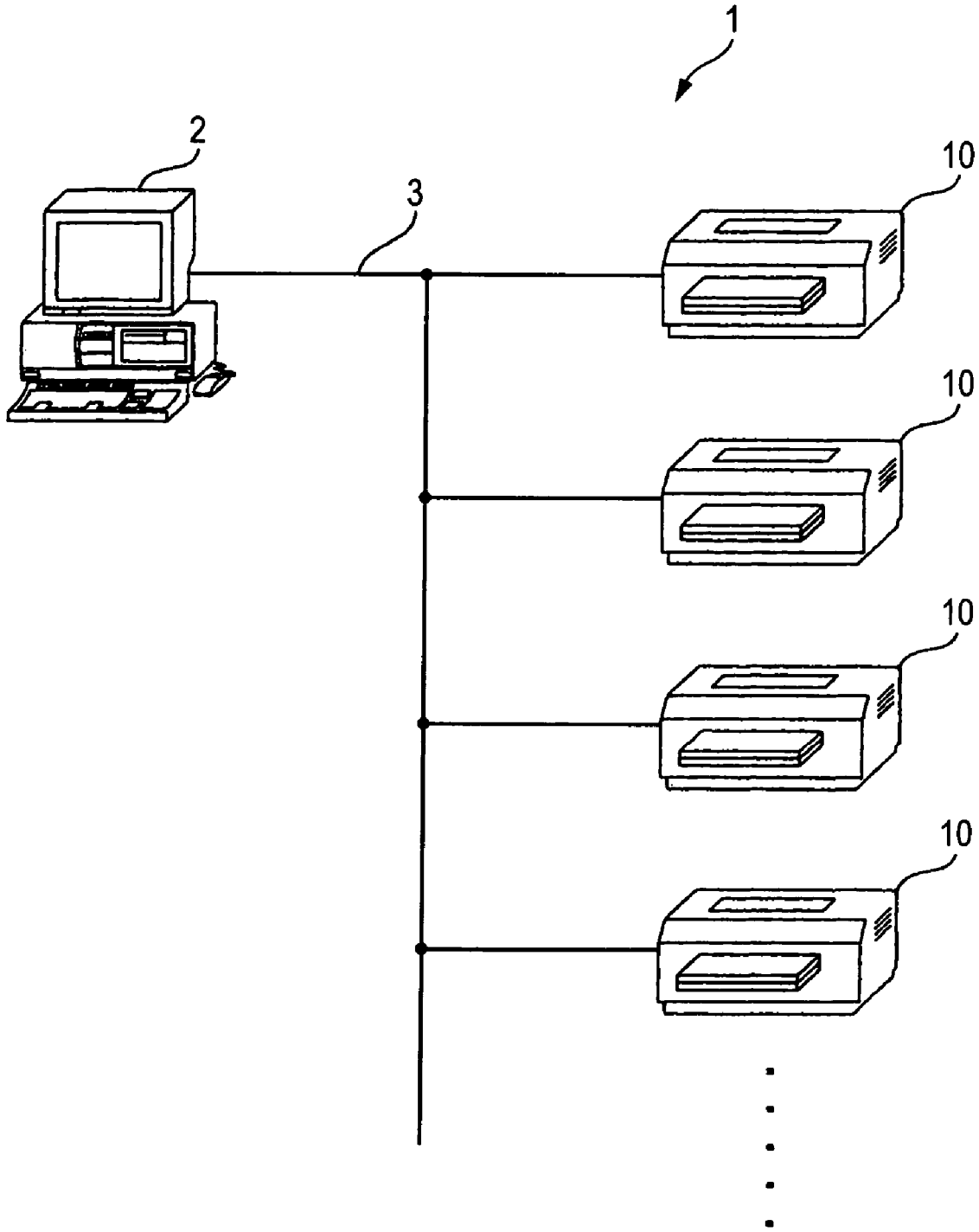
FIG. 1 is a schematic diagram of an image forming system according to one embodiment of the present invention.

FIG. 1 illustrates an image forming system 1 according to an embodiment of the present invention. The image forming system 1 is constructed by connecting a host apparatus 2, such as a personal computer (PC) to, for example, a plurality of image forming apparatuses 10 via a network 3. The host apparatus 2 may be a terminal having a control device, such as a micro controller unit (MCU), an input-output device, such as a touch panel, and a communication device for transmitting or receiving signals via the network 3, except the PC. The network 3 may be constructed by wire or wireless. Further, a plurality of the host apparatuses 2 may be connected to the network 3.

As such, the image forming system 1 is constructed such that the host apparatus 2 can control the image forming apparatuses 10 via the network 3.

Figure 2:
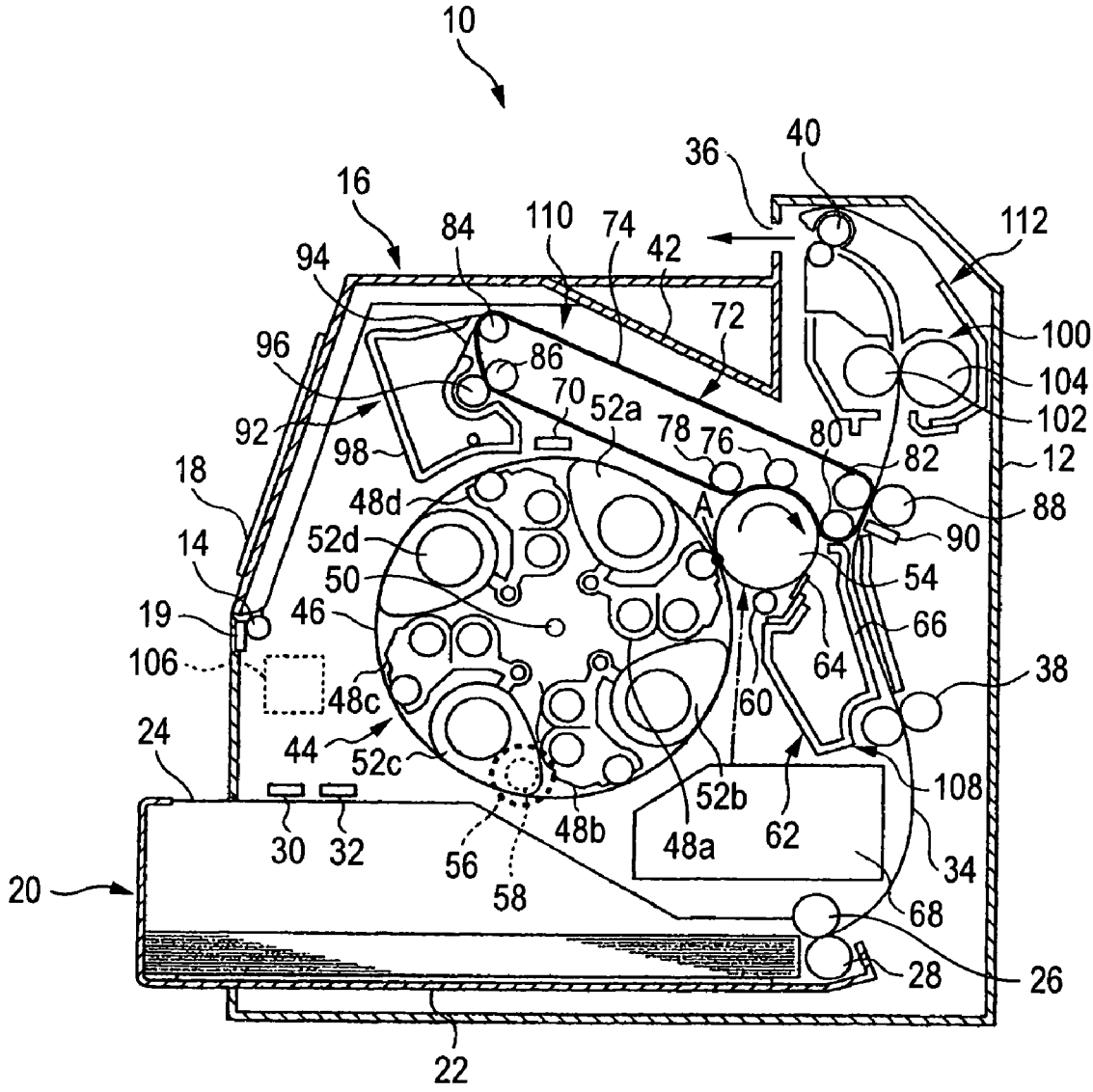
FIG. 2 is a side view schematically illustrating the image forming apparatus according to the embodiment of the present invention.

FIG. 2 schematically illustrates an image forming apparatus 10. The image forming apparatus 10 has an image forming apparatus main body 12, and an opening and closing cover 16 is provided at an upper portion of the image forming apparatus main body 12 to rotate about a fulcrum 14. A user interface device (UI device) 18, such as a touch panel, is provided on the front side (the left side in FIG. 2) of the opening and closing cover 16. The UI device 18 displays control information or instruction information of the image forming apparatus 10, and the instruction information from a user is input to the UI device 18. That is, a user can operate the image forming apparatus 10 via the UI device 18. Meanwhile, the UI device 18 may be a device for performing only the input of signals, such as a switch, or may be a device for receiving only the output of signals, such as display. Otherwise, the UI device 18 may be a combined device for performing both the input and output of signals.

Further, an opening and closing detecting sensor 19 is provided in the vicinity of the fulcrum 14 to detect the opening or closing of the opening and closing cover 16 by contact or separation according to opening or closing of the opening and closing cover 16.

For example, one-stage sheet feeding unit 20 is provided at a lower portion of the image forming apparatus main body 12. The sheet feeding unit 20 has a sheet feeding unit main body 22 and a sheet feeding cassette 24 for receiving sheets. A feeding roller 26 for feeding sheets from the sheet feeding cassette 24 and a retard roller 28 for separating the fed sheets one by one are arranged at the upper portion of the vicinity of a rear end of the sheet feeding cassette 24. Further, a temperature sensor 30 for detecting the temperature in the image forming apparatus main body 12 and a humidity sensor 32 for detecting the humidity in the image forming apparatus main body 12 are provided above the sheet feeding cassette 24.

A conveying path 34 is a sheet conveying path from the feeding roller 26 to a discharge port 36, and the conveying path 34 is formed substantially vertically from the sheet feeding unit 20 to a fixing device 100, which will be described later, in the vicinity of the rear side (the right side in FIG. 2) of the image forming apparatus main body 12. A secondary transfer roller 88 and a secondary transfer backup roller 82, which will be described later, are arranged upstream of the fixing device 100 in the conveying path 34, and a resist roller 38 is arranged downstream of the secondary transfer roller 88 and the secondary transfer backup roller 82. Further, a discharge roller 40 is arranged in the vicinity of the discharge port 36 in the conveying path 34.

Accordingly, the sheets fed by the feeding roller 26 from the sheet feeding cassette 24 of the sheet feeding unit 20 are separated by the retard roller 28, and only the topmost sheet is guided to the conveying path 34. Then, the conveyance of the guided sheet is temporally stopped by the resist roller 38, and the sheet passes between the secondary transfer roller 88 and the secondary transfer backup roller 82, which will be described later, at a predetermined timing, so that a toner image is transferred onto the sheet. Subsequently, the transferred toner image is fixed by the fixing device 100, and the sheet is then discharged by the discharge roller 40 from the discharge port 36 to a discharge section 42 provided on the upper side of the opening and closing cover 16. The discharge section 42 slopes gradually downward from the front side (the left side in FIG. 2) thereof toward the discharge port.

A developer container unit 44, such as a rotary developing device, is arranged, for example, substantially at the center of the image forming apparatus main body 12. The developer container unit 44 has a developer container unit main body 46, and the developer container unit main body 46 is mounted with four developer containers 48*a* to 48*d* for forming a toner image. These developer containers 48*a* to 48*d* rotate left (in the counterclockwise direction in FIG. 2) about a rotating shaft 50 with the developer container unit main body 46. The developer containers 48*a* to 48*d* are mounted with tubular toner cartridges 52*a* to 52*d* for containing toners of yellow (Y), magenta (M), cyan (C), and black (K), respectively. When the toner cartridges 52*a* to 52*d* are mounted in the developer container unit main body 46 through the developer containers 48*a* to 48*d*, the toner cartridges 52*a* to 52*d* are mounted such that their outer surfaces almost coincide with the outer circumference of the developer container unit main body 46.

An image carrier 54 made of, for example, a photoreceptor is arranged so as to abut on the developer container unit 44 from the rear side (the right side in FIG. 2) of the image forming apparatus 10. Specifically, four colors of Y, M, C, and K are prepared in the developer container unit 44 to perform full color development, and the developer containers 48*a* to 48*d* are rotated and positioned at positions to face the image carrier 54 and then develop a latent image on the image carrier 54, using the toners of respective colors of yellow (Y), magenta (M), cyan (C) and black (B), sequentially.

Further, a wireless communication unit 56 is arranged in the vicinity of a position substantially opposite to the image carrier 54 with respect to the rotating shaft 50 of the developer container unit 44. The wireless communication unit 56 has an antenna 58 and communicates with memory chips 170, which will be described later, by wireless.

Further, an electrifying device 60 including, for example, an electrifying roller, is provided below the image carrier 54 for uniformly electrifying the image carrier 54. Further, an image carrier cleaner 62 abuts on the image carrier 54 upstream of the electrifying device 60 in the rotating direction of the image carrier 54. The image carrier cleaner 62 includes a cleaning blade 64 for scraping off a toner remaining on the image carrier 54 after a primary transfer and a waste toner collecting bottle 66 for collecting the toner scraped off by the cleaning blade 64.

Meanwhile, for example, ribs are formed on the rear side (the right side in FIG. 2) of the waste toner collecting bottle 66, and the rear surface of the waste toner collecting bottle 66 is formed into a curved surface such that sheets can be smoothly conveyed. Further, the rear surface of the waste toner collecting bottle 66 constitutes a portion of the conveying path 34.

Further, an exposure device 68 for writing a latent image on the image carrier 54 electrified by the electrifying device 60, using light rays, such as laser beam, is provided below the rear side of the developer container unit 44. Further, an unused state detecting sensor 70, such as a reflective photosensor, for detecting whether the toner cartridges 52*a* to 52*d* mounted in the developer container unit 44 are unused, is provided above the developer container unit 44. An intermediate transfer device 72 is provided above the developer container unit 44 and the unused state detecting sensor 70. The intermediate transfer device 72 primarily transfers the toner image visualized by the developer container unit 44 for each color at a primary transfer position whenever an intermediate transfer body 74 makes one rotation such that the toner image having four colors are superposed on the intermediate transfer body 74, and then collectively transfers the toner image on a sheet at a secondary transfer position which will be described later.

The intermediate transfer device 72 includes an intermediate transfer body 74, such as an intermediate transfer belt, a primary transfer roller 76, a lap-in roller 78, a lap-out roller 80, a secondary backup roller 82, a scraper backup roller 84, and a brush backup roller 86. The intermediate transfer body 74 has, for example, elasticity, and is substantially flatly stretched such that it has long sides and short sides above the developer container unit 44. The upper long side of the intermediate transfer body 74 is stretched such that it is substantially parallel to the discharge section 42 provided on the upper side of the image forming apparatus main body 12. Further, the intermediate transfer body 74 has a primary transfer section (an image carrier lap region) to abut on the image carrier 54 in the shape of a lap between the lap-in roller 78 arranged upstream of the primary transfer roller 76 at the lower long side thereof, and the lap-out roller 80 arranged downstream of the primary transfer roller 76. Also, the intermediate transfer body 74 is wound around the image carrier 54 by a predetermined range to follow the rotation of the imager carrier 54.

Moreover, a planar surface (a short side) is formed at the rear side (the right side in FIG. 2) of the intermediate transfer body 74 by the lap-out roller 80 and the secondary transfer backup roller 82. The planar surface forms a secondary transfer section so as to face the conveying path 34.

As such, a toner image on the image carrier 54 is repeatedly and primarily transferred onto the intermediate transfer body 74 in order of, for example, yellow, magenta, cyan and black by the primary transfer roller 76, and the primarily transferred toner image is then carried toward the secondary transfer section.

The scraper backup roller 84 assists a scraper 94, which will be described later, in scraping off a toner remaining on the intermediate transfer body 74 after the secondary transfer, and the brush backup roller 86 assists a brush roller 96, which will be described later, in scraping off a toner remaining on the intermediate transfer body 74 after the secondary transfer.

The secondary transfer roller 88 and the secondary transfer backup roller 82 of the intermediate transfer device 72 face each other with the conveying path 34 interposed therebetween. Specifically, a position between the secondary transfer roller 88 and the secondary transfer backup roller 82 becomes a secondary transfer position in the secondary transfer section, and the secondary transfer roller 88 secondarily transfers the toner image primarily transferred onto the intermediate transfer body 74 onto a sheet at the secondary transfer position by the assistance of the secondary transfer backup roller 82. Here, the secondary transfer roller 88 is separated from the intermediate transfer body 74 while the intermediate transfer body 74 rotates three times, i.e., while toner images having three colors of yellow, magenta and cyan, respectively, are carried, whereas the secondary transfer roller 88 abuts on the intermediate transfer body 74 when the black toner image has been transferred. Meanwhile, there is a predetermined potential difference between the secondary transfer roller 88 and the secondary transfer backup roller 82. For example, when the secondary transfer roller 88 has a high voltage, the secondary transfer backup roller 82 is connected to a ground (GND) or the like.

Upstream of the secondary transfer position, an image density sensor 90, such as a reflective photosensor, is arranged opposite to the intermediate transfer body 74 with the conveying path 34 interposed therebetween. The image density sensor 90 reads out a patch of a toner formed on the intermediate transfer body 74, and detects the density of the image formed on the intermediate transfer body 74.

A cleaner 92 for an intermediate transfer body is provided to abut on an end of the intermediate transfer body 74 opposite to the image carrier. The cleaner 92 for an intermediate transfer body includes, for example, a scraper 94 which scrapes and cleans a toner remaining on the intermediate transfer body 74 after the secondary transfer, a brush roller 96 which further scrapes a toner remaining after the cleaning by the scraper 94, and a waste toner collecting bottle 98 which collects the toner scraped by the scraper 94 and the brush roller 96. The scraper 94 is made of, for example, a stainless thin plate. A voltage having polarity reverse to that of the toner is applied to the scraper 94. The brush roller 96 has, for example, a brush such as acryl subjected to conductive treatment. Further, while the intermediate transfer body 74 carries a toner image, the scraper 94 and the brush roller 96 are separated from the intermediate transfer body 74, whereas they are integrated with each other at a predetermined timing so as to abut on the intermediate transfer body 74.

A fixing device 100 is arranged above the secondary transfer position. The fixing device 100 has a heating roller 102 and a pressing roller 104, fixes a toner image secondarily transferred onto a sheet by the secondary transfer roller 88 and the secondary transfer backup roller 82 on the sheet, and conveys the sheet toward the discharge roller 40.

Further, a control unit 106 is arranged in the image forming apparatus main body 12 for controlling respective parts that constitute the image forming apparatus 10.

An image carrier unit 108 is constructed by integrating the image carrier 54, the electrifying device 60, and the image carrier cleaner 62 with each other. Further, an image forming unit 110 is constructed by integrating the image carrier unit 108, the intermediate transfer device 72 and the cleaner 92 for an intermediate transfer body with each other. Moreover, a fixing unit 112 is constructed by integrating the fixing device 100 and the discharge roller 40 with each other.

Figure 3:
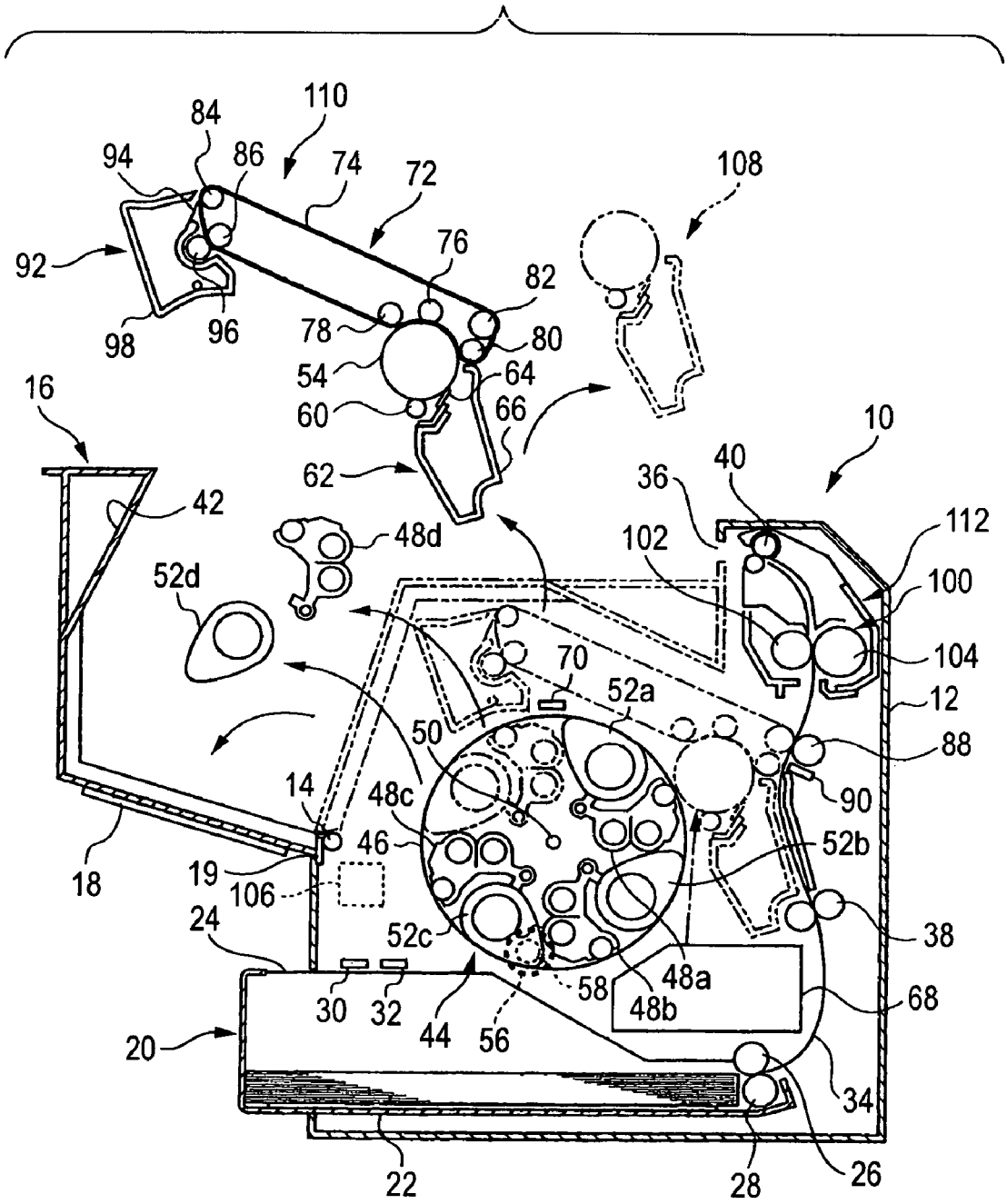
FIG. 3 is a side view illustrating a state in which replaceable units of the image forming apparatus according to the embodiment of the present invention are detached from an image forming apparatus main body.

As also illustrated in FIG. 3, the image forming unit 110 is adapted to be attachable to or detachable from the image forming apparatus main body 12, and is attached to or detached from the image forming apparatus main body by opening the opening and closing cover 16. Further, the image carrier unit 108 is adapted to be attachable to or detachable from the image forming unit 110.

When the opening and closing cover 16 is opened and the toner cartridges 52*a* to 52*d* are positioned on the front side (on the side of the opening and closing cover 16), the toner cartridges 52*a* to 52*d* are adapted to be attachable to or detachable from the developer containers 48*a* to 48*d* mounted in the developer container unit main body 46. When the opening and closing cover 16 is opened and the developer containers 48*a* to 48*d* are located on the front side (on the side of the opening and closing cover 16), the developer containers 48*a* to 48*d* are adapted to be attachable to or detachable from the developer container unit main body 46.

The fixing unit 112 is adapted to be attachable to or detachable from the image forming apparatus main body 12 by detaching a top cover (not shown). Further, other units, such as the developer container unit 44 and the sheet feeding unit 20, are adapted to be attachable to or detachable from the image forming apparatus main body 12.

As such, the respective units can be replaced by a user. On the other hand, in case a user mounts a replaceable unit in the image forming apparatus 10, if the replaceable unit is any one other than a genuine article for the image forming apparatus 10, a problem occurs in that good image quality cannot be maintained and the operation cannot be guaranteed. This is because the image forming apparatus 10 is controlled in accordance with the characteristics of members used for the image forming apparatus 10. Thus, units replaceable by a user are provided with sensors that detect predetermined conditions.

Hereinafter, if any one of a plurality of components, such as the developer containers 48*a* to 48*d*, is not specified, the developer containers are abbreviated as, simply, a "developer container 48".

Next, examples of replaceable units having sensors for detecting predetermined conditions will now be described.

Figure 4:
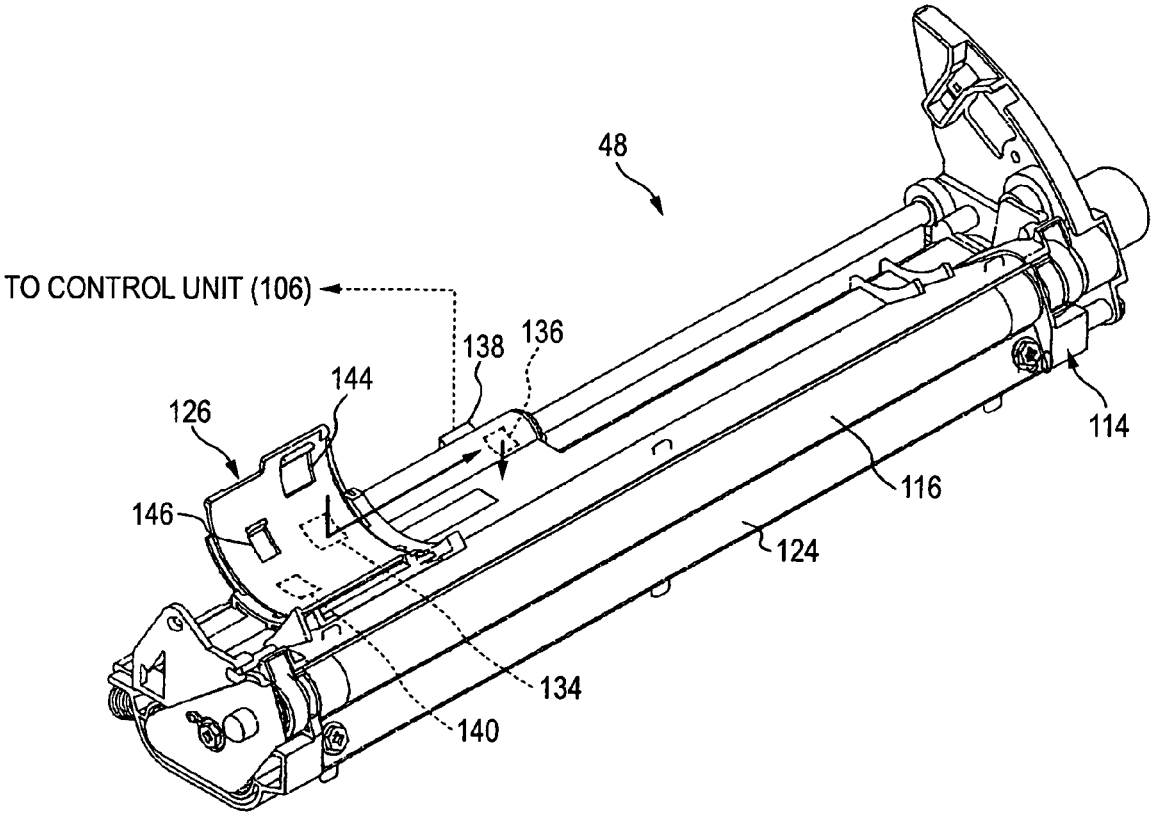
FIG. 4 is a perspective view illustrating a developer container of the image forming apparatus according to the embodiment of the present invention.
Figure 5:
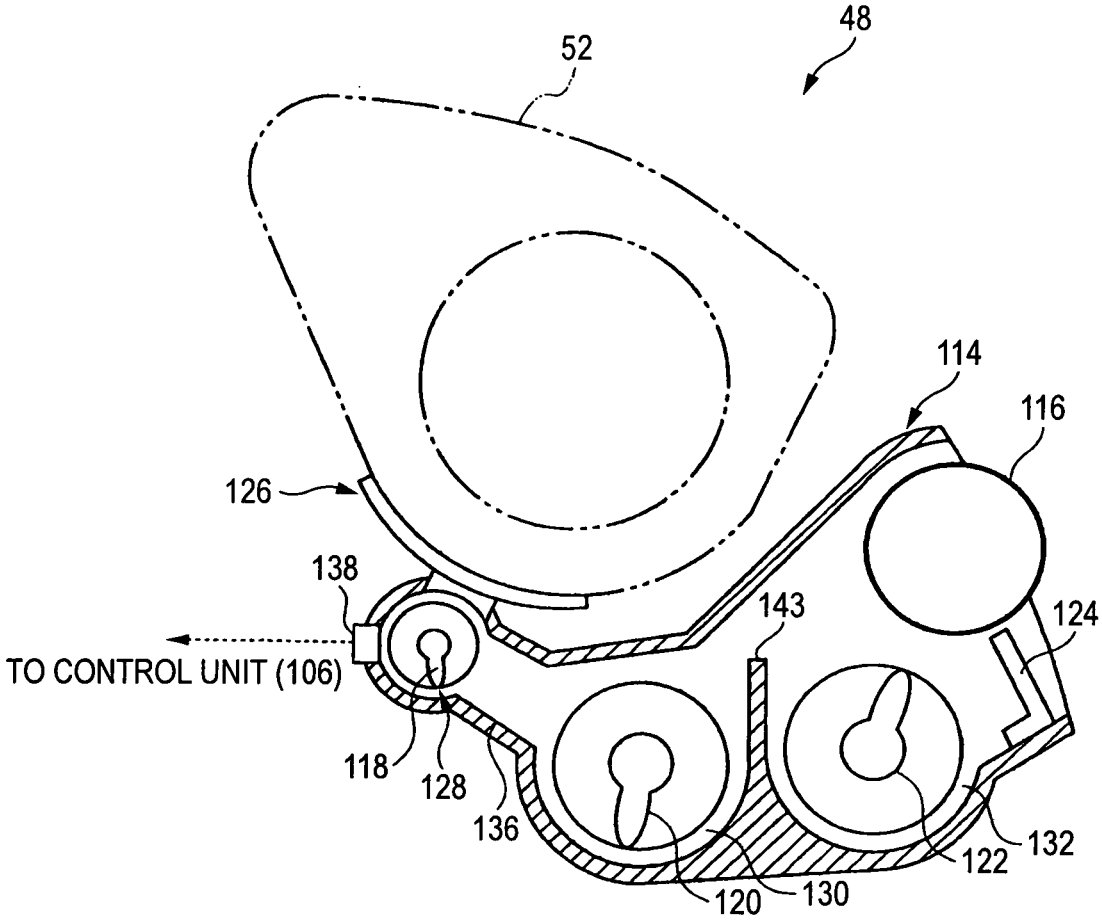
FIG. 5 is a schematic view illustrating a cross-section of the developer container of the image forming apparatus according to the embodiment of the present invention.

FIGS. 4 and 5 illustrate a construction of a developer container 48 that is a replaceable unit.

The developer container 48 has a developing roller 116 serving as a developer carrier arranged on the image carrier 54 side of a developer container housing (a developer container main body) 114, a first auger 118, a second auger 120, a third auger 122, and a layer thickness regulating member 124. The developer container 48 also contains, for example, a two-component developer consisting of a non-magnetic toner and a magnetic carrier.

The developer container housing 114 has a shutter 126 for opening or closing a toner receiving port 134 and a developer discharge port 140, which will be described later, a tubular take-in conveying path 128 for conveying a toner taken in from the toner cartridge 52, and tubular developer conveying paths 130 and 132 for agitating and conveying a toner and a carrier.

The take-in conveying path 128 has a toner receiving port 134 for receiving a toner from the toner cartridge 52, and a toner feeding port 136 for feeding a toner to the developer conveying path 130. The first auger 118 is arranged in the take-in conveying path 128. The first auger 118 conveys a toner received from the toner cartridge 52 by the take-in conveying path 128, to the developer conveying path 130. Further, the rotation of the first auger 118 is regulated so that the amount of a toner supplied to the developer container 48 from the toner cartridge 52 can be regulated. Thus, a CPU 202 may cumulate the driving time or revolution number of the first auger 118 such that the consumption of a toner (the consumption of the toner cartridge 52) can be calculated. Further, the consumption of a toner may be calculated by storing, as electric charges, currents flowing through the image carrier 54 to a carrier and the like when the exposure device 68 writes an electrostatic latent image in the image carrier 54, and then by allowing the CPU 202 to count the number of times by which the stored electric charges reaches a predetermined amount.

A toner presence/absence detecting sensor 138 is provided in the take-in conveying path 128 between the toner receiving port 134 and the toner feeding port 136. The toner presence/absence detecting sensor 138 detects the presence or absence of a toner in the take-in conveying path 128, for example, by detecting a change in a resistance value depending on the presence or absence of a toner between two points in the take-in conveying path 128. Further, the toner presence/absence detecting sensor 138 may be a piezoelectric element.

The developer conveying path 130 has a developer discharge port 140 for discharging a surplus developer to the toner cartridge 52, and the second auger 120 is arranged in the developer conveying path 130. The second auger 120 agitates a toner conveyed through the take-in conveying path 128, and a carrier, and conveys the resulting mixture to the developer conveying path 132.

The third auger 122 is arranged in the developer conveying path 132. The third auger 122 agitates and conveys a developer through the developer conveying path 130, and supplies the resultant to the developing roller 116.

Meanwhile, a partition plate 143 is provided between the developer conveying path 130 and the developer conveying path 132. Passageways (not shown) are provided at both ends of the partition plate 143 for connecting the developer conveying path 130 and the developer conveying path 132. Thus, the second auger 120 and the third auger 122 convey a developer in directions different from each other so that a toner can be frictionally electrified so as to have predetermined polarity and electric charge quantity by the carrier and can be circulated in the developer container housing 114. Further, a deteriorated developer is discharged to the toner cartridge 52 from the developer discharge port 140 at a predetermined timing so that the total lifetime of the developer can be prolonged (a trickle development method).

The shutter 126 has openings 144 and 146. The opening 144 is overlapped with the toner receiving port 134 to form a passageway for a toner from the toner cartridge 52 to the developer container 48, and the opening 146 is overlapped with the developer discharge port 140 to form a passageway for a surplus developer from the developing container 48 to the toner cartridge 52.

The developing roller 116 neighbors upon the image carrier 54 while carrying a toner, thereby developing an electrostatic latent image carried by the image carrier 54 with the toner. The layer thickness regulating member 124 regulates the layer thickness of a toner carried by the developing roller 116.

Figure 6:
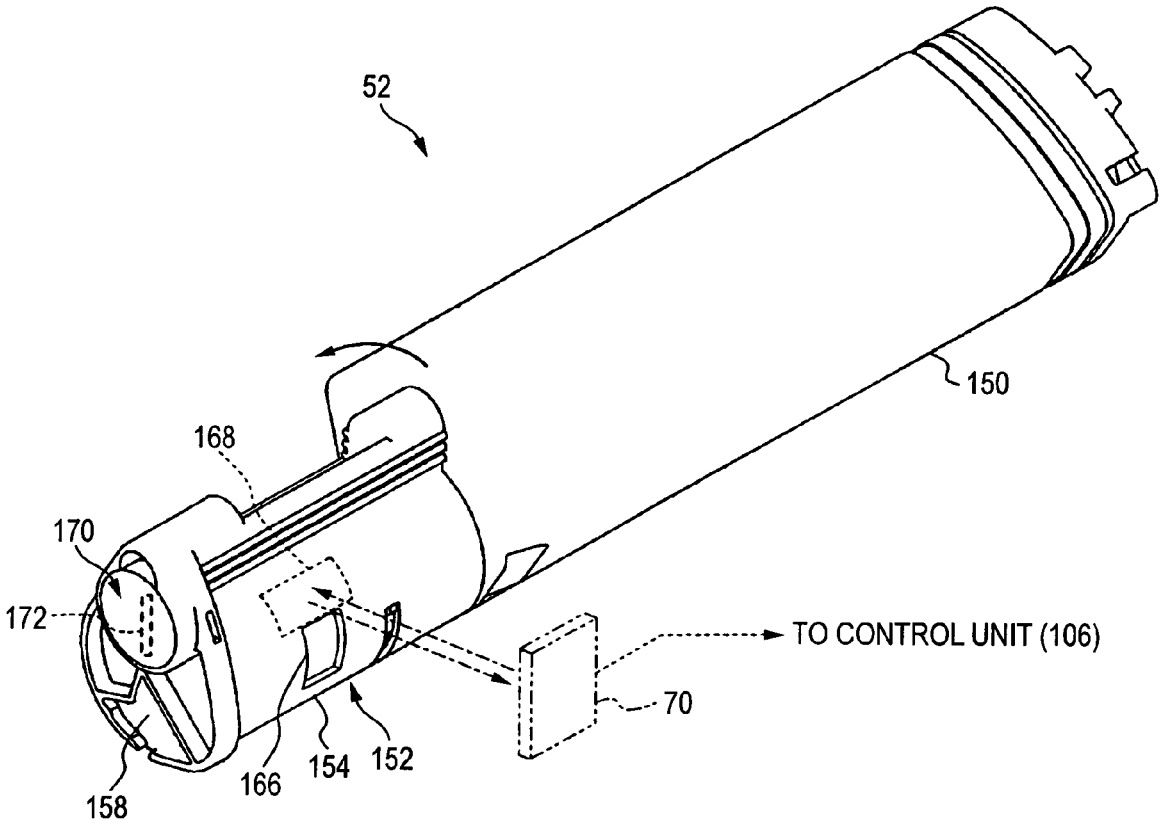
FIG. 6 is a perspective view illustrating a toner cartridge of the image forming apparatus according to the embodiment of the present invention.
Figure 7:
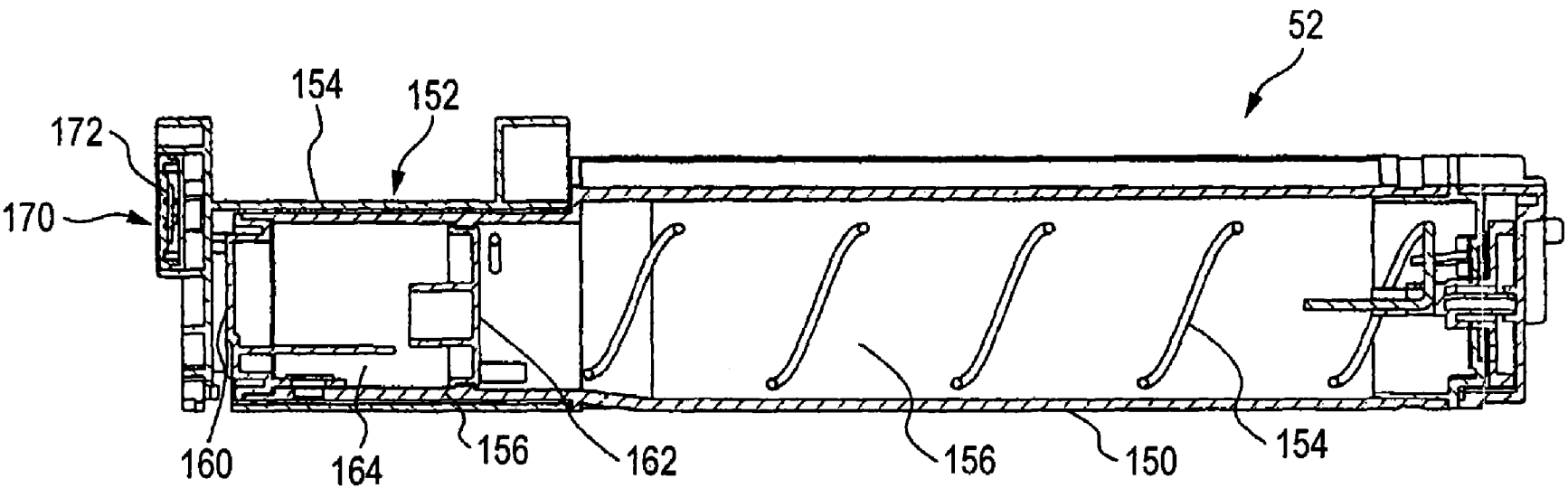
FIG. 7 is a sectional view illustrating the toner cartridge of the image forming apparatus according to the embodiment of the present invention.

FIGS. 6 and 7 illustrate a construction of the toner cartridge 52 that is a replaceable unit.

The toner cartridge 52 has a toner cartridge main body 150, and a rotating member 152 provided at a longitudinal end of the toner cartridge main body 150.

The toner cartridge main body 150 is formed in a tubular shape, and is formed such that a substantially cylindrical portion having an agitating and conveying member 154 arranged therein and a portion extending from the substantially tubular portion in a direction substantially perpendicular to its longitudinal direction so as to be gradually narrowed are integrated with each other. Further, when the toner cartridge 52 is mounted in the developer container unit main body 46 via the developer container 48, the toner cartridge main body 150 is configured such that its outer surface substantially coincides with the outer circumference of the developer container main body 46.

A toner accommodating space 156 is formed in the toner cartridge main body 150 for accommodating a toner to be supplied to the developer container 48. Besides, the toner cartridge supplies a few new carriers with the toner. The above-mentioned agitating and conveying member 154 is provided in the toner accommodating space 156. The agitating and conveying member 154 is wound in, for example, a spiral shape, and agitates a toner in the toner accommodating space 156 and conveys the agitated toner toward the toner receiving port 134 of the developer container 48.

The rotating member 152 has a rotating member main body 154, and a cylindrical tubular part 156 provided in the rotating member main body 154 and integrally formed with the toner cartridge main body 150. The tubular part 156 is sealed up at a lateral face 158 of the rotating member main body 154 by a tubular part sidewall 160, and has an isolating wall 162 provided therein. A developer collecting space 164 for collecting a surplus developer from the developer container 48 is formed at the side of the isolating wall 162 facing the tubular part sidewall 160, and the above-mentioned toner accommodating space 156 is formed to extend at the side of the isolating wall 162 opposite to the tubular part sidewall 160.

The rotating member main body 154 has a window 166 covered with a transparent member, and has the inner surface thereof formed in a cylindrical shape to rotate along the outer surface of the cylindrical portion of a tubular part 156. Further, a reflecting member 168, such as a white tape, is attached to the outer surface of the cylindrical portion of the tubular part 156. When the toner cartridge 52 is mounted in the developer container 48 and the rotating member main body 154 rotates, the reflecting member 168 is exposed through the window 166. Further, when the developer container unit 44 having the toner cartridge 52 mounted therein rotates in the image forming apparatus main body 12, the exposed reflecting member 168 passes through a position which faces the unused state detecting sensor 70 fixed to the image forming apparatus main body 12. As described above, the unused state detecting sensor 70 is, for example, a reflective photosensor. When the reflecting member 168 of the toner cartridge 52 mounted in the developer container unit 44 passes through a position which faces the unused state detecting sensor 70, the unused state detecting sensor 70 detects the quantity of reflection of the reflecting member 168 which varies depending on dirt by a toner, thereby detecting whether or not the toner cartridge 52 is unused.

A memory chip 170 is attached to the lateral face 158 of the rotating member main body 154. The memory chip 170 has an antenna 172, and performs wireless communication with the wireless communication unit 56 provided on the image forming apparatus main body 12.

Next, regarding the wireless communication unit 56 and the memory chip 170, a circuit configuration of each thereof and communication performed therebetween will now be described.

Figure 8:
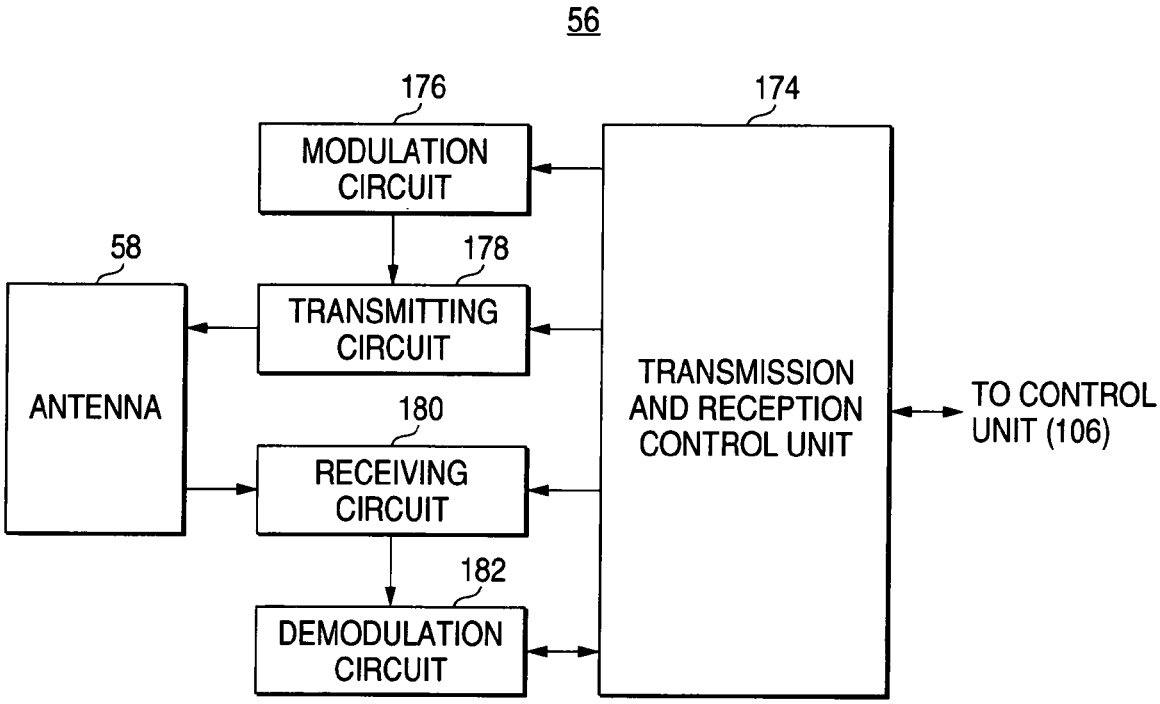
FIG. 8 is a block diagram showing a circuit configuration of a wireless communication unit of the image forming apparatus according to the embodiment of the present invention.
Figure 9:
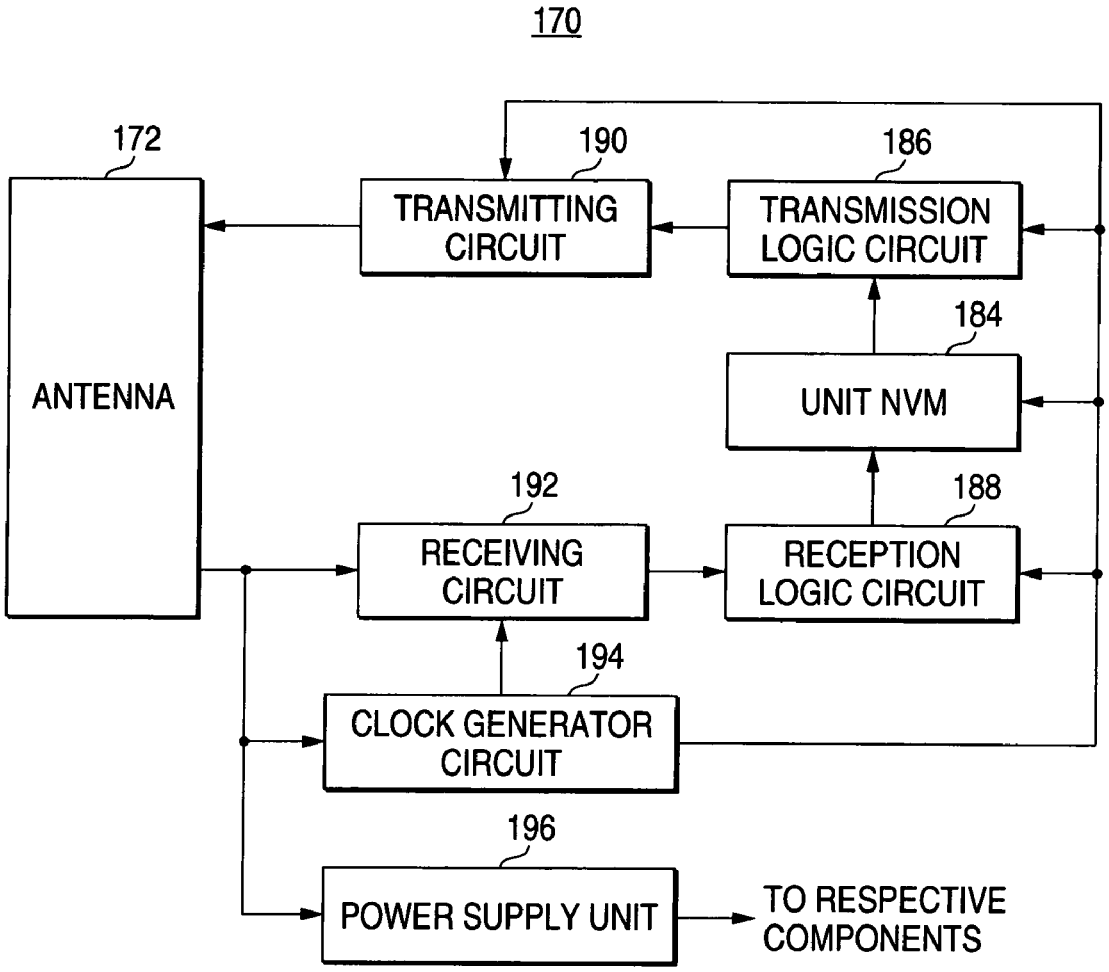
FIG. 9 is a block diagram showing a circuit configuration of a memory chip of a toner cartridge used for the image forming apparatus according to the embodiment of the present invention.

FIG. 8 is a block diagram showing a circuit configuration of the wireless communication unit 56. FIG. 9 is a block diagram showing a circuit configuration of the memory chip 170.

As illustrated in FIG. 8, a circuit of the wireless communication unit 56 includes a transmission and reception control unit 174, a modulation circuit 176, a transmitting circuit 178, a receiving circuit 180, a demodulation circuit 182, and an antenna 58. In the wireless communication unit 56, the transmission and reception control unit 174 controls the operation of the respective components of the wireless communication unit 56. Also, the transmission and reception control unit 174 outputs data input from the control unit 106 to the demodulation circuit 176. Further, the transmission and reception control unit 174 outputs data received by the receiving circuit 180 and demodulated by the demodulation circuit 182 to the control unit 106. The modulation circuit 176 modulates data input from the transmission and reception control unit 174 and outputs the modulated data to the transmitting circuit 178. The transmitting circuit 178 outputs radio signals, including data and clock signals to be stored in the memory chip 170, to the memory chip 170 via the antenna 58.

The receiving circuit 180 receives signals transmitted from the memory chip 170 via the antenna 58, and outputs the received signals to the demodulation circuit 182. The demodulation circuit 182 demodulates data transmitted by the memory chip 170 depending on a change in the signals input from the receiving circuit 180, and outputs the demodulated data to the transmission and reception control unit 174.

As illustrated in FIG. 9, a circuit of the memory chip 170 includes a unit nonvolatile memory (NVM) 184, a transmission logic circuit 186, a reception logic circuit 188, a transmitting circuit 190, a receiving circuit 192, a clock regenerator circuit 194, a power supply unit 196, and an antenna 172.

When radio signals are transmitted from the wireless communication unit 56 to the memory chip 170, the receiving circuit 192, the clock regenerator circuit 194 and the power supply unit 196 receive the radio signals via the antenna 172. In the memory chip 170, when the radio signals were received, the power supply unit 196 rectifies a current caused by the electromagnetic induction by the radio signals, and supplies electric power required for the operation of the respective components of the memory chip 170 to the components. For example, when a voltage higher than that generated by the power supply unit 196 is required, the memory chip 170 may be configured to receive the power supplied from the main body 40. For example, power may be supplied in a non-contact way from an alternating current supplied to the developer container unit 44 by further providing the memory chip 170 with power supply coils or the like.

When the clock regenerator circuit 194 receives the radio signals, it regenerates clock signals and outputs the regenerated clock signals to the respective circuits which constitute the memory chip 170. When the receiving circuit 192 receives the radio signals, it outputs signals, such as data included in the radio signals, to the reception logic circuit 188 in synchronization with the clock signals input from the clock regenerator circuit 194. The reception logic circuit 188 demodulates signals, such as data input from the receiving circuit 192, in synchronization with the clock signals input from the clock regenerator circuit 194, and outputs the demodulated signals to the unit NVM 184.

The unit NVM 184 is a writable nonvolatile memory. When signals input from the reception logic circuit 188 in synchronization with the clock signals input from the clock regenerator circuit 194, indicate write-in of data, the unit NVM 184 performs write-in (storing) of the data, and when the signals indicate readout of data, the unit NVM 184 outputs the data stored in the unit NVM 184 to the transmission logic circuit 186. A nonvolatile memory included in the unit NVM 184 may be, for example, a flash read-only memory (flash ROM), an electrically erasable programmable read-only memory (EEPROM), or a ferroelectric random access memory (FeRAM).

The transmission logic circuit 186 modulates data input from the unit NVM 184 in synchronization with the clock signals input from the clock regenerator circuit 194, and outputs the modulated data to the transmitting circuit 190. The transmitting circuit 190 transmits the signals input from the transmission logic circuit 186 to the wireless communication unit 56 via the antenna 172 as radio signals, in synchronization with the clock signals input from the clock regenerator circuit 194.

Meanwhile, signals transmitted or received as the radio signals may be converted into radio signals after their encryption, and may then be transmitted or received. Further, for example, authorized users may rewrite the contents in the unit NVM 184 through any device other than the control unit 106, using encrypted radio signals.

Figure 10:
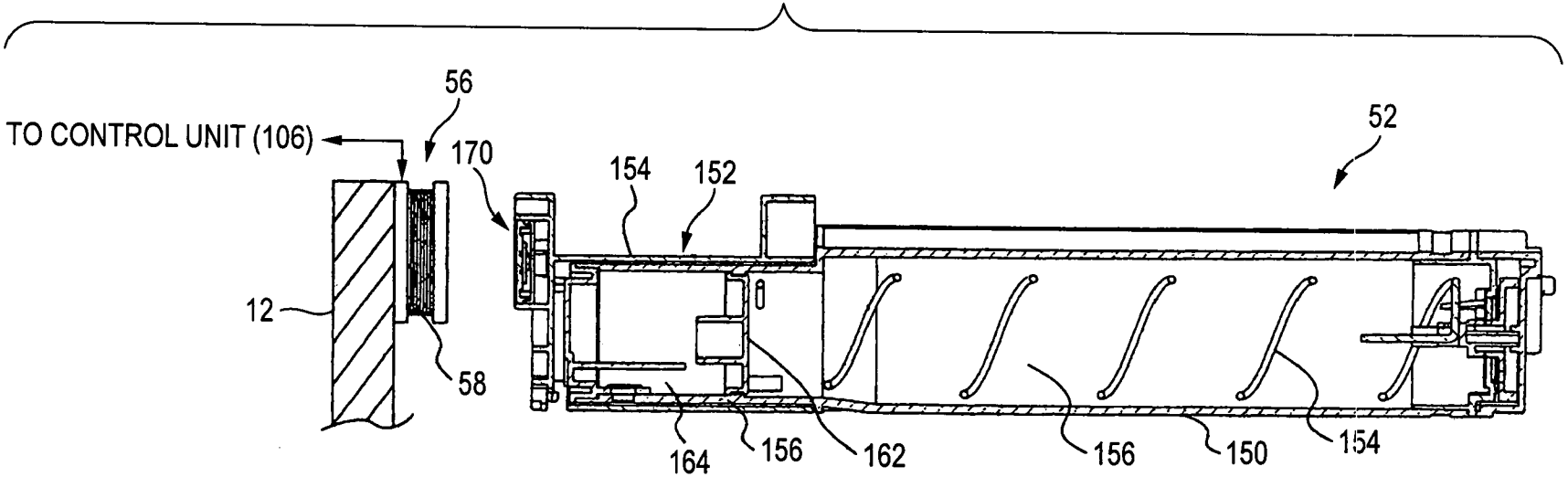
FIG. 10 is a sectional view illustrating a positional relationship between the wireless communication unit and the memory chip which perform wireless communication.

FIG. 10 illustrates a positional relationship between the wireless communication unit 56 and the memory chip 170 which perform wireless communication. As described above, the toner cartridge 52 is mounted in each developer container 48, and moves while the developer container unit 44 (FIG. 2) rotates about the rotating shaft 50. The wireless communication unit 56 is fixed to the image forming apparatus main body 12 in the vicinity of the lateral side of the developer container unit 44 so as to sequentially substantially face the memory chips 170 moved by the rotation of the developer container unit 44. The wireless communication unit 56 is also adapted to perform wireless communication in its halting state in which the movement of the developer container 48 is controlled at a position which substantially faces any one of the memory chips 170 so as to perform wireless communication with the facing memory chip 170. Further, the wireless communication unit 56 is adapted to receive acknowledge signals transmitted by the memory chip 170 in response to, for example, radio signals output by the wireless communication unit 56, so as to confirm the start of transmission or reception of data.

Figure 11:
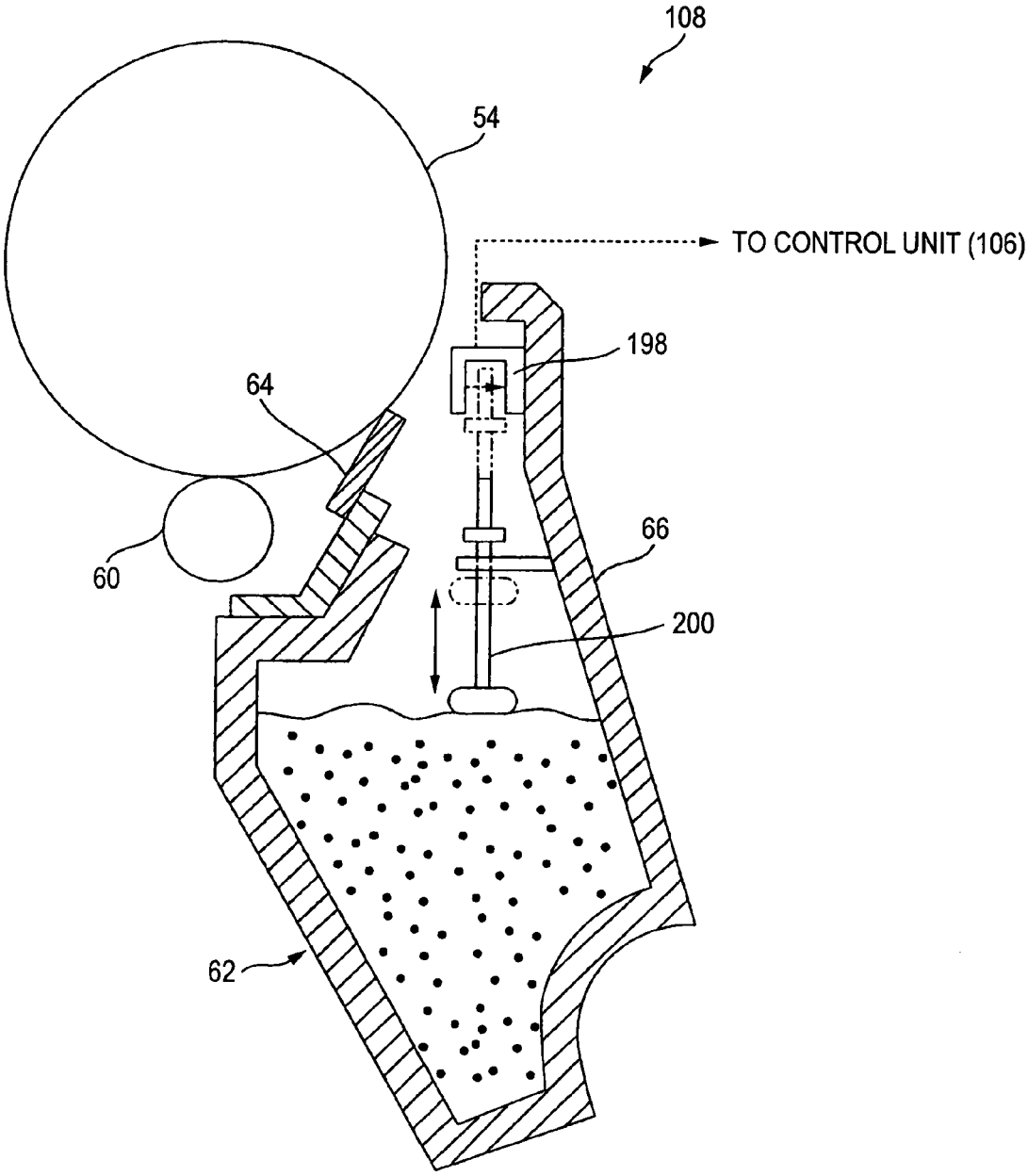
FIG. 11 is a side view illustrating a construction of an image carrier unit used for the image forming apparatus according to the embodiment of the present invention.

FIG. 11 illustrates a configuration of the image carrier unit 108 that is a replaceable unit.

As describe above, the image carrier unit 108 is constructed by integrating the image carrier 54, the electrifying device 60 and the image carrier cleaner 62 with each other. For example, the image carrier unit 108 has a waste toner fullness sensor 198 arranged in the image carrier cleaner 62 at the upper portion thereof, and a float 200 arranged below the waste toner fullness sensor 198. The waste toner fullness sensor 198 has an optical path configured such that light emitted by a light-emitting part provided at one side is received by a light-receiving part provided at the other side, and outputs whether or not the light-receiving part has received the light, to the control unit 106. The float 200 is adapted to rise when a waste toner collected in the waste toner collecting bottle 66 from the image carrier 54 exceeds a predetermined amount, and is adapted to intercept the optical path of the waste toner fullness sensor 198 when the waste toner collecting bottle 66 is full of a waste toner. As such, the image carrier unit 108 detects whether or not the waste toner collecting bottle 66 becomes full by means of the waste toner fullness sensor 198 and the float 200, and outputs the detected result to the control unit 106.

Further, the waste toner fullness sensor 198 and the float 200 may be provided in the cleaner 92 for an intermediate transfer body to detect whether or not the waste toner collecting bottle 98 becomes full.

As such, a replaceable unit which has a sensor or the like for detecting predetermined conditions is adapted to output results detected by the sensor or the like to the control unit 106, and the control unit 106 controls the respective components which constitute the image forming apparatus 10 on the basis of the input detected results.

Next, a construction of the control unit 106 will be described in detail.

Figure 12:
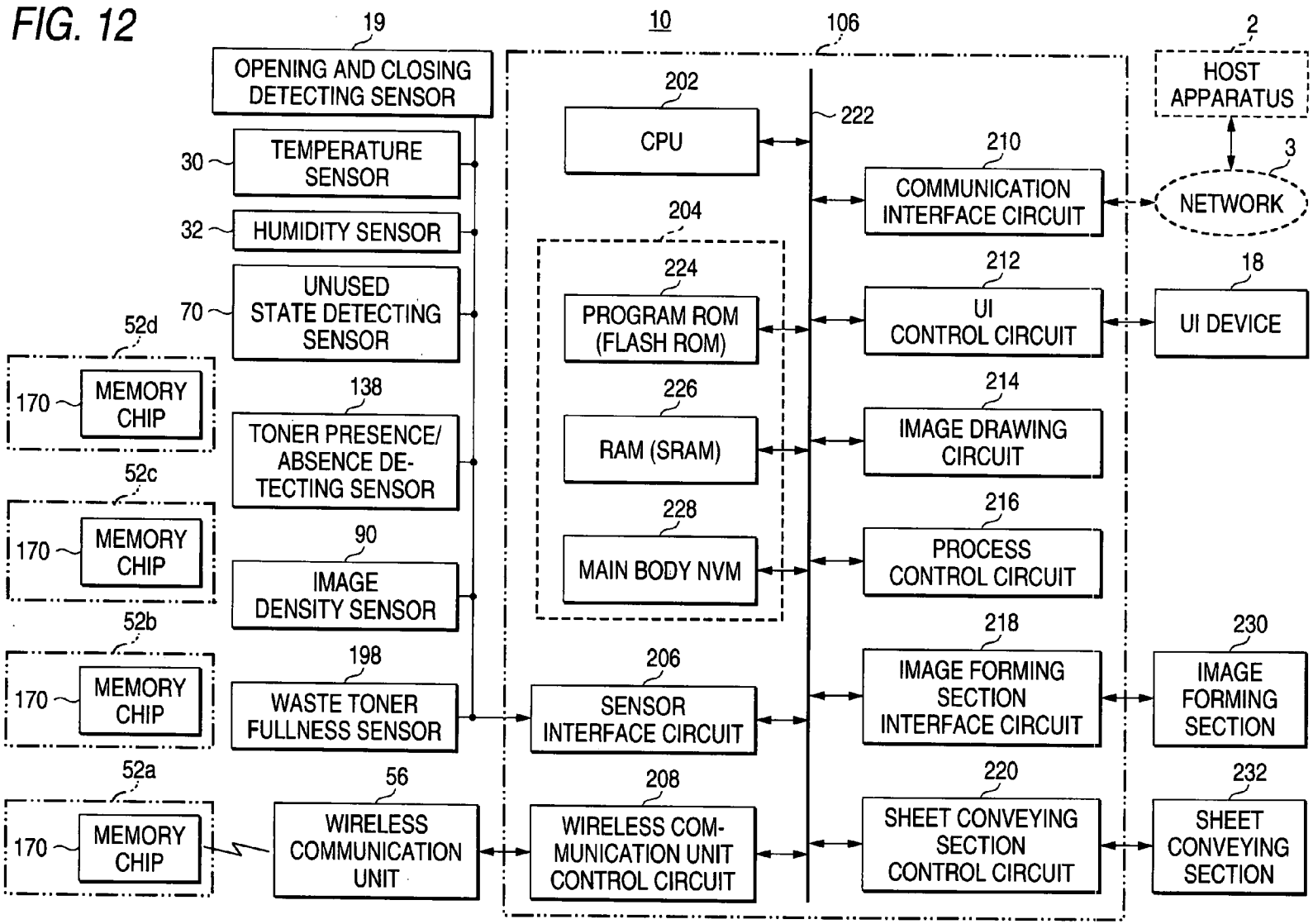
FIG. 12 is a block diagram showing a configuration of a control unit of the image forming apparatus according to the embodiment of the present invention, and respective components connected to the control unit.

FIG. 12 is a block diagram showing a configuration of the control unit 106 and respective components connected to the control unit 106.

The control unit 106 has a CPU 202, a storage unit 204, a sensor interface (sensor I/F) circuit 206, a wireless communication unit control circuit 208, a communication interface (communication I/F) circuit 210, a user interface (UI) control circuit 212, an image drawing circuit 214, a process control circuit 216, an image forming section interface (image forming I/F) circuit 218, and a sheet conveying section control circuit 220. These components are configured to be capable of inputting or outputting signals via a system bus 222.

The CPU 202 transmits or receives signals between the respective components, which constitute the control unit 106, via the system bus 222, and controls the respective components which constitute the control unit 106.

The storage unit 204 has a program ROM 224, a RAM 226 and a main body nonvolatile memory (NVM) 228, and stores information required for controlling the image forming apparatus 10, and the like. The program ROM 224 may have, for example, a flash ROM, and the contents stored in the program ROM 224 may be updated. The RAM 226 may have, for example, an SRAM, and stores temporary information, such as drawing data inputted from the image drawing circuit 214. The main body NVM 228 has, for example, an electrically rewritable nonvolatile memory, such as an EEPROM or a flash ROM. Meanwhile, the main body NVM 228 is a rewritable storage device, and it may be an SRAM, a hard disc drive (HDD) or an optical memory whose power is backed up by, for example, a battery, as long as it can hold data even if the image forming apparatus 10 is powered off.

The sensor I/F circuit 206 receives results detected by the opening and closing detecting sensor 19, the temperature sensor 30, the humidity sensor 32, the unused state detecting sensor 70, the toner presence/absence detecting sensor 138, the image density sensor 90 and the waste toner fullness sensor 198, respectively, and outputs the detected results to the CPU 202 via the system bus 222. The wireless communication unit control circuit 208 transmits or receives signals with the four memory chips 170 respectively provided in the toner cartridges 52*a* to 52*d* via the wireless communication unit 56, transmits or receives signals with the CPU 202, the storage unit 204 and the like, via the system bus 222, and connects the respective memory chips 170 with the CPU 202, storage unit 204 and the like.

The communication I/F circuit 210 transmits or receives signals with the host apparatus 2 via the network 3, transmits or receives signals with the CPU 202 and the like via the system bus 222, and connects the host apparatus 2 with the CPU 202 and the like. The UI control circuit 212 transmits or receives signals with the UI device 18, transmits or receives signals with the CPU 202 and the like via the system bus 222, and connects the UI device 18 with the CPU 202 and the like.

The image drawing circuit 214 draws an image on the basis of image forming signals inputted from the host apparatus 2 or the like, and outputs the drawn image to the CPU 202 and the RAM 226. The process control circuit 216 along with the CPU 202 refers to set values, which will be described later, stored in the storage unit 204, and controls an image forming section 230, including the exposure device 68, the image forming unit 110, the developer container unit 44 and the like, via the image forming section I/F circuit 218. The sheet conveying section control circuit 220 along with the CPU 202 controls a sheet conveying section 232, including the feeding roller 26, the retard roller 28, the resist roller 38 and the like.

Meanwhile, since the CPU 202 can compare the data stored in the storage unit 204 with the data stored in the unit NVM 184, and then determine the state of the toner cartridge 52 having the memory chip 170 thereto, the memory chip 170 constitutes a part of detecting unit, even if it does not have any sensor.

Next, data that is stored in the program ROM 224, the main body NVM 228 and the unit NVM 184 will now be described in detail.

Figure 13:
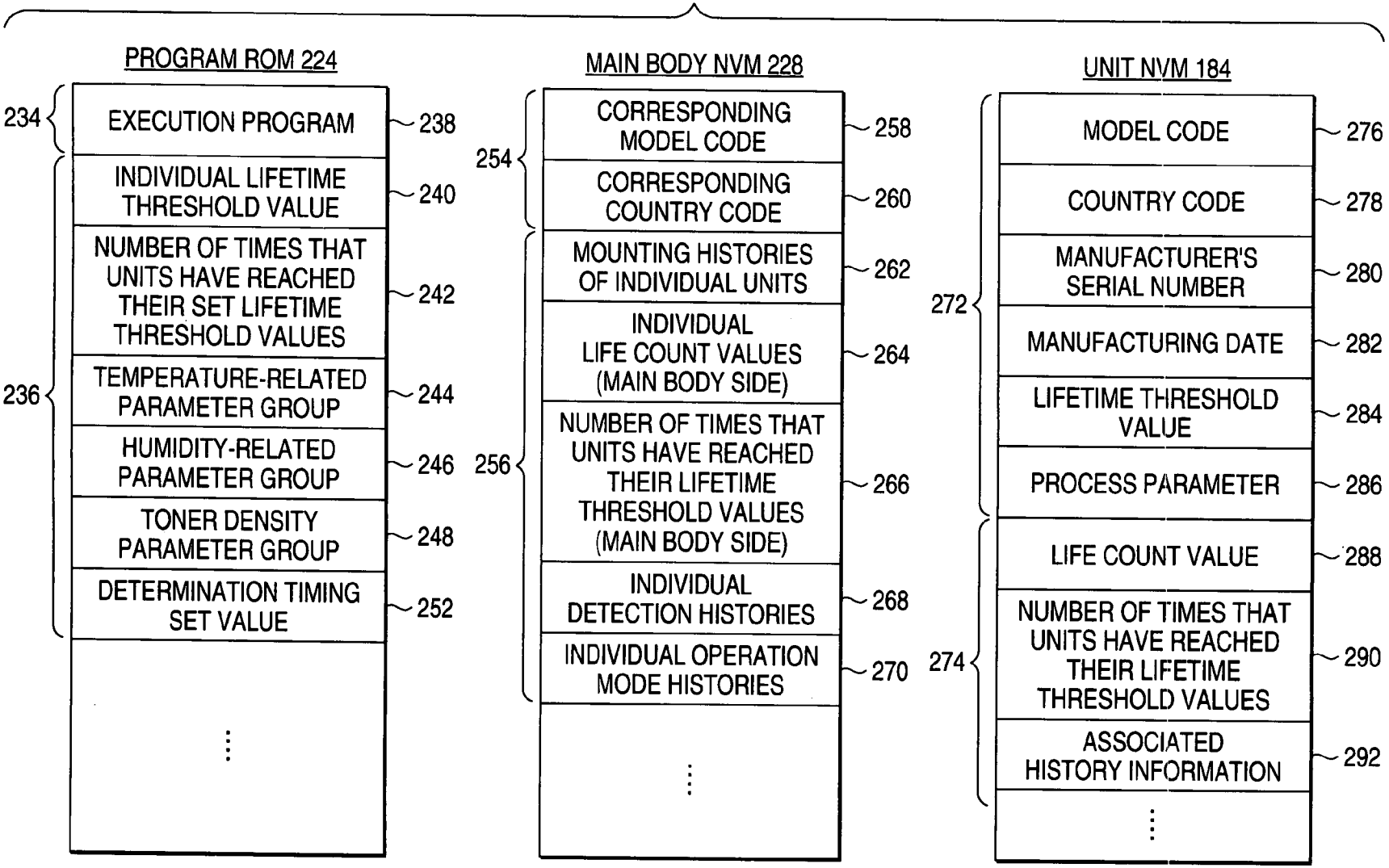
FIG. 13 is a memory map exemplifying data stored in a program ROM, a main body NVM and a unit NVM.

FIG. 13 illustrates an example of the data stored in the program ROM 224, the main body NVM 228 and the unit NVM 184.

The program ROM 224 is provided with a program region 234, a set value region 236, and the like. The program region 234 stores an execution program 238 for operating the image forming apparatus 10. The set value region 236 stores individual consumption threshold values 240, number of times that units reached their set lifetime threshold values 242, a temperature-related parameter group 244, a humidity-related parameter group 246, a toner density parameter group 248, and determination timing set values 252.

The individual consumption threshold values include the lifetime (lifetime threshold values) of individual replaceable units of the image forming apparatus 10. The number of times that units have reached their set lifetime threshold values 242 include the number of times which allows the individual replaceable units of the image forming apparatus 10 to arrive at individual threshold values thereof. The temperature-related parameter group 244 includes individual parameters related to the control of the temperature of the image forming apparatus 10. The humidity-related parameter group 246 includes individual parameters related to the control of the humidity of the image forming apparatus 10. The toner density parameter group 248 includes individual parameters related to the control of the density of a toner in the developer container 48. The determination timing set values 252 include a period of time (determination timing) which is taken until the CPU 202 starts to determine whether or not the individual replaceable units of the image forming apparatus 10 are genuine in a process (FIG. 17) or the like in which the image forming apparatus 10 performs printing preparation fit to an operation mode, which will be described later.

The main body NVM 228 is provided with a corresponding unit information region 254 and a main-body-side update region 256, and the like.

The corresponding unit information region 254 stores corresponding model codes 258 and corresponding country codes 260. The corresponding model codes 258 store a table (data) of models showing whether each of the individual replaceable units of the image forming apparatus 10 is a model which matches with the image forming apparatus 10. The corresponding country codes 260 store a table (data) of individual countries which sets specifications different in each country for the individual replaceable units of the image forming apparatus 10.

The main-body-side update region 256 stores mounting histories 262 of individual units, individual life count values 264 on the main body side, number of times that units have reached their lifetime threshold values 266 on the main body side, individual detection histories 268, individual operation mode histories 270, and the like. The individual unit mounting histories 262 include mounting histories of individual replaceable units of the image forming apparatus 10. Further, a value showing that a genuine article is mounted is stored in an initial state (as an initial value) of each of the individual unit mounting histories 262. The individual life count values 264 on the main body side include individual life count values (consumption up to the present time from the time when replaceable units begin to be used) of individual replaceable units of the image forming apparatus 10. Meanwhile, the consumption of the individual units may be calculated from the cumulative operation time or the like of each of the individual units. The number of times that units have reached their lifetime threshold values 266 on the main body side includes number of times that individual replaceable units of the image forming apparatus 10 have reached their lifetime threshold values. The individual detection histories 268 include histories of detection results detected by respective sensors or the like provided in the image forming apparatus 10. The individual operation mode histories 270 include histories of operation modes applied to individual replaceable units of the image forming apparatus 10.

The unit NVM 184 is provided with a unit information region 272, a unit-side update region 274, and the like.

The unit information region 272 stores model codes 276 indicating a model, country codes 278 indicating a country in which the specification of a model is set, manufacturer's serial numbers 280 and manufacturing dates 282, which are unique to the individual units, lifetime threshold values 284 indicating lifetime of the unit, process parameters 286 for process control, and the like.

The unit-side update region 274 stores life count values 288 showing the consumption of the toner cartridge 52 up to the present time from the time when the toner cartridges being to be used, number of times that units have reached their lifetime threshold values 290 showing the number of times which arrives at a lifetime threshold value stored in the lifetime threshold values 284, associated history information 292, and the like. Meanwhile, the associated history information 292 includes histories of associated information, such as the number of revolutions of the image carrier 54, available for grasping the state of the toner cartridge 52.

When image forming signals are transmitted to the image forming apparatus 10 constructed as above, the image carrier 54 is uniformly electrified by the electrifying device 60, and light rays are emitted onto the electrified image carrier 54 from the exposure device 68 on the basis of the image signals. The light rays from the exposure device 68 expose the surface of the image carrier 54, thereby forming a latent image.

The latent image carried by the image carrier 54 is developed at its development position by the developer container unit 44. In the developer container unit 44, the developer containers 48*a* to 48*d* are respectively supplied with yellow, magenta, cyan and black toners from the toner cartridges 52*a* to 52*d*. Further, developers excessively supplied to the developer containers 48*a* to 48*d* are respectively collected into the toner cartridges 52*a* to 52*d*. The toner images developed for each color by the developer containers 48*a* to 48*d* of the developer container unit 44 are superposed on the intermediate transfer body 74 to be primarily transferred thereto. At the time of the primary transfer, a waste toner remaining on the image carrier 54 is scraped and collected by the cleaner 62 for an image carrier.

On the other hand, upon receiving sheet feeding signals or the like, sheets received in the sheet feeding cassette 24 are fed by the feeding roller 26, are separated by the retard roller 28, and are guided to the conveying path 34, are then primarily stopped by the resist roller 38, and are guided to between the secondary transfer roller 88 and the secondary transfer backup roller 82 at a predetermined timing. When the sheet is guided to between the secondary transfer roller 88 and the secondary transfer backup roller 82, a toner image on which four colors overlap each other by the primary transfer onto the intermediate transfer body 74 is secondarily transferred on the sheet by the secondary transfer roller 88 and the secondary transfer backup roller 82. After the secondary transfer, a waste toner remaining on the intermediate transfer body 74 is scraped by the cleaner 92 for an intermediate transfer body, and is then collected.

The sheet onto which the toner image has been transferred is guided to the fixing device 100, and the toner image on the sheet is fixed by a thermal pressure generated by the heating roller 102 and the pressing roller 104. The sheet on which the toner image has been fixed is discharged from the discharge port 36 toward the discharge section 42 by means of the discharge roller 40. The control unit 106 makes a life count value or the like of the toner cartridge 52 stored in the unit NVM 184 and the main body NVM 228.

Figure 14:
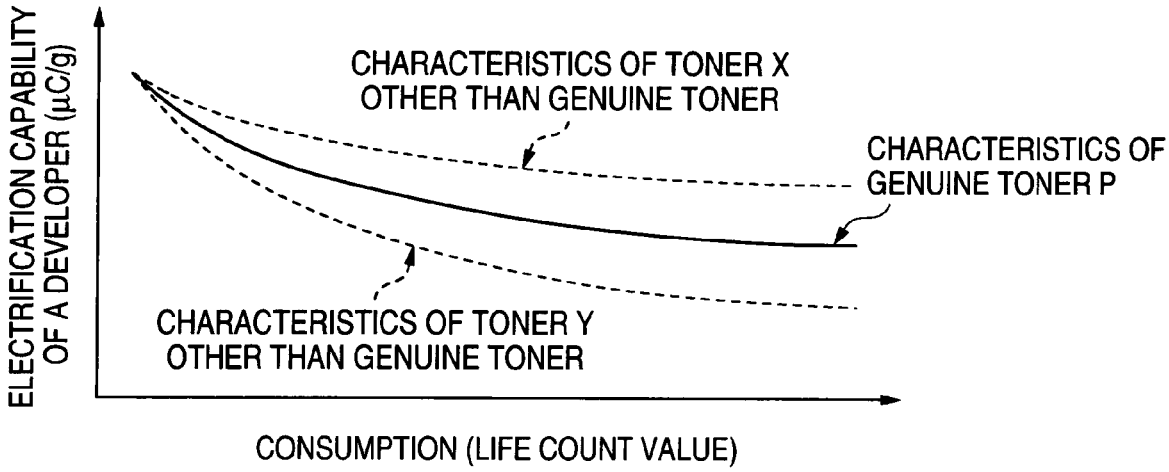
FIG. 14 is a graph showing a change in the electrification capability of a developer with respect to a consumption (a life count value) stored in the main body NVM.

FIG. 14 is a graph showing a change in the electrification capability of a developer with respect to the consumption (life count value) of the developer stored in the main body NVM 228.

Figure 15:
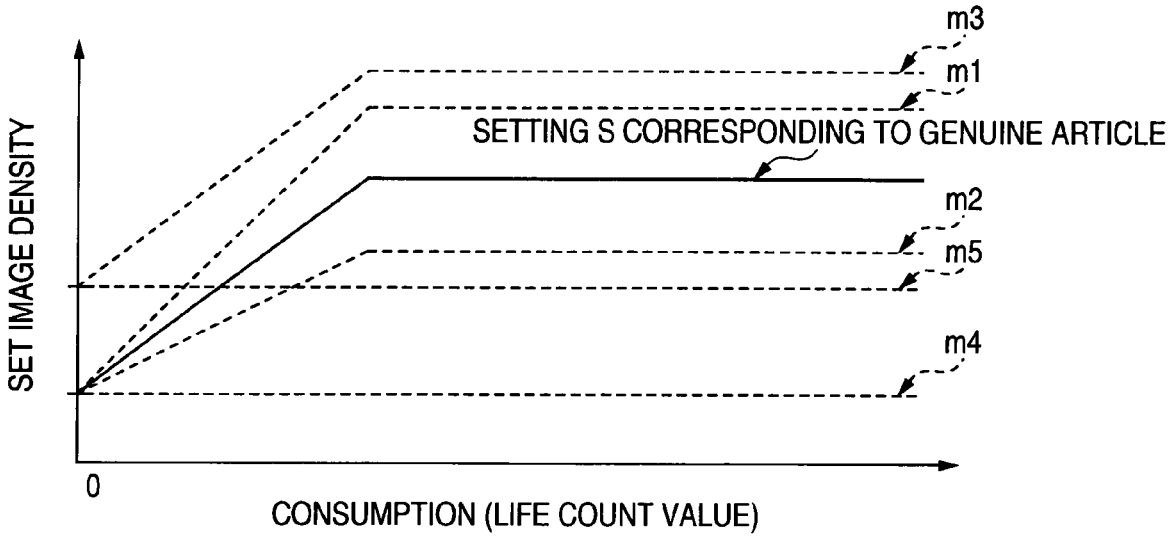
FIG. 15 is a graph showing setting for correcting a change in the electrification capability of the developer, which shows setting of an image density with respect to the consumption of the developer.

FIG. 15 is a graph showing setting for correcting a change in the electrification capability of the developer, which shows setting of an image density with respect to the consumption of the developer.

Figure 16A:
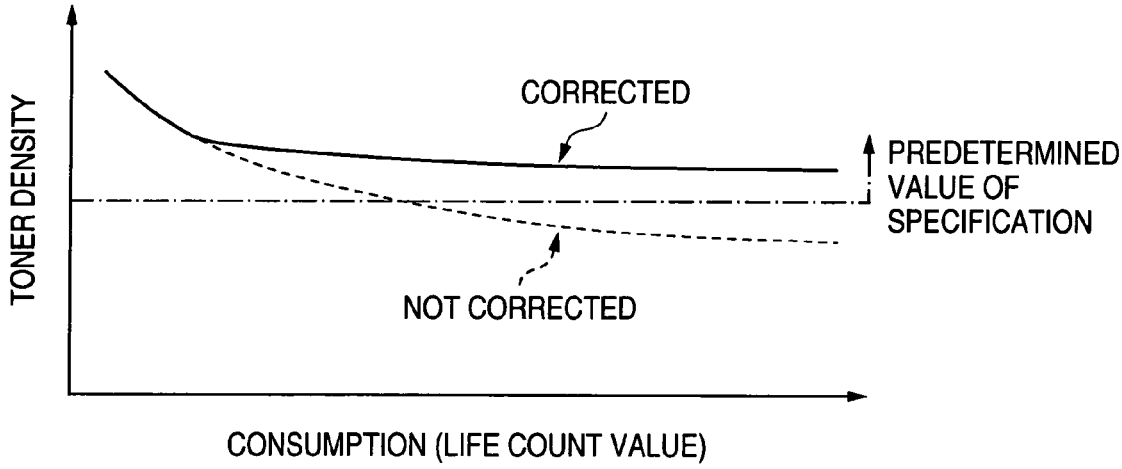
Figure 16B:
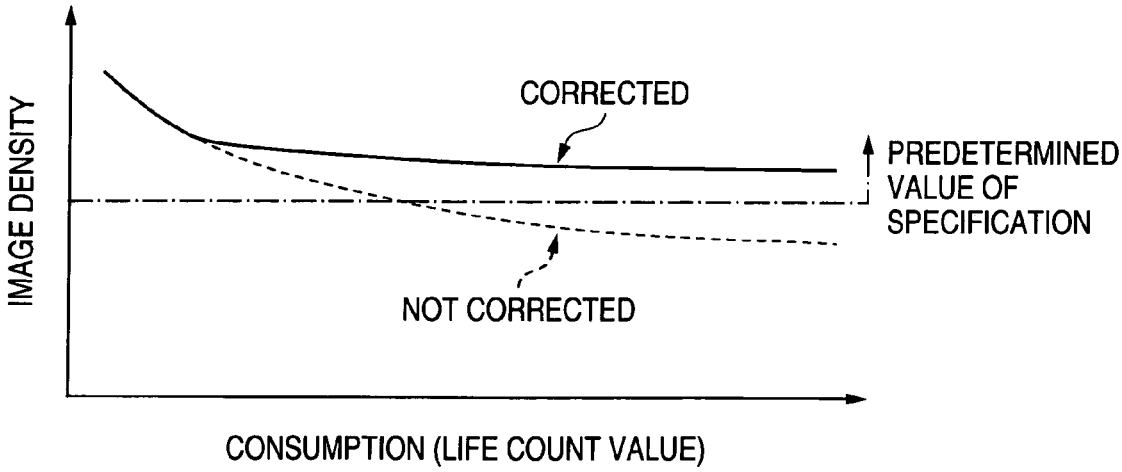

FIGS. 16A and 16B are graphs showing results corrected by the setting shown in FIG. 15, in which FIG. 16A shows a corrected toner density, and FIG. 16B shows a corrected image density.

A toner accommodated in the toner cartridge 52 is frictionally electrified so as to have predetermined polarity and electric charge quantity by a carrier in the developer container 48. When a developer is used, the electrification capability of the developer deteriorates according to the consumption of the developer, like characteristics of a genuine toner P shown in FIG. 14.

Thus, even when the image forming apparatus 10 employs a trickle development method, in order to maintain the image quality of an image formed on a sheet at a predetermined level, the setting on the density of a toner in the developer container 48 and the density of an image on the intermediate transfer body 74 should be corrected.

For example, the CPU 202 makes the image density sensor 90 detect the density of an image. At this time, if the image density is high, the CPU 202 controls the rotational drive of the first auger 118 to reduce the amount of a toner to be supplied into the developer container 48, thereby lowering the density of the toner, which lowers the density of the image. Further, if the image density is low, the CPU 202 controls the rotational drive of the first auger 118 to increase the amount of a toner to be supplied into the developer container 48, thereby raising the density of the toner, which raises the density of the image. Generally, a pattern having half-tone density is used as a pattern for detecting the above-mentioned image density.

However, when the electrification capability of a toner deteriorates, the development performance of the toner is improved and the image density is raised. Therefore, if the above-mentioned control is executed as it is, the toner density may be excessively lowered, which may lower a maximum image density.

Accordingly, even when the electrification capability of a developer deteriorates, in order for the maximum density of an image transferred onto a sheet not to be lowered, the set values for controlling the density of a toner in the developer container 48, which are stored in the toner image parameter group 248 used for controlling the toner density based on the image density detection results detected by the image density sensor 90, are corrected to increase according to the consumption of the developer. The CPU 202 makes the first auger 118 rotate according to the corrected set values (setting S corresponding to the toner P in FIG. 15) so that the toner density can be maintained so as not to be below a desired predetermined value, as shown in FIG. 16A.

As a result, as shown in FIG. 16B, the image density can be maintained so as not to be below a specified set value.

On the other hand, in case a toner cartridge other than a genuine cartridge, which contains a toner X or a toner Y other than a genuine toner P for the image forming apparatus 10 and has substantially the same construction as that of the toner cartridge 52, is mounted, as shown in FIG. 14, it is expected the toner X or the toner Y will exhibit characteristics different from those of the genuine toner P. Thus, in order to improve the quality of an image to be formed on a sheet, corrected set values different from the setting S corresponding to the toner P are required. Accordingly, for example, in the case of any cartridge other than a genuine cartridge, which contains the toner X or the toner Y, correction is made to the consumption of a developer obtained by combining conditions to be changed, such as increasing or decreasing the degree of a change (gradient) in a set value of the toner density (m1 or m2 in FIG. 15); increasing or decreasing a limit value (m1 or m2); varying an initial value (consumption=0) (m3); no making a change in a set value according to the consumption (m4); and no making a change in a set value according to the consumption, for example, by varying an initial value (m5). This change is performed by allowing a user to select an operation mode other than that corresponding to the genuine toner via the UI device 18.

Next, the control of the image forming apparatus 10 based on the data stored in the storage unit 204 and the unit NVM 184 will now be described.

On the basis of the data stored in the storage unit 204 and the unit NVM 184, the image forming apparatus 10 controls display or the like by the UI device 18. For example, if the toner cartridge 52 is genuine, the CPU 202 controls the UI device 18 to display the residual quantity of the toner, whereas if the toner cartridge 52 is not genuine, the CPU 202 controls the UI device 18 to display the consumption of the toner. This is because, if the toner cartridge 52 is not genuine, the quantity of the toner is unknown, so that the residual quantity of the toner cannot be calculated.

Next, a method of controlling the image forming apparatus 10 based on the data stored in the storage unit 204 and the unit NVM 184 will now be described.

Figure 17:
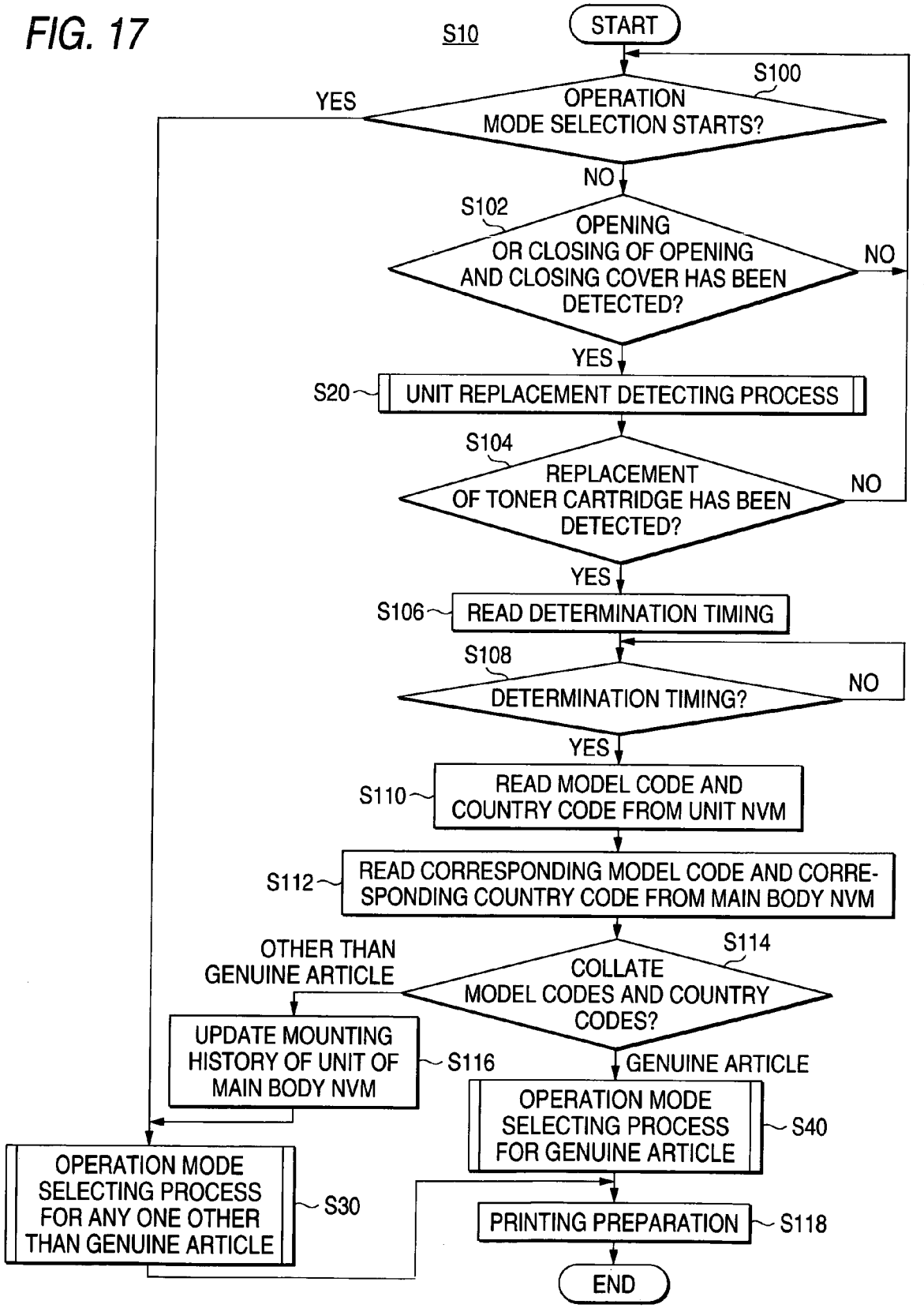
FIG. 17 is a flowchart showing a process (S10) in which the image forming apparatus performs printing preparation on a toner cartridge, which is fit to an operation mode.

FIG. 17 is a flowchart showing a process (S10) in which the image forming apparatus 10 performs printing preparation on the toner cartridge 52, which is fit for an operation mode.

Figure 18:
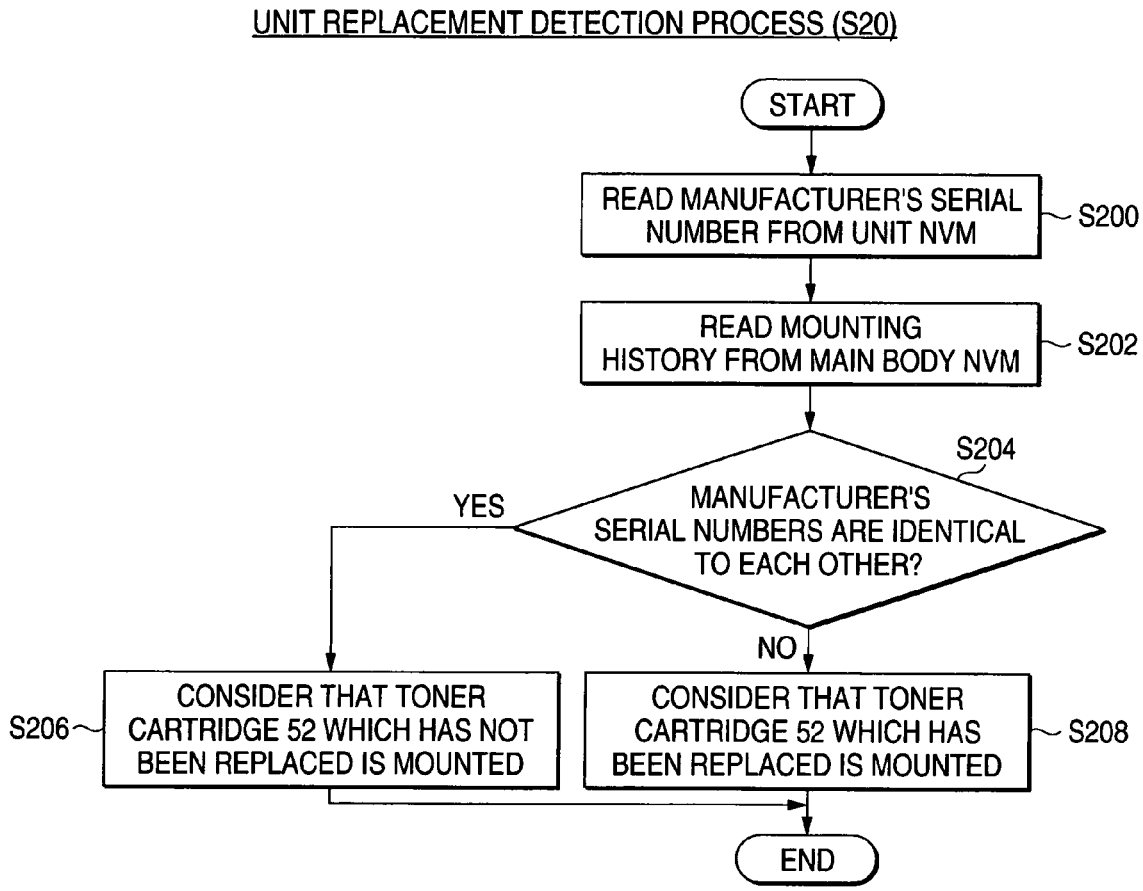
FIG. 18 is a flowchart showing a unit replacement detecting process (S20) of detecting whether or not a toner cartridge has been replaced.

FIG. 18 is a flowchart showing a unit replacement detecting process (S20) of detecting whether or not the toner cartridge 52 has been replaced.

Figure 19:
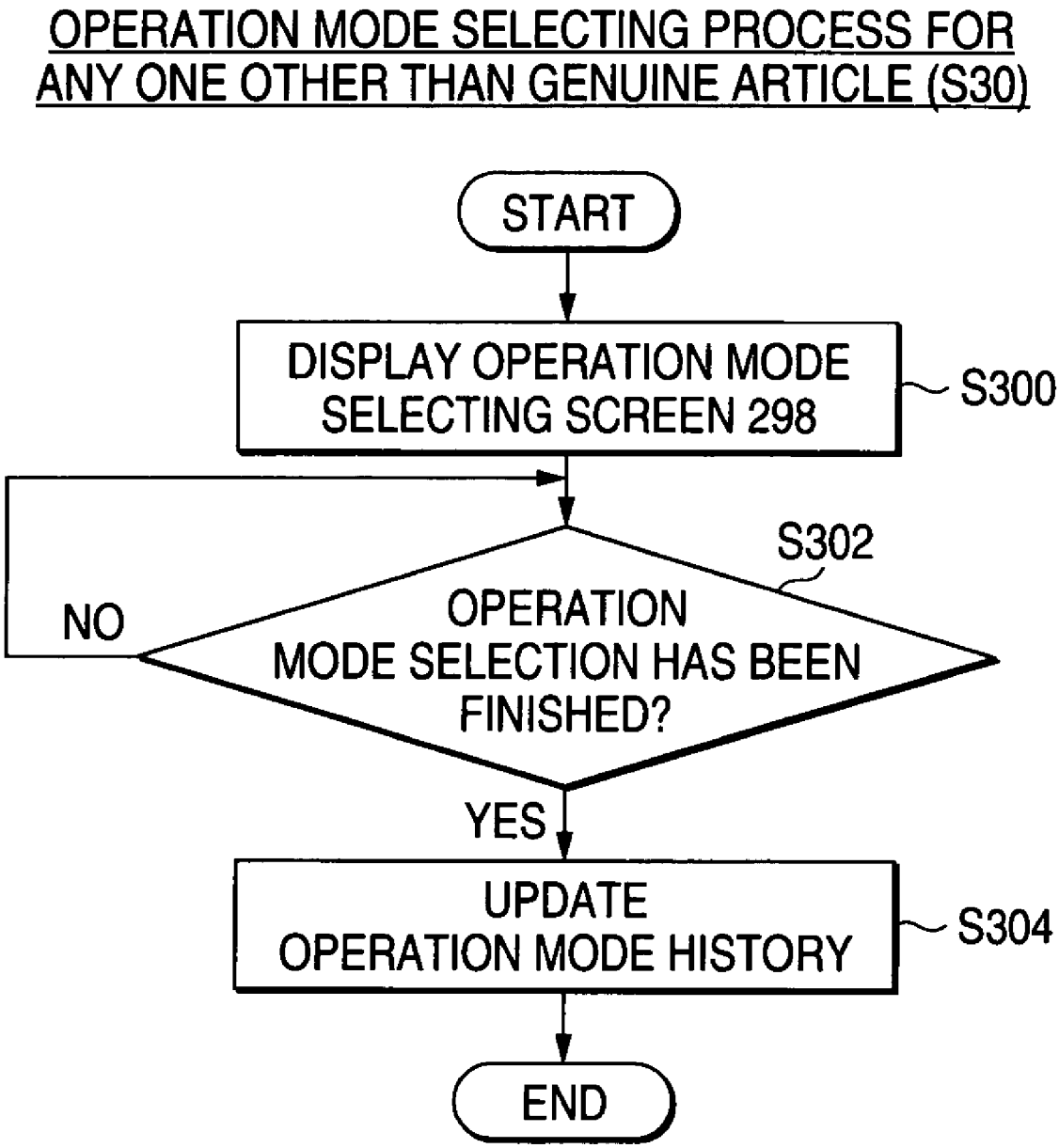
FIG. 19 is a flowchart showing an operation mode selecting process for any one other than a genuine article (S30), performed by the image forming apparatus so that a user can select an operation mode for any one other than the genuine article.

FIG. 19 is a flowchart showing an operation mode selecting process for any one other than a genuine article (S30), performed by the image forming apparatus 10 so that a user can select an operation mode for any one other than the genuine article.

Figure 20:
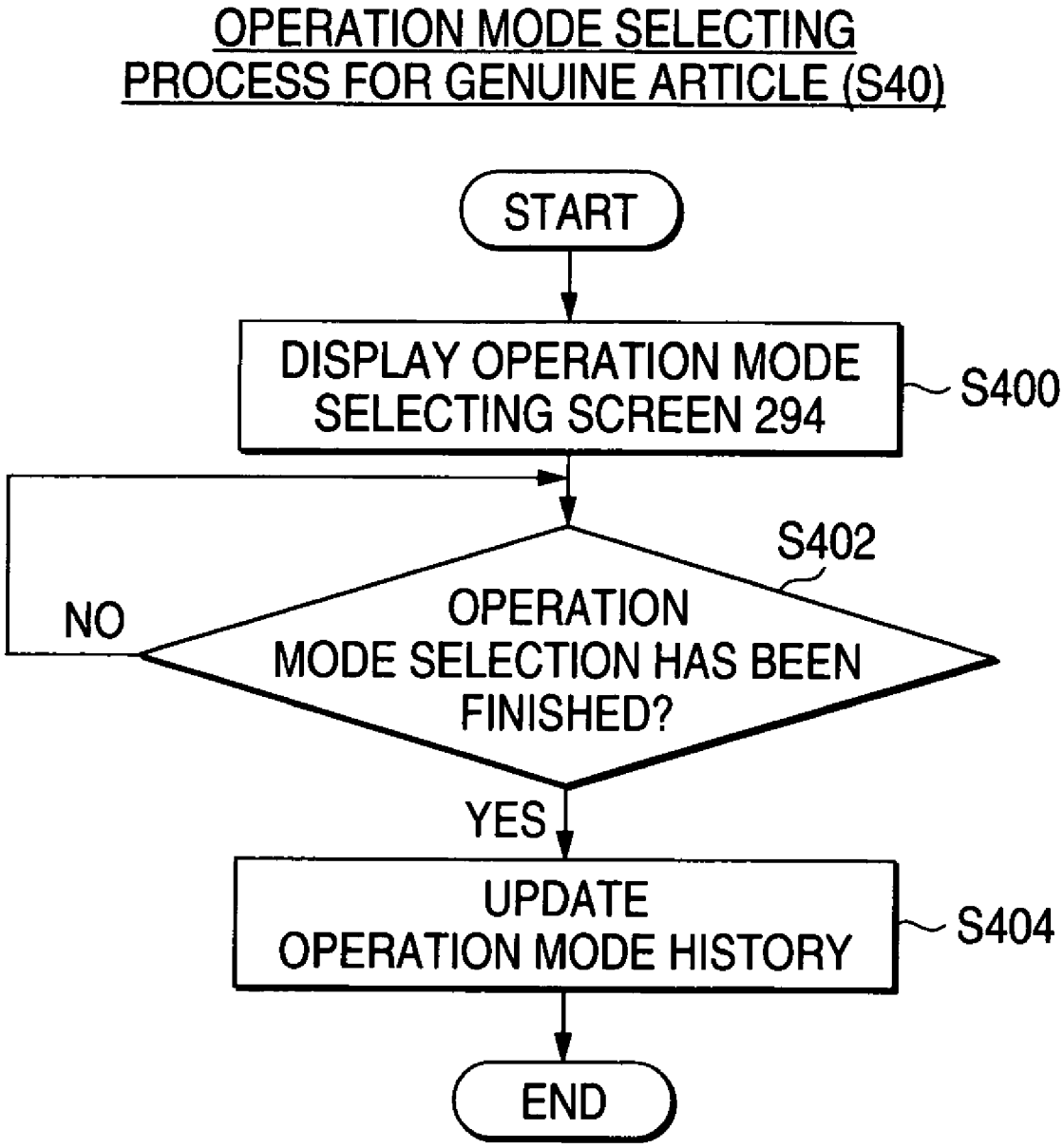
FIG. 20 is a flowchart showing an operation mode selecting process for a genuine article (S40) performed by the image forming apparatus so that a user can select an operation mode for the genuine article.

FIG. 20 is a flowchart showing an operation mode selecting process for a genuine article (S40) performed by the image forming apparatus 10 so that a user can select an operation mode for the genuine article.

As shown in FIG. 17, in Step 100 (S100), the CPU 202 determines whether or not there is any input for starting the selection of an operation mode by operating the UI device 18. If there is any input for starting the selection of an operation mode, the process in S30 is carried out, whereas if there is no input for starting the selection of an operation mode, a process in S102 is carried out.

In Step 102 (S102), the CPU 202 determines whether the opening and closing detecting sensor 19 has detected opening or closing of the opening and closing cover 16. If the CPU 202 determines that the opening or closing of the opening and closing cover 16 has been detected, a process in S20 is carried out. If not, a process in S100 is carried out. In other words, if the opening and closing cover 16 is opened or closed, since there is possibility that the toner cartridge 52 has been replaced, a unit replacement detecting process is carried out.

In Step 200 (S200 in FIG. 18), the CPU 202 reads the manufacturer's serial number 280 from the unit NVM 184.

In Step 202 (S202), the CPU 202 reads a manufacturer's serial number of a last-mounted toner cartridge, which is included in the individual unit mounting histories 262 from the main body NVM 228.

In Step 204 (S204), the CPU 202 determines whether or not the manufacturer's serial number of the last-mounted cartridge is identical to the manufacturer's serial number 280 read from the unit NVM 184. If the manufacturer's serial number of the last-mounted toner cartridge is identical to the manufacturer's serial number 280 read from the unit NVM 184, a process in S206 is carried out. If not, a process in S208 is carried out.

In Step 206 (S206), the CPU 202 considers that the toner cartridge 52 which has not been replaced is again mounted (that the toner cartridge is not replaced).

In Step 208 (S208), the CPU 202 considers that a toner cartridge 52 which has been replaced is mounted (that the replacement is detected).

In Step 104 (S104 in FIG. 17), if the CPU 202 considers that the replacement of the toner cartridge 52 is detected, a process in S106 is carried out. If not, the process in S100 is carried out.

In Step 106 (S106), the CPU 202 reads the determination timing set values 252 from the program ROM 224.

Meanwhile, the determination timing set values 252 may be zero.

In Step 108 (S108), the CPU 202 determines whether or not a determination timing has reached that starts to determine whether or not a mounted toner cartridge 52 is genuine, using a timer or the like, which is not shown. If the determination timing has reached that starts to determine whether or not the mounted toner cartridge 52 is genuine, a process in S110 is carried out. If not, the CPU 202 waits to the determination timing.

In Step 110 (S110), the CPU 202 reads a model code 276 and a country code 278 from the unit NVM 184.

In Step 112 (S112), the CPU 202 reads a corresponding model code 258 and a corresponding country code 260 from the main body NVM 228.

In Step 114 (S114), the CPU 202 collates the model code 276 with the corresponding model code 258, and collates the model code 278 with the corresponding country code 260. At this time, if the CPU 202 determines that a replaced toner cartridge 52 is genuine, a process in S40 is carried out, whereas if the CPU 202 determines that the replaceable cartridge 52 is not genuine, a process in S116 is carried out.

In Step 116 (S116), in accordance with data read from the toner cartridge 52 which is currently mounted, the CPU 202 updates the mounting history of the toner cartridge 52 included in the individual unit mounting histories 262 of the main body NVM 228. Then, the process in S30 is carried out.

Figure 21A:
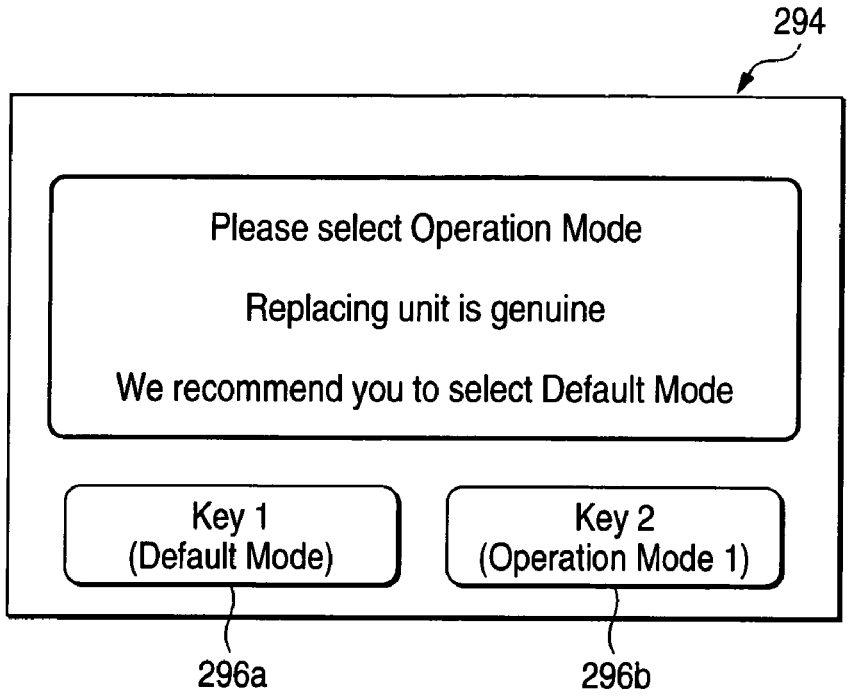
Figure 21B:
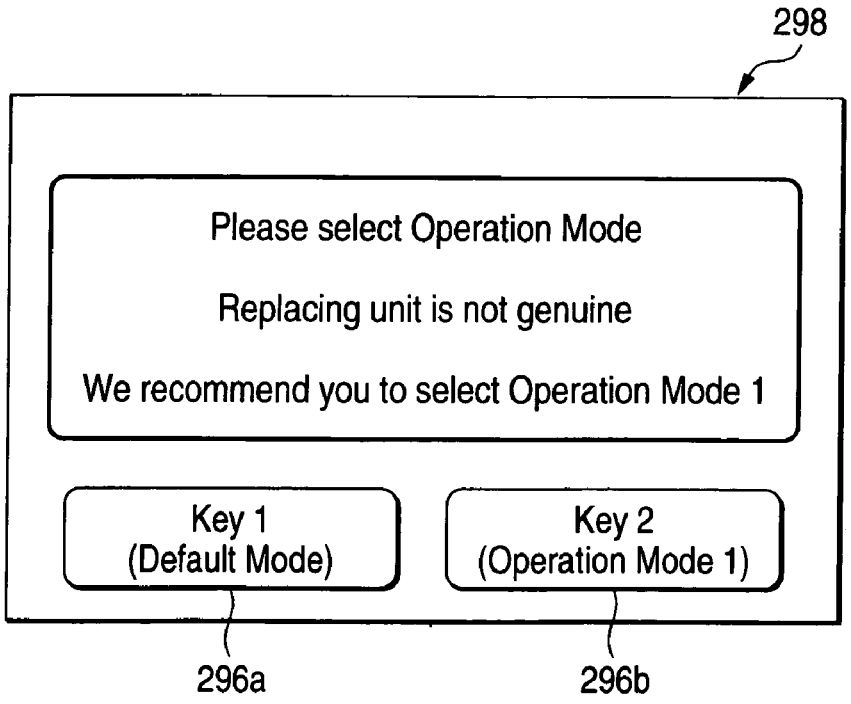

In Step 300 (S300 in FIG. 19), the UI device 18 displays an operation mode selecting screen 298 shown in FIG. 21B.

In Step 302 (S302), the CPU 202 determines whether or not an input has been finished which selects either a key button 296*a* for selecting a default mode (an operation mode corresponding to a genuine article) displayed on the operation mode display screen 298, or a key button 296*b* for specifying the other operation modes. If the input which selects any one of the key buttons 296*a* and 296*b* has been finished, a process in S304 is carried out. If there is no input for specifying any one of the operation modes, the image forming apparatus 10 waits until a user selects any operation mode.

In Step 304 (S304), the CPU 202 updates (including overwrite) the individual operation mode histories 270 of the main body NVM 228 with an operation mode selected in S302.

In Step 400 (S400 in FIG. 20), the UI device 18 displays the operation mode selecting screen 294 shown in FIG. 21A.

In Step 402 (S402), the CPU 202 determines whether or not an input has been finished which selects either the key button 296*a* for selecting a default mode (an operation mode corresponding to a genuine article) displayed on the operation mode display screen 294, or the key button 296*b* for specifying the other operation modes. If the input which selects any one of the key buttons 296*a* and 296*b* has been finished, a process in S404 is carried out. If there is no input for specifying any one of the operation modes, the image forming apparatus 10 waits until a user selects any operation mode.

In Step 404 (S404), the CPU 202 updates (including overwrite) the individual operation mode histories 270 of the main body NVM 228 with an operation mode selected in S402.

In Step 118 (S118 in FIG. 17), the CPU 202 performs printing operation fit to a selected operation mode which is included in the latest individual operation mode histories 270, and then completes the process. Meanwhile, in the printing preparation in S118, for example, whether or not a mounted toner cartridge 52 is genuine may be displayed on the UI device 18.

Meanwhile, a plurality of other operation modes different from an operation mode corresponding to a genuine article may be provided so that a user can freely select any operation mode from the plurality of other operation modes.

As such, even when a replaceable unit of the image forming apparatus 10 is not genuine, a user can select any operation mode different from an operation mode corresponding to a genuine article so that the image quality can be improved.

Further, if replaceable units are all genuine, an operation mode which can be selected by a user is limited so that the image forming apparatus 10 operates only in operation modes corresponding to the genuine articles, thereby preventing the user from deteriorating the image quality inadvertently.

Next, modifications of the image forming apparatus according to the embodiment of the present invention will now be described.

Figure 22:
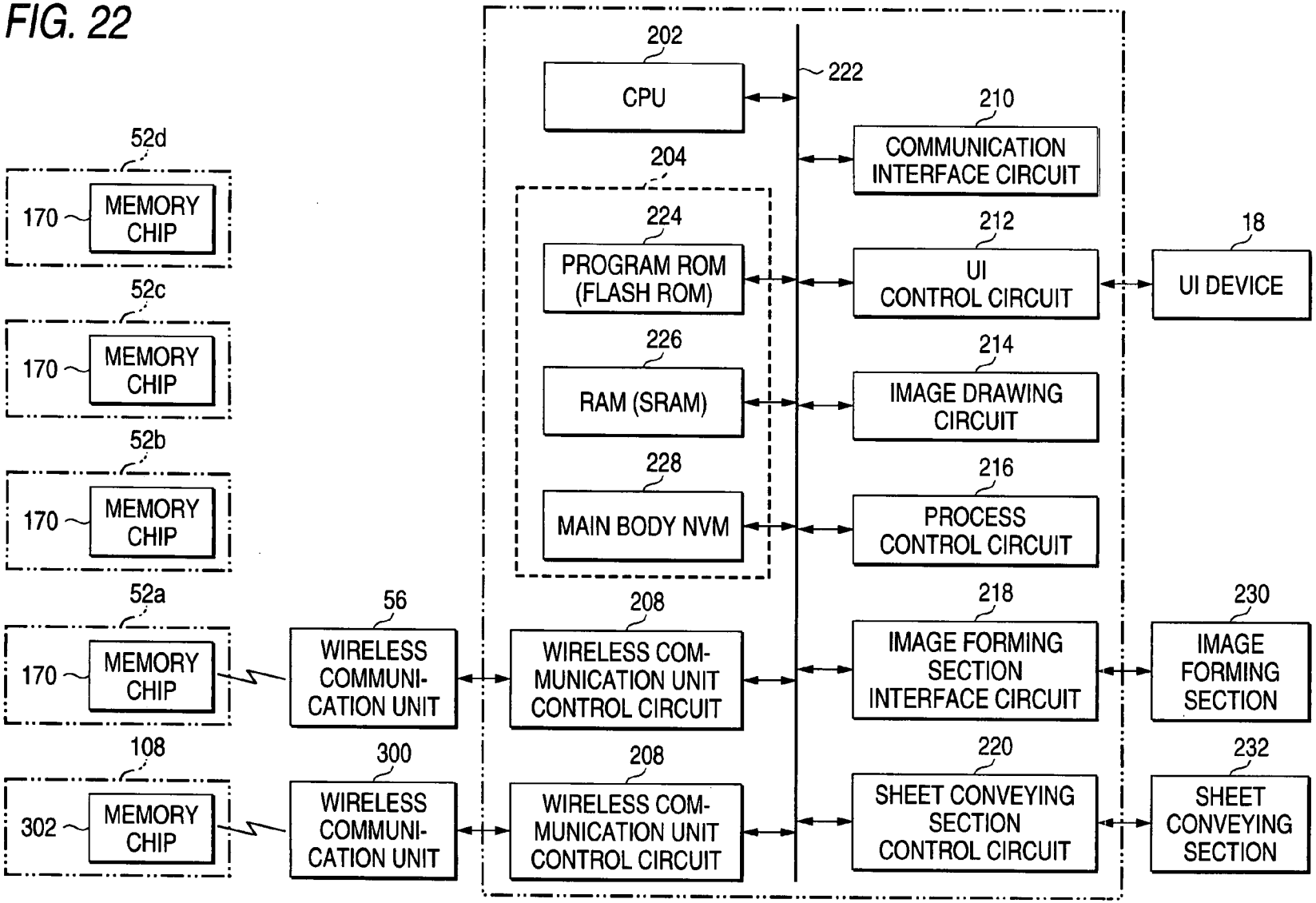
FIG. 22 is a block diagram showing one modification of the image forming apparatus according to the present invention.

FIG. 22 shows a first modification of the image forming apparatus according to the embodiment of the present invention. Meanwhile, in the first modification of the image forming apparatus, the components substantially identical to those of the image forming apparatus 10 shown in FIG. 12 are given the same reference numerals.

The first modification of the image forming apparatus has, for example, the toner cartridges 52*a* to 52*d* and the image carrier unit 108.

A wireless communication unit 300 has the same construction as that of the wireless communication unit 56 shown in FIG. 8, and is fixed to, for example, the image forming apparatus main body. A memory chip 302 has the same construction as that of the memory chip 170 as shown in FIG. 9, and is provided in, for example, a replaceable unit such as the image carrier unit 108 shown in FIG. 11. Further, when a replaceable unit such as the image carrier unit 108 is mounted in the image forming apparatus main body, the memory chip 302 is located in the vicinity of the wireless communication unit 300, and transmits or receives signals with the wireless communication unit 300 under the control of the CPU 202.

Thus, in the first modification of the image forming apparatus, four memory chips 170 sequentially transmit or receive signals with the wireless communication unit 56, and the memory chip 302 transmits or receives signals with the wireless communication unit 300. Thereby, whether or not replaceable units, such as the toner cartridges 52*a* to 52*d* provided with the memory chips 170, respectively, and the image carrier unit 108 provided with the memory chip 302, are genuine can be discriminated.

Figure 23:
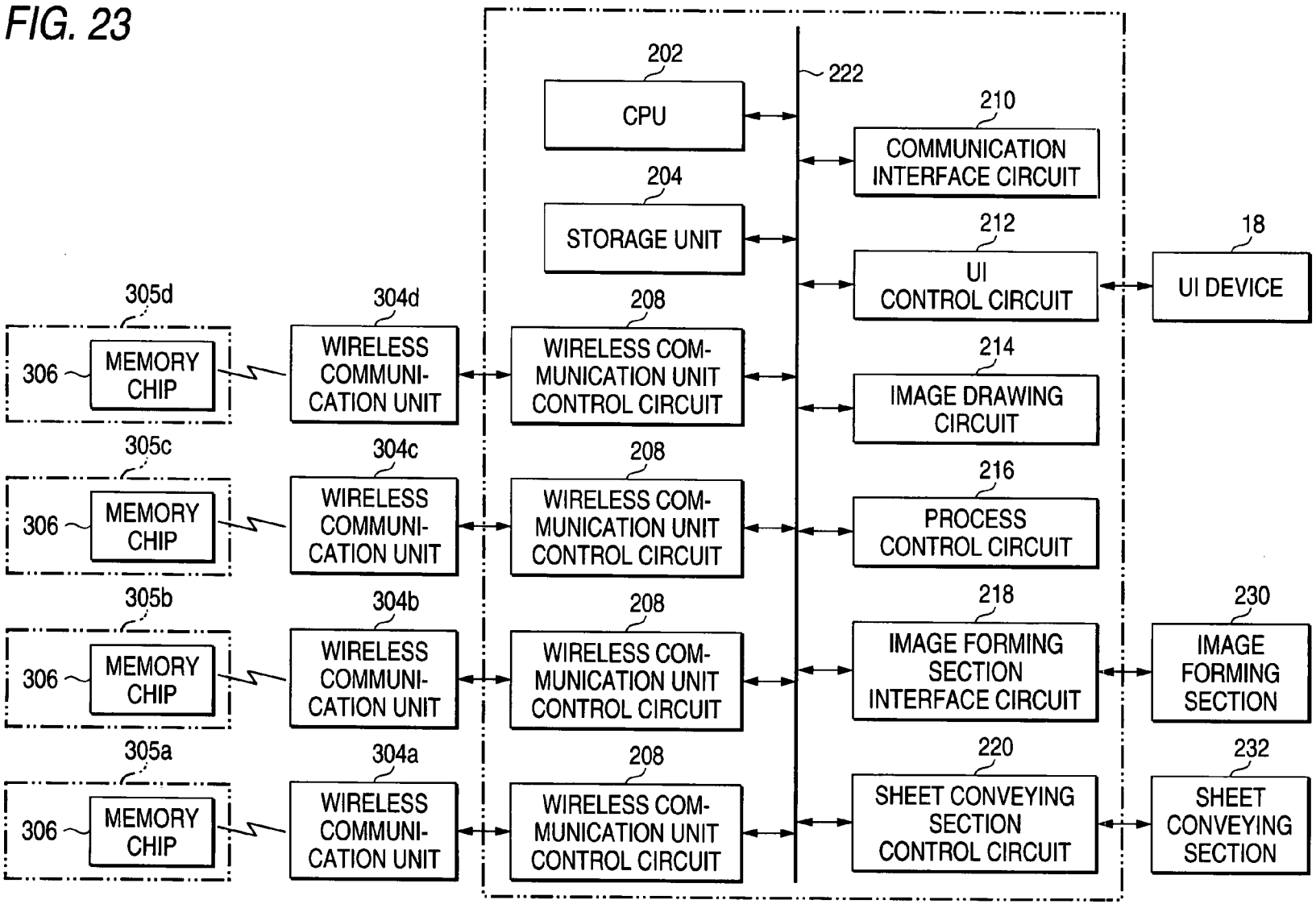
FIG. 23 is a block diagram showing one modification of the image forming apparatus according to the present invention.

FIG. 23 shows a second modification of the image forming apparatus according to the embodiment of the present invention. Meanwhile, in the second modification of the image forming apparatus, the components substantially identical to those of the image forming apparatus 10 shown in FIG. 12 are given the same reference numerals.

The second modification of the image forming apparatus has units, such as four wireless communication units 304*a* to 304*d* and toner cartridges 305*a* to 305*d* replaceably arranged at predetermined positions in the image forming apparatus for accommodating yellow, magenta, cyan and black toners, respectively.

The wireless communication units 304*a* to 304*d* have the same construction as that of the wireless communication unit 56 shown in FIG. 8, and are fixed to, for example, the image forming apparatus main body. The memory chips 306 have the same construction as that of the memory chip 170 shown in FIG. 9, and are provided in, for example, the toner cartridges 305*a* to 305*d*, respectively. Further, when the toner cartridges 305*a* to 305*d* are mounted in the image forming apparatus main body, the memory chips 306 are located in the vicinities of the wireless communication units 304*a* to 304*d*, respectively, and transmit or receive signals with the wireless communication units 304*a* to 304*d*, respectively, under the control of the CPU 202.

Thus, in the second modification of the image forming apparatus, four memory chips 306 transmit or receive signals with the wireless communication units 304*a* to 304*d*, respectively. Thereby, whether or not replaceable units, such as the toner cartridges 305*a* to 305*d* provided with the memory chips 306, respectively, are genuine can be discriminated.

Figure 24:
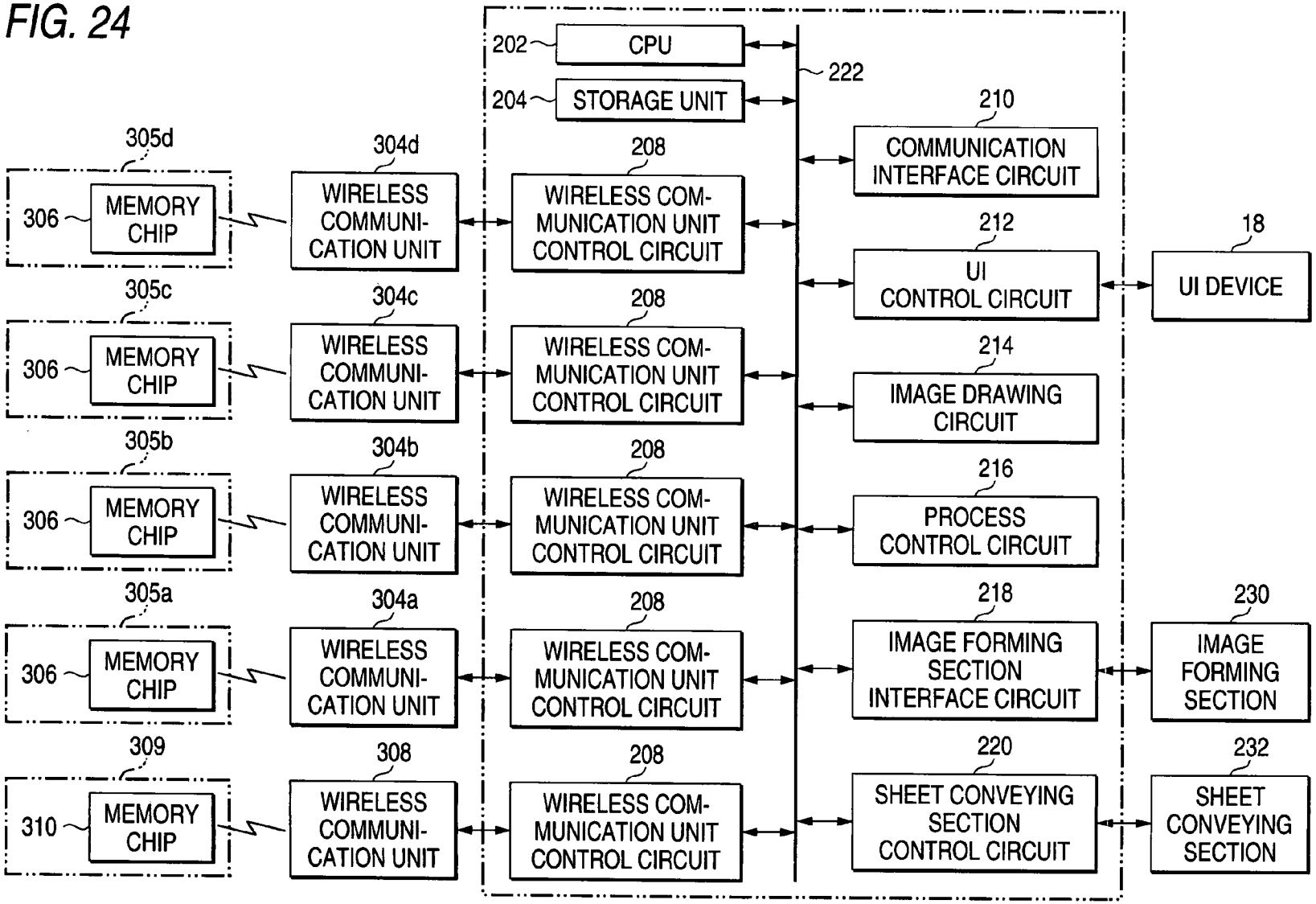
FIG. 24 is a block diagram showing one modification of the image forming apparatus according to the present invention.

FIG. 24 shows a third modification of the image forming apparatus according to the embodiment of the present invention. Meanwhile, in the third modification of the image forming apparatus, the components substantially identical to those of the second modification of the image forming apparatus shown in FIG. 23 are given the same reference numerals.

The third modification of the image forming apparatus has replaceable units, such as four wireless communication units 304*a* to 304*d*, toner cartridges 305*a* to 305*d* replaceably arranged at predetermined positions in the image forming apparatus for accommodating yellow, magenta, cyan and black toners, respectively, and an image carrier unit 309 including an image carrier such as a photoreceptor.

The wireless communication unit 308 has the same construction as that of the wireless communication unit 56 shown in FIG. 8, and is fixed to, for example, the image forming apparatus main body. The memory chip 310 has the same construction as that of the memory chip 170 shown in FIG. 9, and is provided in, for example, the image carrier unit 309. Further, when the image carrier unit 309 is mounted in the image forming apparatus main body, the memory chip 310 is located in the vicinity of the wireless communication unit 308, and transmits or receives signals with the wireless communication unit 308, under the control of the CPU 202.

Thus, in the third modification of the image forming apparatus, four memory chips 306 transmit or receive signals with the wireless communication units 304*a* to 304*d*, respectively, and the memory chip 310 transmits or receives signals with the wireless communication unit 308. Thereby, whether or not the replaceable units, such as the toner cartridges 305*a* to 305*d* provided with the memory chips 306, respectively, and the image carrier unit 309 provided with the memory chip 310, are genuine can be discriminated.

Second Embodiment

An image forming apparatus, an image forming system, and a method of controlling the image forming apparatus of the second embodiment includes configurations of the first embodiment that are explained by FIGS. 1 to 24. Therefore, in this embodiment, explanations of the overlapped configurations are omitted.

Data that are stored in the program ROM 224, the main body NVM 228 and the unit NVM 184 will now be described in detail.

Figure 25:
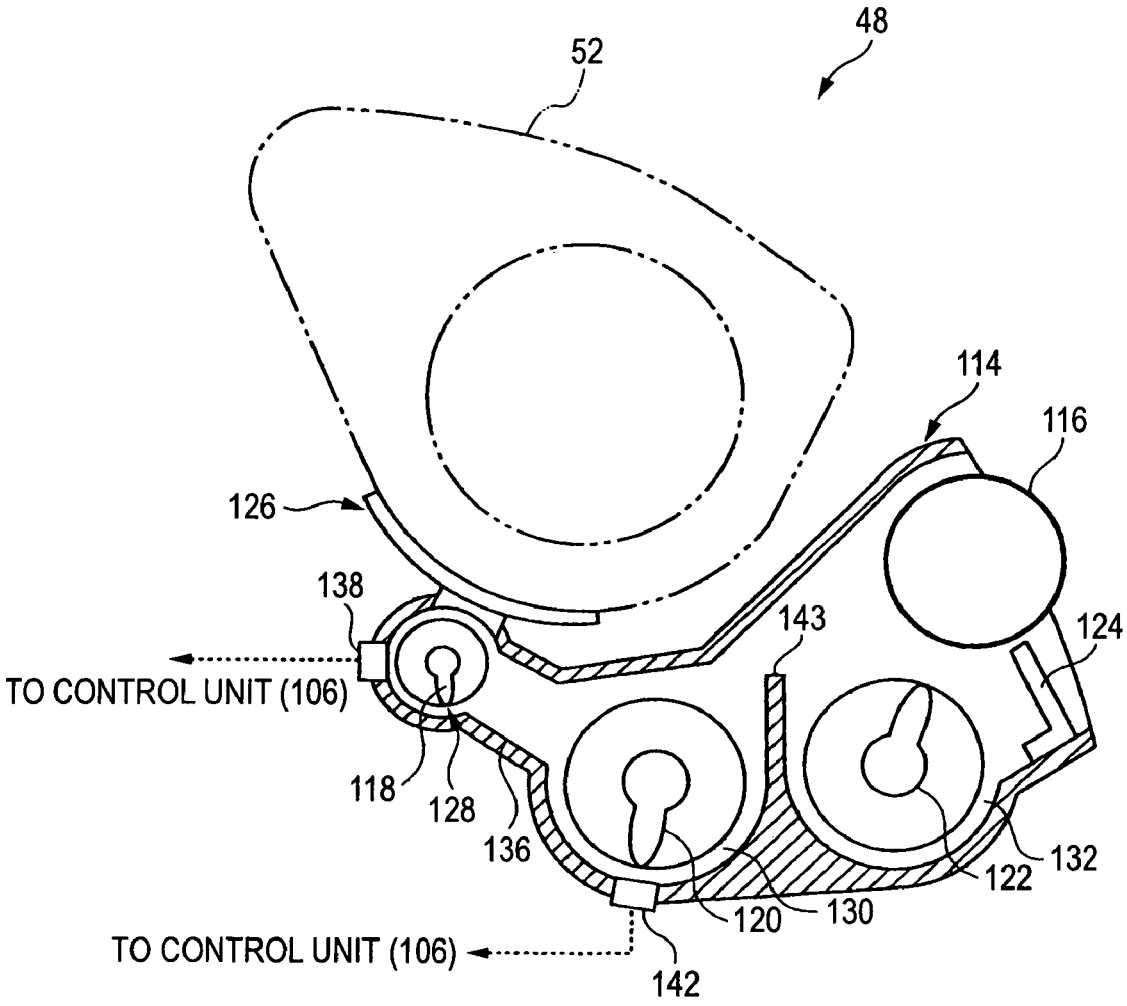
FIG. 25 is a schematic view showing a cross-section of the developer container of the image forming apparatus according to one embodiment of the present invention.

FIG. 25 is a schematic view illustrating a cross-section of the developer container of the image forming apparatus according to the embodiment of this embodiment.

Figure 26:
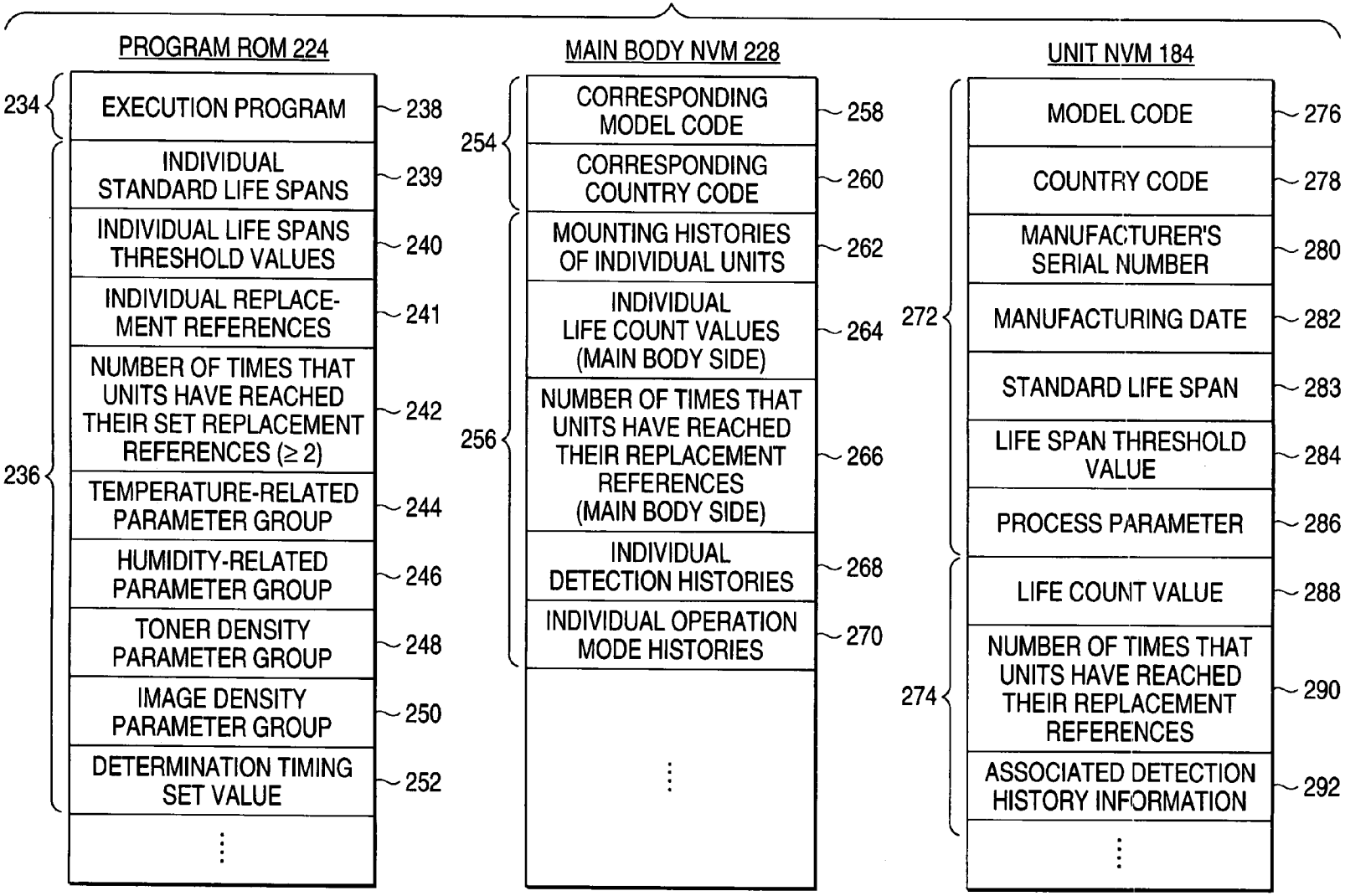
FIG. 26 is a memory map exemplarily showing data which are stored in a program ROM, a main body NVM, and a unit NVM according to one embodiment of the present invention.

FIG. 26 shows an example of the data stored in the program ROM 224, the main body NVM 228 and the unit NVM 184.

The program ROM 224 is provided with a program region 234, a set value region 236 and so on. The program region 234 stores an execution program 238 which operates the image forming apparatus 10. The set value region 236 stores individual standard life spans 239, individual consumption threshold values 240, individual replacement references 241 including a plurality of set values, number of times that units have reached their set replacement references 242, a temperature-related parameter group 244, a humidity-related parameter group 246, a toner density parameter group 248, an image density parameter group 250, determination timing set values 252 and the like.

The individual standard life spans 239 include standard consumption limitations (standard life spans) of the individual replaceable units of the image forming apparatus 10. The individual consumption threshold values 240 include limit values of the consumptions (life span threshold values) which exceed the standard life spans of the individual replaceable units in the image forming apparatus 10 and at which the genuine article does not arrive even when the detections regarding the standard life spans are uneven. The individual replacement references 241 indicate that the toner cartridge 52 is to be replaced. For example, the individual replacement references 241 include the lowest limit value of the toner density (replacement reference toner density) in the developer container 48, the lowest limit value of the image density (replacement reference image density) on the intermediate transfer body 74, and the like. The number of times that units have reached their set replacement references 242 include the number of times which allows the individual replaceable units of the image forming apparatus 10 to arrive at states to be replaced (replacement references). For example, for each unit, an integer of two or more is set. The temperature-related parameter group 244 includes individual parameters related to the control of the temperature of the image forming apparatus 10. The humidity-related parameter group 246 includes individual parameters related to the control of the humidity of the image forming apparatus 10. The toner density parameter group 248 includes individual parameters related to the control of the toner density in the developer container 48. The image density parameter group 250 includes individual parameters related to the control of the image density on the intermediate transfer body 74. The determination timing set values 252 include a period of time (determination timing) which is taken until the CPU 202 starts to determine whether or not the individual replaceable units of the image forming apparatus 10 are the genuine articles, in a process or the like in which the image forming apparatus 10 performs printing preparation fit to an operation mode.

The main body NVM 228 is provided with a corresponding unit information region 254, a main-body-side update region 256, and so on.

The corresponding unit information region 254 stores corresponding model codes 258 and corresponding country codes 260. The corresponding model codes 258 store a table (data) of models indicating whether or not each of the individual replaceable units of the image forming apparatus 10 is a model which is suitable for the image forming apparatus 10. The corresponding country codes 260 store a table (data) of individual countries, in which specifications of the individual replaceable units of the image forming apparatus 10 are set differently for every country.

The main-body-side update region 256 stores mounting histories 262 of individual units, individual life count values 264 on the main body side, number of times that units have reached their lifetime threshold values 266 on the main body side, individual detection histories 268, individual operation mode histories 270, and the like. The individual unit mounting histories 262 include mounting histories of individual replaceable units of the image forming apparatus 10. Further, a value showing that a genuine article is mounted is stored in an initial state (as an initial value) of each of the individual unit mounting histories 262. The individual life count values 264 on the main body side include individual life count values (consumption up to the present time from the time when replaceable units begin to be used) of individual replaceable units of the image forming apparatus 10. Meanwhile, the consumption of the individual units may be calculated from the cumulative operation time or the like of each of the individual units. The number of times that units have reached their lifetime threshold values 266 on the main body side includes number of times that individual replaceable units of the image forming apparatus 10 have reached their lifetime threshold values. The individual detection histories 268 include histories of detection results detected by respective sensors or the like provided in the image forming apparatus 10. The individual operation mode histories 270 include histories of operation modes applied to individual replaceable units of the image forming apparatus 10.

Moreover, data stored in the main-body-side update region 256 may be compressed by the CPU 202 when being written into the main-body-side update region 256 and it may be decompressed by the CPU 202 when being read out from the main-body-side update region 256.

The unit NVM 184 is provided with a unit information region 272, a unit-side update region 274, and so on.

The unit information region 272 stores model codes 276 indicating a model, country codes 278 indicating a country to which the specification of a model is set, manufacturer's serial numbers 280 which are unique to the individual units, manufacturing dates 282, standard life spans 283 indicating a value of the standard life span of a unit, life span threshold values 284 indicating the life span threshold value of the unit, process parameters 286 for process control, and so on.

The unit-side update region 274 stores life count values 288 indicating the consumption of the toner cartridge 52 up to the present from the time when the toner cartridge 52 is started to be used, number of times that units have reached their replacement references 290 indicating how many times the individual units arrive at the replacement references which are stored in the individual replacement references 241, associated detection history information 292, and so on. Moreover, the numbers of times which are stored in the number of times that units have reached their replacement references 290 and initial values of the life count values 288 are set to zero (0), respectively. Further, the associated detection history information 292 includes histories of associated information available for grasping the state of the toner cartridge 52, such as the number of rotation times of the image carrier 54, the detection result of the waste toner fullness sensor 198 or the like.

When image forming signals are transmitted to the image forming apparatus 10 constructed as above, the image carrier 54 is uniformly electrified by the electrifying device 60, and light rays are emitted onto the electrified image carrier 54 from the exposure device 68 on the basis of the image signals. The light rays from the exposure device 68 expose the surface of the image carrier 54, thereby forming a latent image.

The latent image carried by the image carrier 54 is developed at a development position by the developer container unit 44. In the developer container unit 44, the developer containers 48*a* to 48*d* are respectively supplied with yellow, magenta, cyan and black toners from the toner cartridges 52*a* to 52*d*. Further, developers excessively supplied to the developer containers 48*a* to 48*d* are respectively collected into the toner cartridges 52*a* to 52*d*. Toner images developed for the respective colors by the developer containers 48*a* to 48*d* of the developer container unit 44 are superposed on the intermediate transfer body 74 to be primarily transferred thereto. At the time of the primary transfer, a waste toner remaining on the image carrier 54 is scraped by the cleaner 62 for the image carrier 54 to be collected.

On the other hand, upon receiving sheet feeding signals or the like, sheets received in the sheet feeding cassette 24 are fed by the feeding roller 26, are separated by the retard roller 28, and are respectively guided to the conveying path 34. And then the sheet is primarily stopped by the resist roller 38 and is guided between the secondary transfer roller 88 and the secondary transfer backup roller 82 at a predetermined timing. When the sheet is guided between the secondary transfer roller 88 and the secondary transfer backup roller 82, a toner image in which four colors overlap each other by the primary transfer onto the intermediate transfer body 74 is secondarily transferred on the sheet by the secondary transfer roller 88 and the secondary transfer backup roller 82. After the secondary transfer, the waste toner remaining on the intermediate transfer body 74 is scraped by the cleaner 92 for the intermediate transfer body 74 to be collected.

The sheet onto which the toner image has been transferred is guided to the fixing device 100, and the toner image on the sheet is fixed by a thermal pressure generated by the heating roller 102 and the pressing roller 104. The sheet on which the toner image has been fixed is discharged from the discharge port 36 toward the discharge section 42 by means of the discharge roller 40. The control unit 106 makes the unit NVM 184 and the main body NVM 228 store a life count value of the toner cartridge 52 or the like.

FIG. 14 is a graph showing a change in electrification capability of a developer with respect to the consumption (life count value) stored in the main body NVM 228.

Figure 27A:
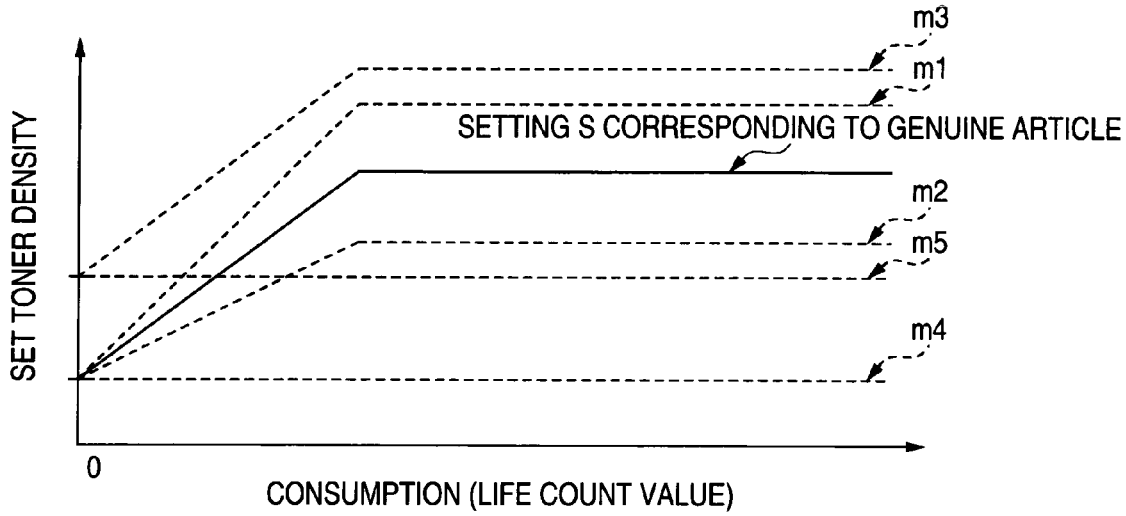
Figure 27B:
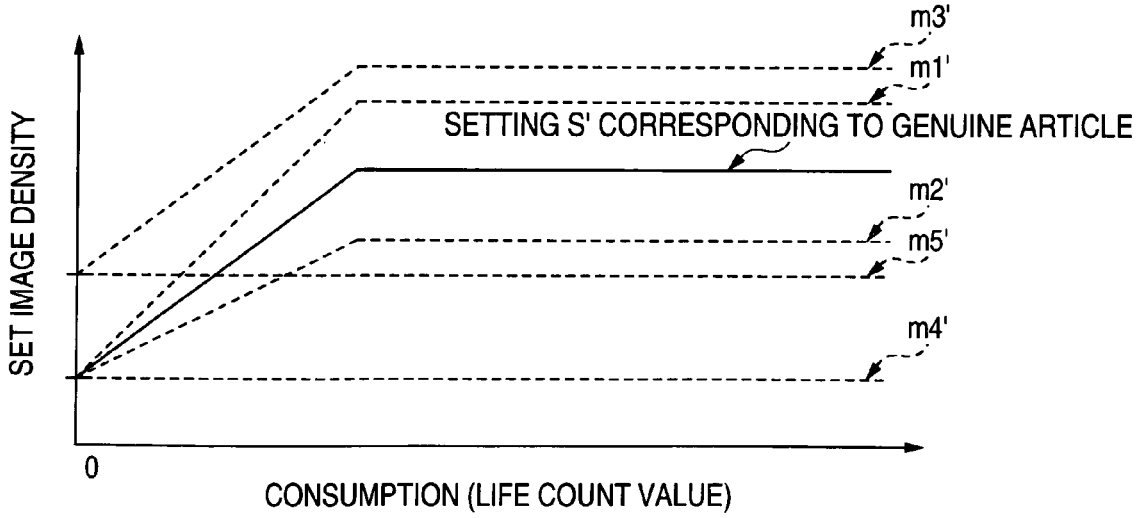

FIGS. 27A and 27B are graphs showing setting for correcting a change in electrification capability of the developer. More specifically, FIG. 27A shows setting of a toner density with respect to the consumption of the developer, and FIG. 27B shows setting of an image density with respect to the consumption of the developer.

FIGS. 16A and 16B are graphs showing results corrected by the setting shown in FIGS. 27A and 27B. More specifically, FIG. 16A shows a corrected toner density, and FIG. 16B shows a corrected image density.

A toner received in the toner cartridge 52 is frictionally electrified so as to have a predetermined polarity and electrification quantity by a carrier in the developer container 48. When a developer is used, the electrification capability of the developer deteriorates according to the consumption of the developer, like characteristics of a genuine toner P shown in FIG. 14.

Thus, even when a trickle development method is employed, in order to maintain the image quality of an image formed on the sheet at a predetermined level, the image forming apparatus 10 is configured such that the settings with respect to the toner density in the developer container 48 and the image density on the intermediate transfer body 74 is corrected.

For example, the CPU 202 corrects the set value of the toner density in the developer container 48, which is stored in the toner density parameter group 248, so as to increase according to the consumption of the developer, such that the density of the image to be transferred onto the sheet is not lowered even when the electrification capability of the developer is lowered. The CPU 202 rotates the first auger 118 according to the corrected set value (in FIG. 27A, the setting S corresponding to the toner P) and keep the toner density such that the toner density to be detected by the toner density sensor 142 is not below a predetermined value of the specification as shown in FIG. 16A.

Further, the CPU 202 corrects the set value of the image density on the intermediate transfer body 74, which is stored in the image density parameter group 250, so as to increase according to the consumption of the developer, such that the density of the image to be transferred onto the sheet is not lowered even when the electrification capability of the developer is lowered. The CPU 202 rotates the first auger 118 according to the corrected set value (in FIG. 27B, the setting S' corresponding to the toner P) and keep the image density such that the image density to be detected by the image density sensor 90 is not below a predetermined value of the specification as shown in FIG. 16B.

On the other hand, in case a toner cartridge other than a genuine cartridge, having approximately the same construction as that of the toner cartridge 52 which receives a toner X or a toner Y of a non-genuine article, is mounted on the image forming apparatus 10, as shown in FIG. 14, it is expected the toner X or the toner Y will exhibit characteristics different form those of the genuine toner P. Thus, in order to improve the quality of the image to be formed on the sheet, corrected set values different from the settings S and S' corresponding to the toner P are required. Accordingly, for example, in the case of any cartridge other than a genuine cartridge, which receives the toner X or the toner Y other of the non-genuine article, the correction of the consumption of the developer is changed by the combination of conditions to be changed, such as increasing or decreasing the degree of a change (gradient) in the set value of the toner density (m1 or m2 in FIG. 27A); increasing or decreasing a limit value (m1 or m2); varying an initial value (consumption=0) (m3); making no change in the set value according to the consumption (m4); and making no change in the set value according to the consumption, for example, by varying an initial value (m5). This change is performed by allowing a user to select an operation mode different from the operation mode corresponding to the genuine article via the UI device 18.

Further, as regard the set value of the image density with respect to the consumption of the developer, the correction of the consumption of the developer is changed by the combination of conditions to be changed, such as increasing or decreasing the degree of a change (gradient) in the set value (m1' or m2' in FIG. 27B); increasing or decreasing a limit value (m1' or m2'); varying an initial value (consumption=0) (m3'); making no change in the set value according to the consumption (m4'); and making no change in the set value according to the consumption, for example, by varying an initial value (m5'). This change is performed by allowing a user to select an operation mode different from that corresponding to the genuine article via the UI device 18. In addition, an operation mode different from the operation mode corresponding to the genuine article may be selected by the combination of the setting of the toner density, the settings of other parameters, and so on.

Moreover, an operation mode different from the operation mode corresponding to the genuine article is not limited to the above-mentioned conditions (settings). For example, in an operation mode, the consumption until it arrives at the limit value may be changed or a set value combined with settings of other replaceable units may be controlled as a target value.

Next, the control of the image forming apparatus 10 based on the data stored in the storage unit 204 and the unit NVM 184 will now be described.

On the basis of the data stored in the storage unit 204 and the unit NVM 184, the image forming apparatus 10 controls display or the like by the UI device 18. For example, if the toner cartridge 52 is the genuine article, the CPU 202 controls the UI device 18 to display the residual quantity of the toner, whereas if the toner cartridge 52 is the non-genuine article, the CPU 202 controls the UI device 18 to display the consumption of the toner. This is because, if the toner cartridge 52 is the non-genuine article, the quantity of the toner is unknown, so the residual quantity of the toner cannot be calculated.

Next, a discriminating method for discriminating whether or not the replaceable unit detachable to the image forming apparatus 10 is the genuine article with respect to the image forming apparatus 10 will now be described.

Figure 28:
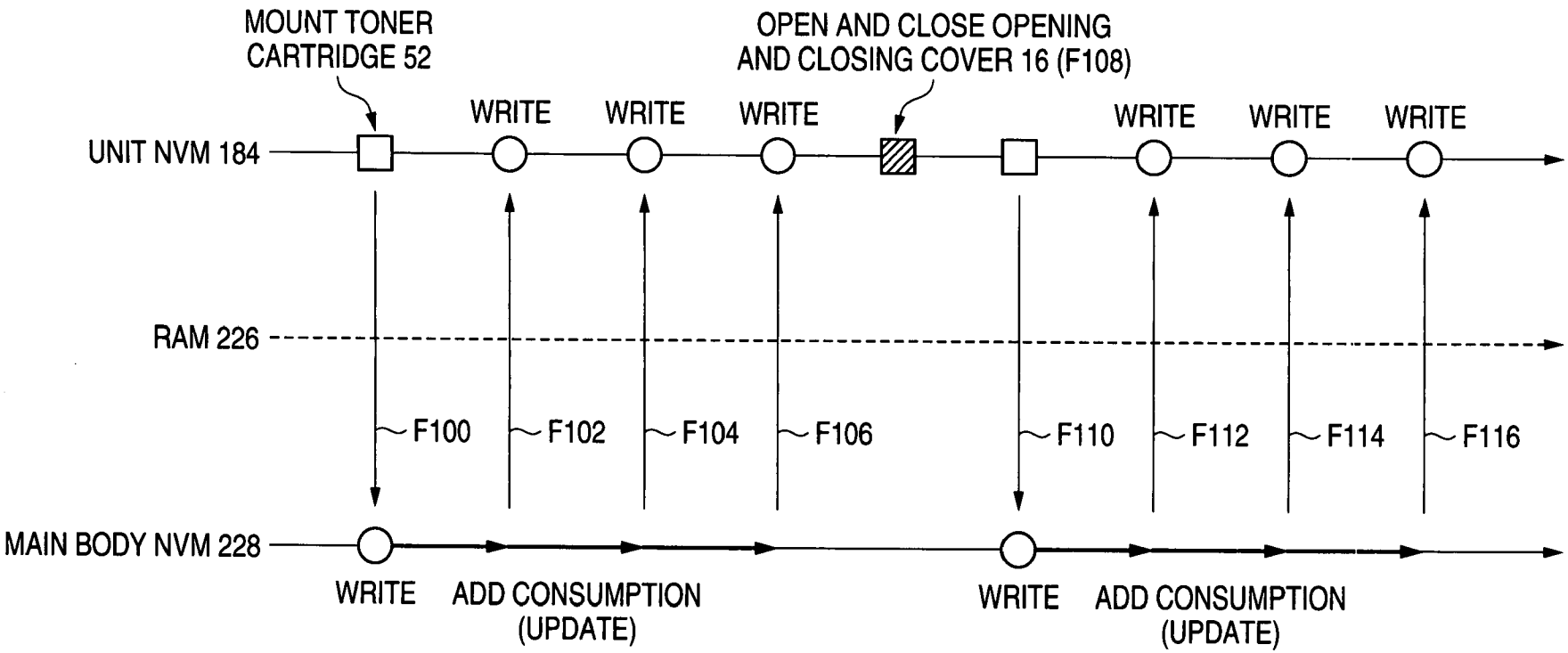
FIG. 28 is a sequence diagram exemplarily showing a sequence of updating data which are stored in a main body NVM and a unit NVM.

FIG. 28 exemplarily shows a sequence of updating the data which are stored in the main body NVM 228 and the unit NVM 184.

As shown in FIG. 28, when the toner cartridge 52 is mounted to the image forming apparatus main body 12, the data which are stored in the life count values 288 and the number of times that units have reached their replacement references 290 of the unit NVM 184 are respectively written into the individual life count values 264 and the number of times that units reached their replacement references 266 of the main body side of the main body NVM 228 via the RAM 226 (F100).

If the image forming apparatus 10 operates, the stored contents of the individual life count values 264, the number of times that units have reached their replacement references 266, and the individual detection histories 268 of the main body side are updated according to the consumption of the toner cartridge 52 or the like and are written into the life count values 288, the number of times that units reached their replacement references 290, and the associated history information 292 of the unit NVM 184 via the RAM 226 at a predetermined timing or period (F102 to F106).

For example, if an event such as opening and closing of the opening and closing cover 16 or the like is generated (F108), the data which are stored in the life count values 288 and the number of times that units have reached their replacement references 290 of the unit NVM 184 is respectively written into the individual life count values 264 and the number of times that units have reached their replacement references 266 of the main body side of the main body NVM 228 via the RAM 226 (F110).

After the event is generated (F108), if the image forming apparatus 10 operates, the stored contents of the individual life count values 264, the number of times that units have reached their replacement references 266, and the individual detection histories 268 of the main body side are updated according to the consumption of the toner cartridge 52 or the like and are written into the life count values 288, the number of times that units have reached their replacement references 290, and the associated history information 292 of the unit NVM 184 via the RAM 226 at a predetermined timing or period (F112 to F116).

Figure 29:
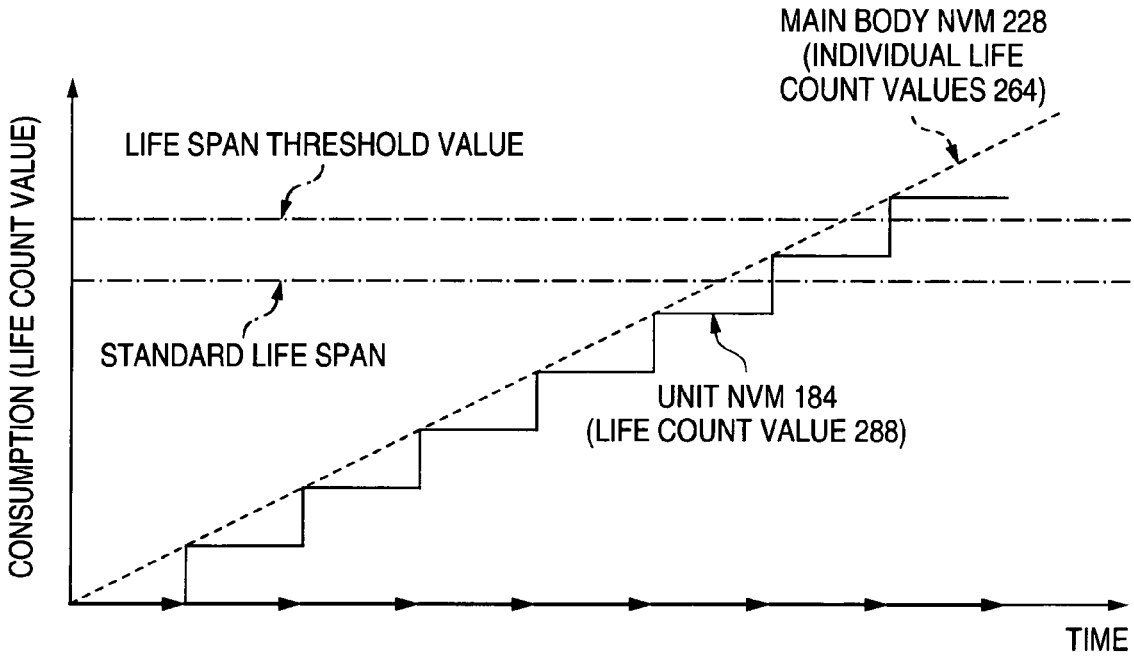
FIG. 29 is a graph showing consumptions which are stored in the main body NVM and the unit NVM and updated, when a toner cartridge is used in approximately proportion to the time.

FIG. 29 shows the consumptions (lift count values) which are stored and updated in the main body NVM 228 and the unit NVM 184, when the toner cartridge 52 is used in approximately proportion to the time (the image forming apparatus 10 operates), for example.

As shown in FIG. 29, the life count values which are stored in the main body NVM 228 are updated according to the operation of the image forming apparatus 10, and the life count values which are stored in the unit NVM 184 are updated at the predetermined timing or period. As described above, the life span threshold values are limit values of the consumptions at which the genuine article does not arrive even when the detections regarding the standard life spans of the toner cartridge 52 are uneven. Thus, if the life count values which are stored in the unit NVM 184 are equal to or more than the life span threshold values, any one of the toner cartridge 52 and the toner in the toner cartridge 52 is discriminated that it is the non-genuine article to the image forming apparatus 10.

Figure 30:
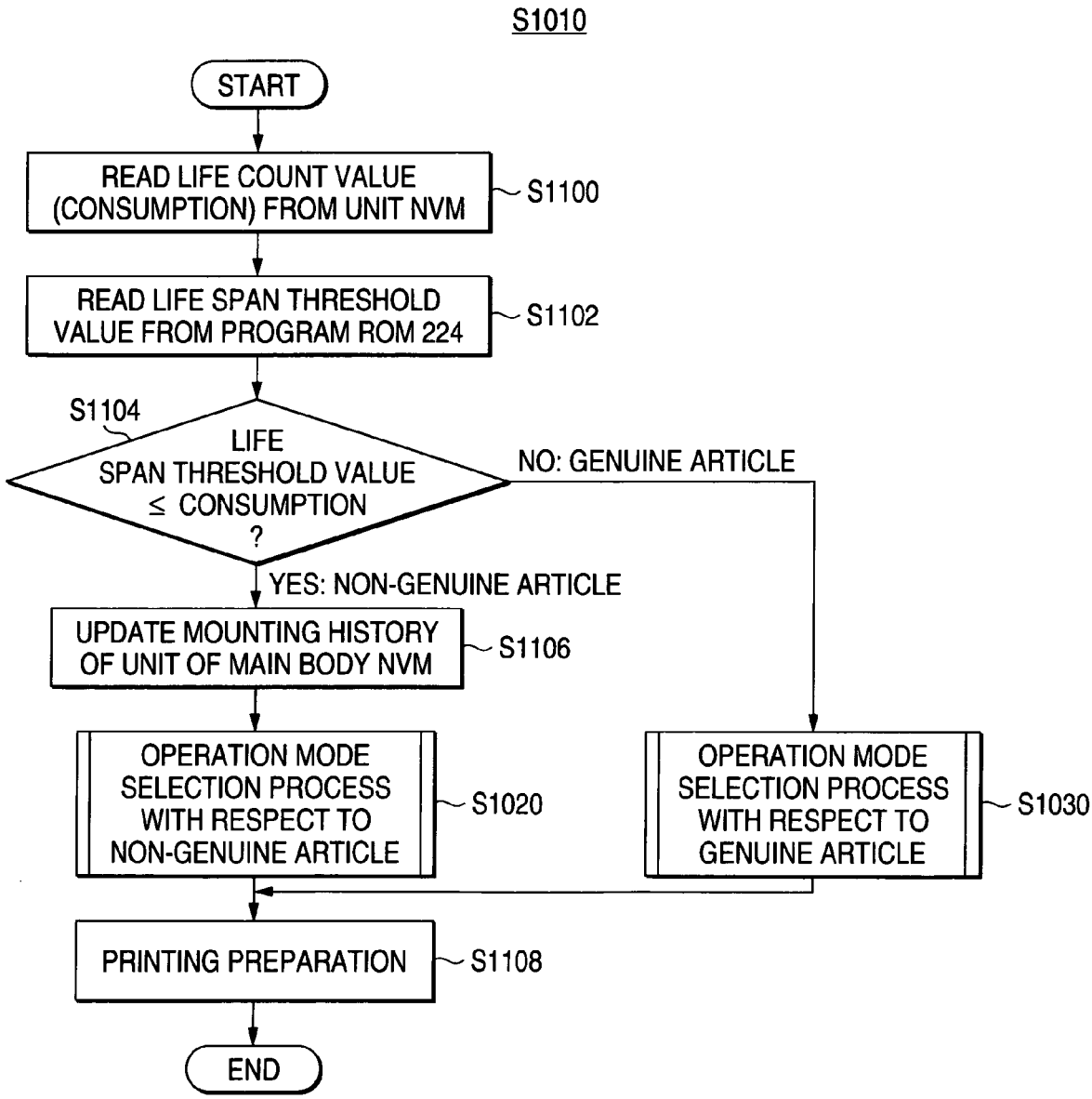
FIG. 30 is a flowchart (S1010) showing a process in which, based on a life span threshold value of a toner cartridge, a CPU discriminates whether or not a toner cartridge is a genuine article with respect to the image forming apparatus.

FIG. 30 is a flowchart showing a process (S1010) in which, based on the life span threshold values 284 of the toner cartridge 52, the CPU discriminates whether or not the toner cartridge 52 is the genuine article with respect to the image forming apparatus 10.

Moreover, the toner cartridge which is the non-genuine article includes one in which only a toner being received the toner cartridge 52 is the non-genuine article.

Figure 31:
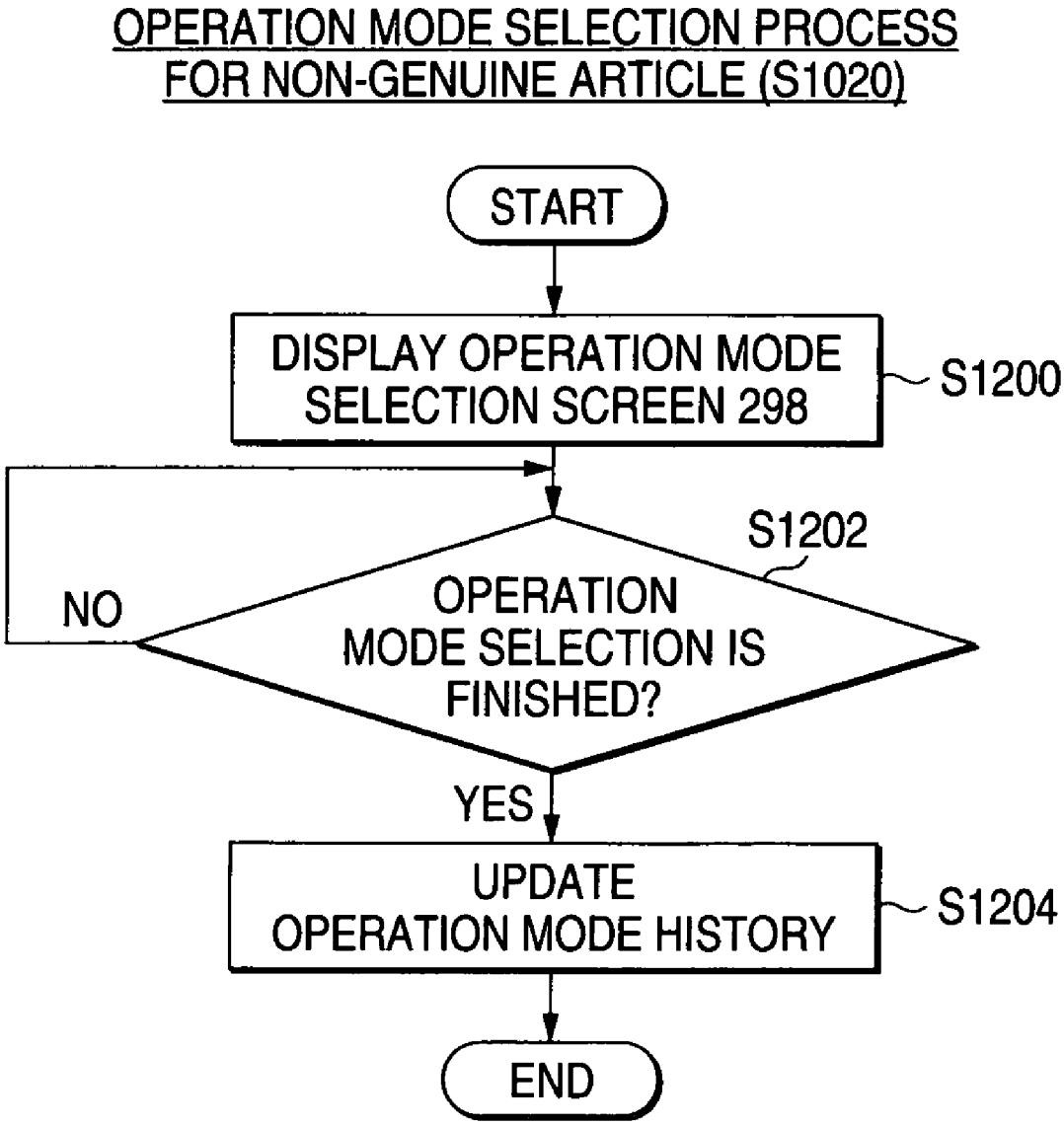
FIG. 31 is a flowchart showing an operation mode selection process (S1020) for a non-genuine article, which is performed by the image forming apparatus, such that a user can select an operation mode for the non-genuine article.

FIG. 31 is a flowchart showing an operation mode selection process (S1020) for a non-genuine article, which is performed by the image forming apparatus 10, such that a user can select an operation mode for the non-genuine article.

Figure 32:
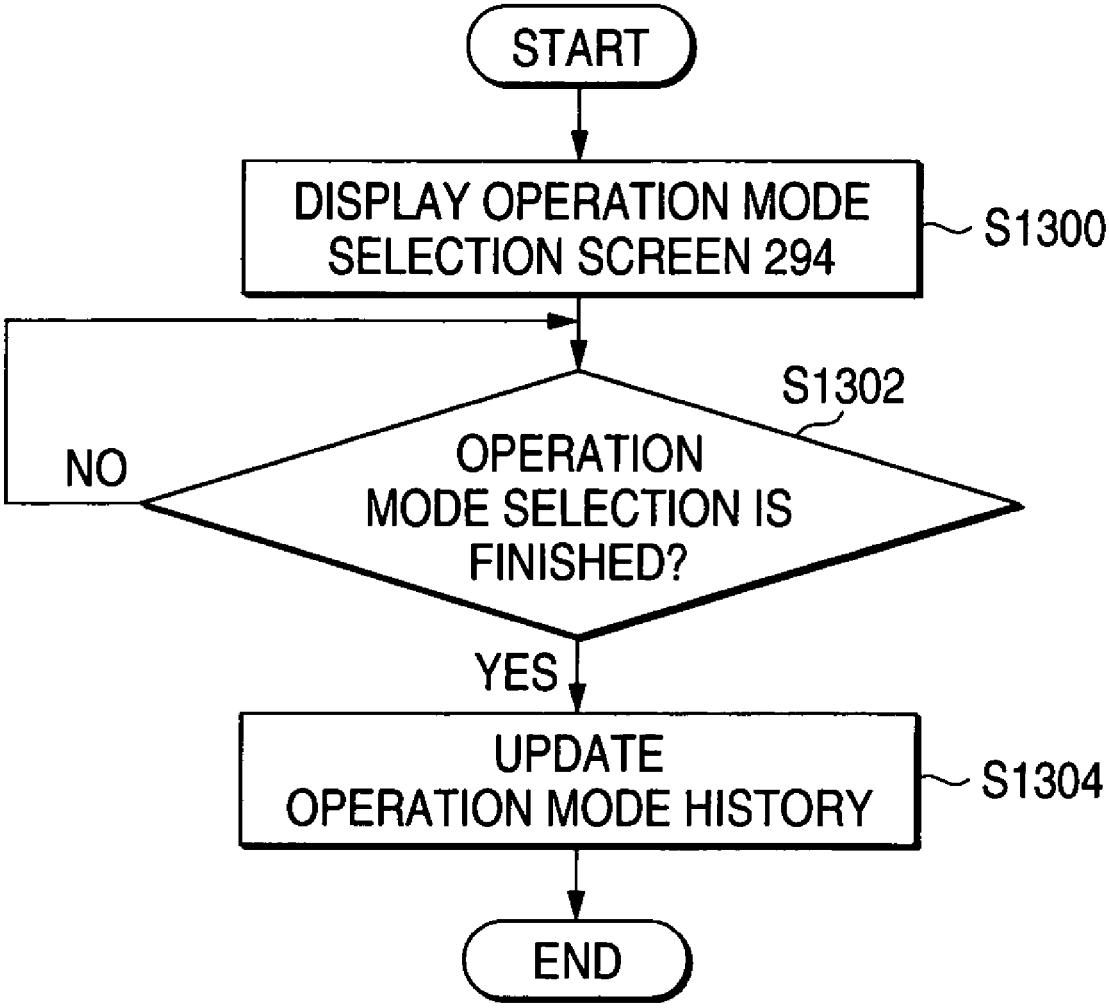
FIG. 32 is a flowchart showing an operation mode selection process (S1030) for a genuine article, which is performed by the image forming apparatus, such that a user can select an operation mode for the genuine article.

FIG. 32 is a flowchart showing an operation mode selection process (S1030) for the genuine article, which is performed by the image forming apparatus 10, such that a user can select an operation mode for the genuine article.

As shown in FIG. 30, in the step 1100 (S1100), the CPU 202 reads the life count values 288 from the unit NVM 184.

In the step 1102 (S1102), the CPU 202 reads the life span threshold values of the toner cartridge 52 from the individual consumption threshold values 240 of the program ROM 224. Here, the life span threshold values may be calculated by reading the standard life spans, instead of the life span threshold values, and multiplying previously programmed coefficients. In addition, discrimination codes and threshold values corresponding to the discrimination codes may be previously set in a program, and then the corresponding threshold value to the read discrimination code may be used.

In the step 1104 (S1104), the CPU 202 discriminates whether or not the life count value 288 read in S1100 is equal to or more than the life span threshold value of the toner cartridge 52 read in S1102. When the life count value 288 is less than the life span threshold value of the toner cartridge 52, the CPU 202 regards the toner cartridge 52 and the toner in the toner cartridge 52 as the genuine article, and then the process progresses to S1030. If the life count value 288 is equal to or more than the life span threshold value of the toner cartridge 52, the CPU 202 regards the toner cartridge 52 as the non-genuine article and then the process progresses to S1106.

In the step 1106 (S1106), the CPU 202 updates the mounting history of the toner cartridge, which is included in the mounting histories of the individual units of the main body NVM 228, that the toner cartridge to be currently mounted is the non-genuine article, and the process progresses to S1020.

In the step 1200 (S1200 in FIG. 31), the UI device 18 displays an operation mode selection screen 298 shown in FIG. 21B.

In the step 1202 (S1202), the CPU 202 determines whether or not an input is finished which selects either a key button 296*a* for selecting a default mode (an operation mode corresponding to a genuine article) displayed on the operation mode selection screen 298 or a key button 296*b* for specifying other operation modes. If the input which selects any one of the key buttons 296*a* and 296*b* is finished, the process progresses to S1204. If there is no input for specifying any one of the operation modes, the image forming apparatus 10 waits until a user selects any operation mode.

In the step 1204 (S1204), the CPU 202 updates (including overwrite) the individual operation mode histories 270 of the main body NVM 228 to an operation mode selected in S1202.

In the step 1300 (S1300 in FIG. 32), the UI device 18 displays the operation mode selection screen 294 shown in FIG. 21A.

In the step 1302 (S1302), the CPU 202 determines whether or not an input is finished which selects either the key button 296*a* for selecting a default mode (an operation mode corresponding to a genuine article) displayed on the operation mode selection screen 294 or a key button 296*b* for specifying other operation modes. If the input which selects any one of the key buttons 296*a* and 296*b* is finished, the process progresses to S1304. If there is no input for specifying any one of the operation modes, the image forming apparatus 10 waits until a user selects any operation mode.

In the step 1304 (S1304), the CPU 202 updates (including overwrite) the individual operation mode histories 270 of the main body NVM 228 to an operation mode selected in S1302.

In the step 1108 (S1108 in FIG. 30), the CPU 202 performs printing preparation fit to a selected operation mode which is included in the latest individual operation mode histories 270, and the process is ended. Moreover, in the printing preparation in S1108, for example, whether or not the mounted toner cartridge 52 is the genuine article may be displayed on the UI device 18.

Moreover, a plurality of other operation modes different from an operation mode corresponding to the genuine article may be configured such that a user can freely select any operation mode from the plurality of other operation modes.

As such, even when a replaceable unit of the image forming apparatus 10 is the non-genuine article, a user can select any operation mode different from an operation mode corresponding to the genuine article, such that the image quality can be improved.

Further, if all of the replaceable units are the genuine article, an operation mode which can be selected by the user is limited such that the image forming apparatus 10 operates only in the operation mode corresponding to the genuine article, thereby preventing the image quality from deteriorating due to the user's misjudgment.

Next, a first modification of the discriminating method of discriminating whether or not the replaceable unit detachable to the image forming apparatus 10 is the genuine article with respect to the image forming apparatus 10 will be described.

Figure 33:
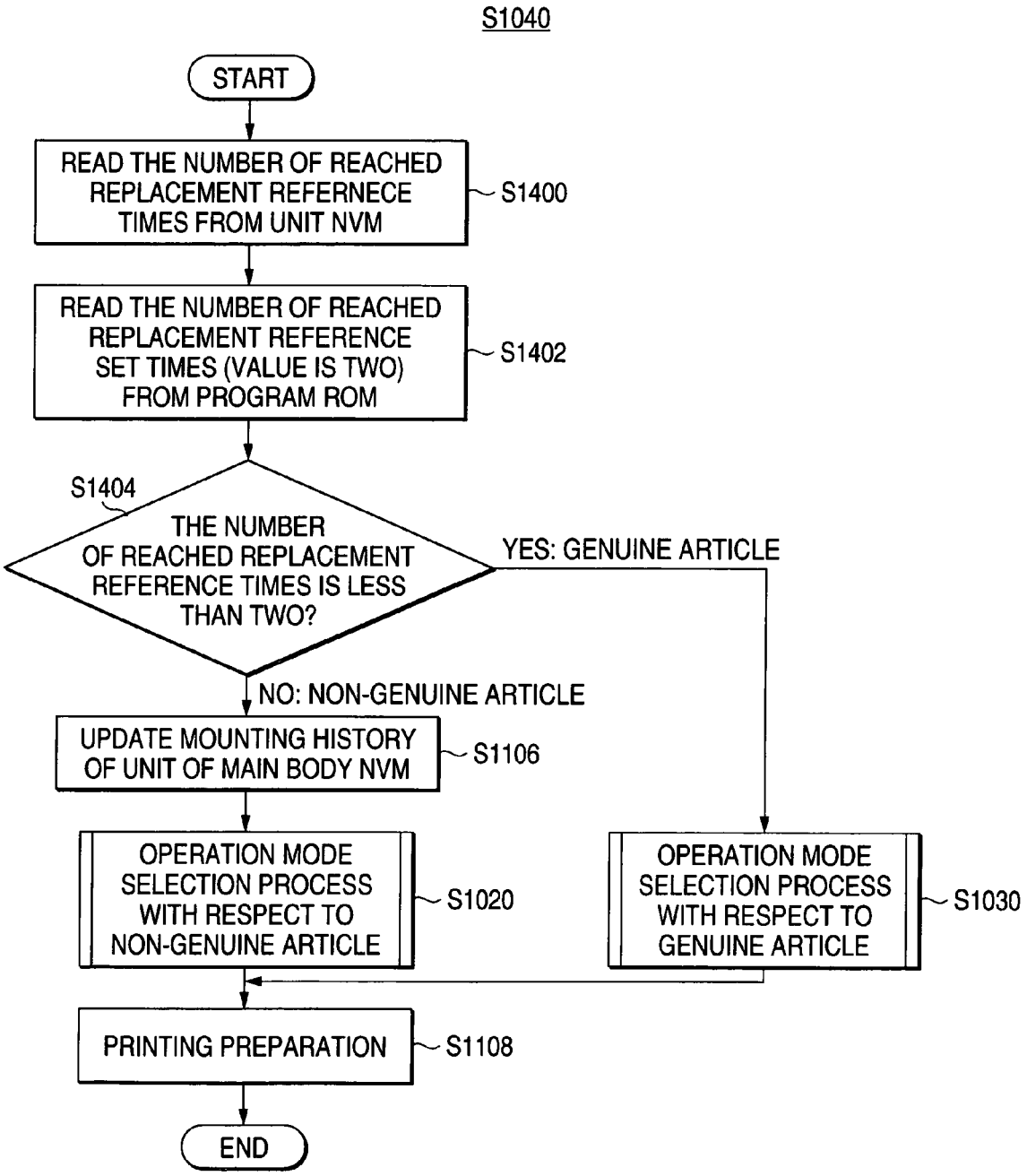
FIG. 33 is a flowchart (S1040) showing a first modification of a discriminating method of discriminating whether or not a replaceable unit is a genuine article with respect to the image forming apparatus.

FIG. 33 is a flowchart (S1040) showing the first modification of the discriminating method of discriminating whether or not the replaceable unit is the genuine article with respect to the image forming apparatus 10. Moreover, in S1040 shown in FIG. 33, the substantially same processes as those in S1010 shown in FIG. 30 are given the same reference numerals.

As shown in FIG. 33, in the step 1400 (S1400), the CPU 202 reads the number of reached replacement reference times from the number of times that units have reached their replacement references 290 of the unit NVM 184.

In the step 1402 (S1402), the CPU 202 reads the number of reached replacement reference set times corresponding to the number of reached replacement reference times read from the number of times that units have reached their set replacement references 242 of the program ROM 224 in S1400. Here, the number of reached replacement reference set times is, for example, two.

In the step 1404 (S1404), the CPU 202 discriminates whether or not the number of reached replacement reference times read in S1400 is equal to or less than the number of reached replacement reference set times (the value is two) read in S1402. If the number of reached replacement reference time is equal to or less than two, the CPU 202 regards the toner cartridge 52 and the toner in the toner cartridge 52 as the genuine article, and then the process progresses to S1030. If the number of reached replacement reference times is more than two, the CPU 202 regards the toner cartridge 52 as the non-genuine article, and then the process progresses to S1106.

Moreover, in the first modification (S1040) of the discrimination method of discriminating whether or not the replaceable unit is the genuine article with respect to the image forming apparatus 10, the process of S1030 may be not performed.

Next, modifications of the image forming apparatus according to the embodiment of the present invention will be described.

FIG. 24 shows a modification of the image forming apparatus according to the embodiment of the present invention. Moreover, in the modification of the image forming apparatus, the substantially same elements as those of the image forming apparatus 10 shown in FIG. 12 are given the same reference numerals.

The modification of the image forming apparatus has replaceable units, such as five wireless communication units 304*a* to 304*d* and 308, toner cartridges 305*a* to 305*d* which are replaceably arranged at predetermined positions in the image forming apparatus and which accommodate yellow, magenta, cyan and black toners respectively, and an image carrier unit 309 having an image carrier such as a photoreceptor, a waste toner collecting bottle for collecting a waste toner collected from the image carrier, or the like. Moreover, in the waste toner collecting bottle which is provided in the image carrier unit 309, the waste toner fullness sensor 198 and the float 200, for example, shown in FIG. 11 are provided, such that whether or not the waste toner collecting bottle is full is detected.

The wireless communication units 304*a* to 304*d* and 308 have the same construction as that of the wireless communication unit 56 shown in FIG. 8 and are fixed to, for example, the image forming apparatus main body. The memory chips 306 have the same construction as that of the memory chip 170 shown in FIG. 9 and are provided in, for example, the toner cartridges 305*a* to 305*d*, respectively. Further, when the toner cartridges 305*a* to 305*d* are mounted to the image forming apparatus main body, the memory chips 306 are disposed in the vicinities of the wireless communication units 304*a* to 304*d*, respectively and transmit or receive signals with the wireless communication units 304*a* to 304*d*, respectively, under the control of the CPU 202. The memory chip 310 has the same construction as that of the memory chip 170 shown in FIG. 9 and is provided in, for example, the image carrier unit 309. Further, the memory chip 310 is constructed to store the detection result of the waste toner fullness sensor 198. In addition, when the image carrier unit 309 is mounted to the image forming apparatus main body, the memory chip 310 is disposed in the vicinity of the wireless communication unit 308 and transmits or receives signals with the wireless communication unit 308 under the control of the CPU 202.

Next, a discriminating method of discriminating whether or not the replaceable unit detachable to the modification of the image forming apparatus is the genuine article with respect to the modification of the image forming apparatus will be described.

Figure 34:
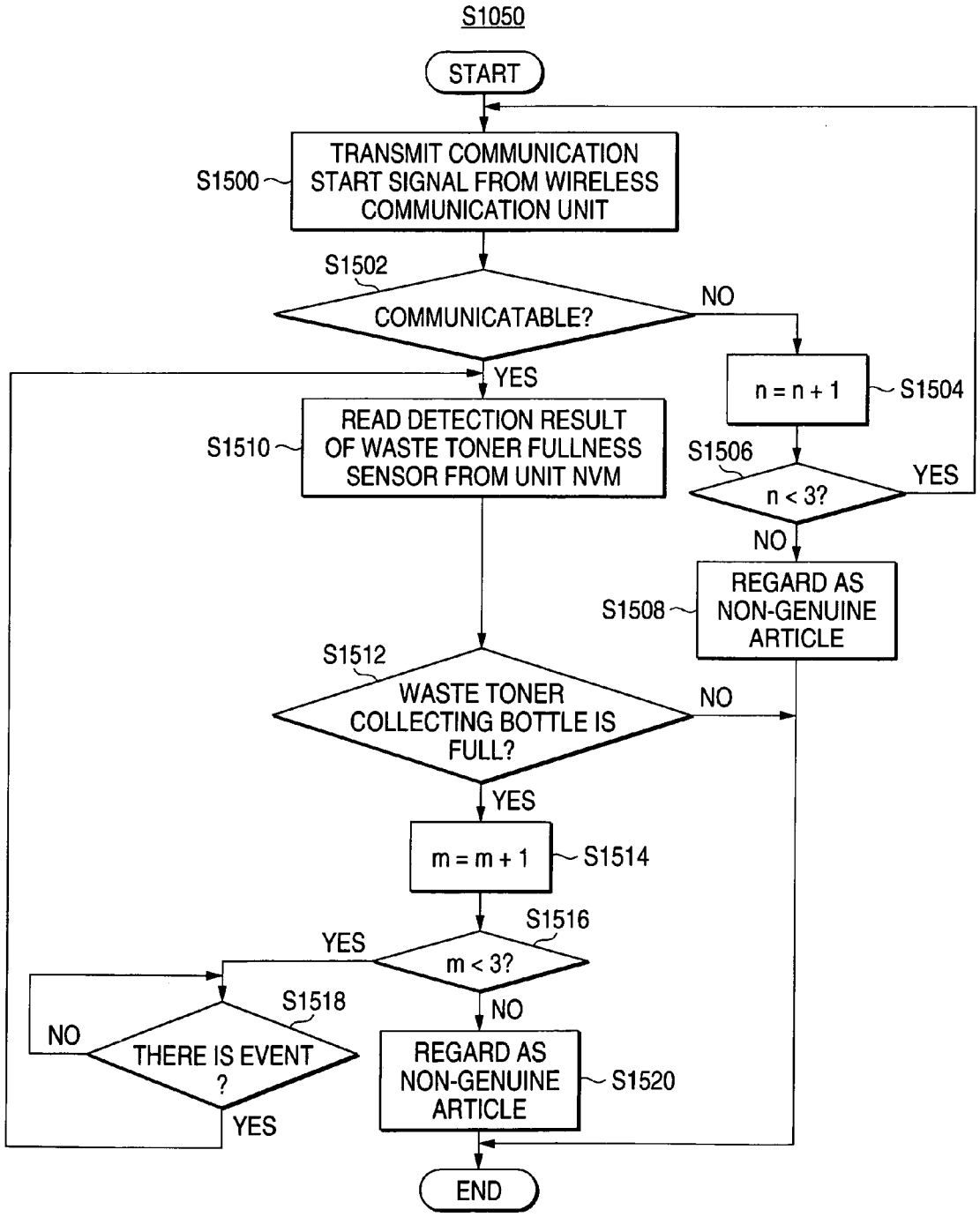
FIG. 34 is a flowchart (S1050) showing a process in which the CPU discriminates whether an image carrier unit is a genuine article with respect to the modification of the image forming apparatus.

FIG. 34 is a flowchart (S1050) showing a process in which the CPU 202 discriminates whether the image carrier unit 309 is the genuine article with respect to the modification of the image forming apparatus.

As shown in FIG. 34, in the step 1500 (S1500), the wireless communication unit 308 transmits a communication start signal (an electric wave signal) to the memory chip 310 of the image carrier unit 309 under the control of the CPU 202.

In the step 1502 (S1502), the CPU 202 confirms via the wireless communication unit 308 whether or not the memory chip 310 transmits an acknowledge signal and discriminates whether or not the wireless communication unit 308 and the memory chip 310 are communicatable with each other. If the CPU 202 discriminates that the wireless communication unit 308 and the memory chip 310 are communicatable with each other, the process progresses to S1510. Meanwhile, if it is discriminated that the wireless communication unit 308 and the memory chip 310 are not communicatable with each other, the process progresses to S1504.

In the step 1504 (S1504), the CPU 202 adds one (1) to the number of communication impossibility times n indicating the number of discriminated times that the wireless communication unit 308 and the memory chip 310 are communicatable with each other. Moreover, the number of communication impossibility times n is a value having an initial value of zero (0) which is counted, for example, by the CPU 202 with the RAM 226 or the like.

In the step 1506 (S1506), the CPU 202 discriminates whether the number of communication impossibility times n is less than three (3). If the number of communication impossibility times n is less than three (3), the process progresses to S1500, while if the number of communication impossibility times n is equal to or more than three (3), the process progresses to S1508. Moreover, the value (three (3)) used in S1506 is an integer which is included in the number of times that units have reached their set replacement references 242 of the program ROM 224 or the execution program 238 and which is used to confirm the communication between the wireless communication unit 308 and the memory chip 310 several times (set to twice times or more).

In the step 1508 (S1508), the CPU 202 performs a process of setting a flag (not shown) indicating that the image carrier unit 309 is the non-genuine article or the like and regards the image carrier unit 309 as the non-genuine article.

In the step 1510 (S1510), the CPU 202 reads the detection result of the waste toner fullness sensor 198 from the unit NVM 184 of the memory chip 310 via the wireless communication unit 308.

In the step 1512 (S1512), it is discriminated whether or not the waste toner collecting bottle is full on the basis of the detection result of the waste toner fullness sensor 198 read in the process of S1510. If the waste toner collecting bottle is full, the process progresses to S1514, while if the waste toner collecting bottle is not full, the process is ended.

In the step 1514 (S1514), the CPU 202 adds one (1) to the number of fullness times m indicating the number of discriminated times that the waste toner collecting bottle is full in the process of S1512. Moreover, the number of fullness times m has an initial value of zero (0) and is stored in at least one of the number of times that units have reached their replacement references 290 and the number of times that units have reached their replacement references 266 of the main body side.

In the step 1516 (S1516), the CPU 202 discriminates whether or not the number of fullness times m is less than three (3). If the number of fullness times m is less than three (3), the process progresses to S1518, while if the number of fullness times m is equal to or more than three (3), the process progresses to S1520. Moreover, the value (three (3)) used in the process of S1516 is stored in the number of times that units have reached their set replacement references 242 of the program ROM 224. Here, this value is set such that the discrimination in the process of S1512 is plurally performed (set to twice times or more).

In the step 1518 (S1518), the CPU 202 determines whether or not there was an event, such as printing performance, giving a change in the detection result of the waste toner fullness sensor 198. If there was an event, the process progresses to S1510. While, if there was no event, the CPU 202 waits until an event is generated.

In the step 1520 (S1520), the CPU 202 performs a process of setting a flag (not shown) indicating that the image carrier unit 309 is the non-genuine article and regards the image carrier unit 309 as the non-genuine article.

As such, the modification of the image forming apparatus can discriminates whether or not the wireless communication unit 308 is communicatable with the image carrier unit or whether or not the image carrier unit is likely to be the non-genuine article, on the basis of the communication result of the memory chip 310 and the wireless communication unit 308. Further, whether or not the image carrier unit is likely to be the non-genuine article may be discriminated only by discriminating whether the wireless communication unit 308 is communicatable with the image carrier unit. In addition, it may be discriminated on the basis of the writing results of the information from the wireless communication unit 308 to the unit NVM 184 of the memory chip 310.

What is claimed is:

1. An image forming apparatus comprising:

an image forming apparatus main body, at least one replaceable unit replaceably mounted in the image forming apparatus main body, a discriminating unit that discriminates whether or not the replaceable unit is a genuine article, an input unit for selecting any one of an operation mode corresponding to a replaceable unit which is a genuine article and other operation modes, different from the operation mode, corresponding to a replacement unit that is other than a genuine article, and a control unit that performs control in an operation mode selected by the input unit that improves an image quality and/or an operational performance achieved with a replacement unit other than a genuine article.

2. The image forming apparatus according to claim 1, wherein the operation mode corresponding to the replaceable unit which is a genuine article is set as a default.

3. The image forming apparatus according to claim 1, the apparatus further comprising a display unit that performs display on the basis of discrimination results of the discriminating unit.

4. An image forming apparatus comprising:

an image forming apparatus main body, at least one replaceable unit replaceably mounted in the image forming apparatus main body, a detecting unit that detects that the replaceable unit has been replaced, a discriminating unit that discriminates whether or not the replaceable unit is a genuine article, if the detecting unit detects that the replaceable unit has been replaced, an input unit for selecting any one of an operation mode corresponding to a replaceable unit which is a genuine article and other operation modes, different from the operation mode, corresponding to a replacement unit that is other than a genuine article, and a control unit that performs control in an operation mode selected by the input unit that improves an image quality and/or an operational performance achieved with a replacement unit other than a genuine article.

5. The image forming apparatus according to claim 4, wherein the input unit can select an operation mode even when the replacement of the replaceable unit is not detected by the detecting unit.

6. The image forming apparatus according to claim 4, wherein the discriminating unit discriminates whether or not the replaceable unit is a genuine article when the detecting unit detects that the replaceable unit has been replaced.

7. The image forming apparatus according to claim 4, wherein the discriminating unit discriminates whether or not the replaceable unit is a genuine article after the detecting unit detects that the replaceable unit has been replaced.

8. An image forming system comprising:

an image forming apparatus, and a host apparatus connected to the image forming apparatus, the image forming apparatus having:

an image forming apparatus main body, at least one replaceable unit replaceably mounted in the image forming apparatus main body, a discriminating unit that discriminates whether or not the replaceable unit is a genuine article, and a control unit that performs control in an operation mode selected, the host apparatus having an input unit for selecting any one of an operation mode corresponding to a replaceable unit which is a genuine article and other operation modes different from the operation mode, corresponding to a replacement unit that is other than a genuine article, wherein the control unit performs control in a selected operation mode corresponding to a replacement unit that is other than a genuine article to improve an image quality and/or an operational performance achieved with a replacement unit other than a genuine article.

9. A method of controlling an image forming apparatus in which at least one replaceable unit is mounted in an image forming apparatus main body, the method comprising:

discriminating whether or not the mounted replaceable unit is a genuine article, waiting until a user selects an operating mode after performing display that urges the user to select an operation mode, corresponding to a replacement unit that is other than a genuine article, and performing control in an operation mode corresponding to input by the user, if the user inputs the operation mode, that improves an image quality and/or an operational performance achieved with a replacement unit other than a genuine article.

10. A method of controlling an image forming apparatus in which at least one replaceable unit is mounted in an image forming apparatus main body, the method comprising:

discriminating whether or not the mounted replaceable unit is a genuine article, waiting until a user selects an operating mode after performing display that urges the user to select an operation mode corresponding to a replacement unit that is other than a genuine article, if it is discriminated that the mounted replaceable unit is not genuine, and performing control in an operation mode corresponding to input by the user, if the user inputs the operation mode, that improves an image quality and/or an operational performance achieved with a replacement unit other than a genuine article.

11. A method of controlling an image forming apparatus in which at least one replaceable unit is mounted in an image forming apparatus main body, the method comprising:

detecting that the replaceable unit has been mounted in the image forming apparatus main body, discriminating whether or not the mounted replaceable unit is a genuine article, waiting until a user selects an operating mode after performing display that urges the user to select an operation mode corresponding to a replacement unit that is other than a genuine article, and performing control in an operation mode corresponding to input by the user, if the user inputs an operation mode corresponding to a replacement unit that is other than a genuine article, that improves an image quality and/or an operational performance achieved with a replacement unit other than a genuine article.

12. A method of controlling an image forming apparatus in which at least one replaceable unit is mounted in an image forming apparatus main body, the method comprising:

detecting that the replaceable unit has been mounted in the image forming apparatus main body, discriminating whether or not the mounted replaceable unit is a genuine article, waiting until a user selects an operating mode after performing display that urges the user to select an operation mode corresponding to a replacement unit that is other than a genuine article, if it is discriminated that the mounted replaceable unit is not a genuine article, and performing control in an operation mode corresponding to input by the user, if the user inputs an operation mode corresponding to a replacement unit that is other than a genuine article, that improves an image quality and/or an operational performance achieved with a replacement unit other than a genuine article.

* * * * *